US009005856B2

(12) United States Patent
Shimada et al.

(10) Patent No.: US 9,005,856 B2
(45) Date of Patent: Apr. 14, 2015

(54) HYDROXYGALLIUM PORPHYRAZINE DERIVATIVE MIXTURE AND ELECTROPHOTOGRAPHIC PHOTOCONDUCTOR

(75) Inventors: Tomoyuki Shimada, Shizuoka (JP); Ryota Arai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/414,053

(22) Filed: Mar. 7, 2012

(65) Prior Publication Data

US 2012/0231380 A1 Sep. 13, 2012

(30) Foreign Application Priority Data

Mar. 9, 2011 (JP) ..... 2011-052237
Mar. 10, 2011 (JP) ..... 2011-052410

(51) Int. Cl.
*G03G 5/043* (2006.01)
*G03G 5/06* (2006.01)
*G03G 5/047* (2006.01)

(52) U.S. Cl.
CPC ..... *G03G 5/0696* (2013.01); *G03G 5/047* (2013.01); *G03G 5/0675* (2013.01)

(58) Field of Classification Search
USPC ..... 430/77
See application file for complete search history.

(56) References Cited

U.S. PATENT DOCUMENTS

| | | | |
|---|---|---|---|
| 5,302,479 | A | 4/1994 | Daimon et al. |
| 5,358,813 | A | 10/1994 | Iijima et al. |
| 5,393,629 | A | 2/1995 | Nukada et al. |
| 6,313,288 | B1 | 11/2001 | Shimada et al. |
| 6,524,761 | B2 | 2/2003 | Shimada et al. |

FOREIGN PATENT DOCUMENTS

| | | |
|---|---|---|
| JP | 3-27111 | 4/1991 |
| JP | 5-263007 | 10/1993 |
| JP | 2637485 | 4/1997 |
| JP | 2000-212462 | 8/2000 |
| JP | 3123185 | 10/2000 |
| JP | 3166293 | 3/2001 |
| JP | 4293694 | 4/2009 |
| JP | 4419873 | 12/2009 |

OTHER PUBLICATIONS

Yoshihide Fujimaki, "High Photosensitivity of an Organic Photoreceptor", IS & T's 7th International Congress on Advances in Non-Impact Printing Technologies, 1,269, 1991, pp. 269-275.
Katsumi Daimon, et al., "A New Polymorph of Hydroxygallium Phthalocyanine and its Application in a Photoreceptor", Journal of Imaging Science and Technology, vol. 40, No. 3, May/Jun. 1996, pp. 249-253.
Office Action issued Oct. 27, 2014, in Japanese Patent Application No. 2011-052237, filed Mar. 9, 2011.

*Primary Examiner* — Brian McDowell
(74) *Attorney, Agent, or Firm* — Oblon, Spivak, McClelland, Maier & Neustadt, L.L.P.

(57) ABSTRACT

A hydroxygallium porphyrazine derivative mixture including: a plurality of different hydroxygallium porphyrazine derivatives each represented by the following General Formula (A-2):

General Formula (A-2)

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

9 Claims, 27 Drawing Sheets

HYDROXYGALLIUM PORPHYRAZINE DERIVATIVE MIXTURE AND ELECTROPHOTOGRAPHIC PHOTOCONDUCTOR

BACKGROUND OF THE INVENTION

1. Field of the Invention

The present invention relates to a hydroxygallium porphyrazine derivative mixture and an electrophotographic photoconductor.

2. Description of the Related Art

Conventionally known photoelectroconductive materials of photoconductors used in electrophotography are roughly classified to inorganic photoelectroconductive materials and organic photoelectroconductive materials. In general, "electrophotography" refers to a so-called Carlson process which is an image forming process where a photoconductor containing such photoelectroconductive materials is first charged in the dark through, for example, colona discharge; then the photoconductor is imagewise exposed to light so that charges only in the light-exposed portion are selectively dissipated to obtain a latent electrostatic image; then the latent electrostatic image is developed with a toner containing a polymer and a colorant such as a dye or pigment to form a visible image. Photoconductors containing organic photoelectroconductive materials superior to those containing inorganic photoelectroconductive materials in terms of selectivity in photoconductive wavelength regions, film formability, flexibility, film transparency, mass productivity, toxicity and cost. Thus, currently, most of the photoconductors use organic photoelectroconductive materials. Also, photoconductors repeatedly used in such electrophotography and other similar processes are required to be excellent in electrostatic characteristics such as sensitivity, receptive potential, potential retentability, potential stability, residual potential and spectral response.

In recent years, information processing system devices employing electrophotography have remarkably been developed.

In particular, printers employing a digital recording method where information is converted to digital signals which are recorded using light, have remarkably been improved in print quality and reliability. This digital recording method is applied to not only printers but also commonly used copiers, and so-called digital copiers have been developed. Furthermore, various information processing functions are added to this digital copiers, and thus their demand is expected to be increased more and more in the future.

Photoconductors for responding to such a digital recording method have been required to have different characteristics from those required for a conventional analog recording method. For example, at present, a light source mainly used is a small, inexpensive, highly reliable laser diode (LD) or light emitting diode (LED). The wavelength region of light emitted from LD often used currently falls within the near-infrared light region, and the wavelength of light emitted from LED is longer than 650 nm. Therefore, in addition to the above requirements, electrophotographic photoconductors are required to have high sensitivity from the visible light region to the near-infrared light region.

In view of this, the following materials have been proposed as photoelectroconductive materials for used in digital recording: squarylium dyes (see Japanese Patent Application Laid-Open (JP-A) Nos. 49-105536 and 58-21416), triphenylamine trisazo pigments (see JP-A No. 61-151659) and phthalocyanine pigments (see JP-A Nos. 48-34189 and 57-148745). In particular, phthalocyanine pigments, which are tetraazaporphyrin derivatives, have a photoconductive wavelength region in a longer wavelength region and high photosensitivity. They can be varied in characteristics depending on the types of the central metal and the crystal form, and have actively been studied as a photoelectroconductive material for digital recording. Conventionally known phthalocyanine pigments exhibiting good sensitivity include ϵ-type copper phthalocyanine, X-type metal-free phthalocyanine, τ-type metal-free phthalocyanine, vanadyl phthalocyanine and titanyl phthalocyanine.

JP-A Nos. 64-17066, 03-128973 and 05-98182 have proposed high-sensitive titanyl phthalocyanine pigments. These titanyl phthalocyanine pigments have the maximum absorption of 700 nm to 860 nm as a spectral wavelength region, and show remarkably high sensitivity to light emitted from a laser diode. However, when the titanyl phthalocyanine pigments described in the above patent literatures are used in electrophotographic photoconductors, the electrophotographic photoconductors exhibit sufficient sensitivity but still pose many problems in practical use such as decrease in chargeability caused by repeated fatigue and large variation in sensitivity depending on the temperature and humidity (see Y. Fujimaki, Proc. IS & T's 7th International Congress on Advances in Non-Impact Printing Technologies, 1, 269 (1991)).

Japanese Patent (JP-B) No. 3123185 discloses a chlorogallium phthalocyanine pigment for a photoelectric conversion material. JP-B No. 3166293 discloses a V-type hydroxygallium phthalocyanine pigment for a photoelectric conversion material, which has strong diffraction peaks at Bragg angles (2θ±0.2°) of 7.5°, 9.9°, 12.5°, 16.3°, 18.6°, 25.1° and 28.3° in the X ray spectrum. These gallium phthalocyanine pigments also have practical sensitivity even in the near-infrared region. Although they are lower than the above-described titanyl phthalocyanine pigments in photosensitivity, the dependency of their photosensitivity on the humidity is lower than that of the titanyl phthalocyanine pigment (see K. Daimon, et al.: J. Imaging Sci. Technol., 40, 249 (1996)). However, these gallium phthalocyanine pigments also pose problems such as decrease in chargeability and increase in residual potential (decrease in sensitivity) caused by repeated fatigue.

JP-B Nos. 2637487 and 2637485 disclose porphyrazine pigments each having a heterocyclic ring such as pyridine or pyrazine. Japanese Patent Application Publication (JP-B) No. 03-27111, and JP-B Nos. 4293694 and 4419873 describe that mixtures of phthalocyanine and other porphyrazine pigments are useful for a photoelectroconductive material. However, electrophotographic photoconductors containing these mixtures do not satisfactorily satisfy the above requirements for electrophotographic photoconductors in terms of sensitivity in the visible light region and the near-infrared light region, decrease in chargeability and increase in residual potential caused by repeated fatigue, as well as large variation in sensitivity depending on the temperature and humidity.

SUMMARY OF THE INVENTION

The present invention aims to solve the above existing problems and achieve the following objects. Specifically, an object of the present invention is to provide: a mixture useful as an organic electrophotographic material used in an electrophotographic photoconductor excellent in sensitivity from the visible light region to the near-infrared region, charge stability to repeated fatigue, and stability to change in temperature and humidity; and a method for producing the mixture.

Another object of the present invention is to provide an electrophotographic photoconductor having high sensitivity in the visible light region and the near-infrared region and involving the following to a less extent: decrease in chargeability and increase in residual potential (decrease in sensitivity) caused by repeated fatigue, and change in them depending on the temperature and humidity.

The present inventors conducted extensive studies to solve the above-described problems and as a result have found a hydroxygallium porphyrazine derivative mixture containing a plurality of different hydroxygallium porphyrazine derivatives each represented by the following General Formula (A-2), and a new method for producing the same. The present invention has been accomplished on the basis of the finding.

General Formula (A-2)

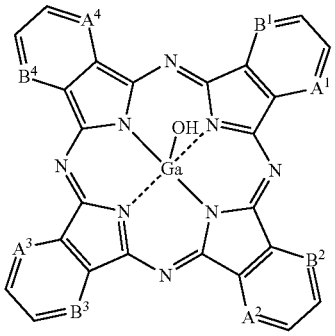

In General Formula (A-2), $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

The present invention is based on the above finding obtained by the present inventors. Specifically, the present invention provides a hydroxygallium porphyrazine derivative mixture including a plurality of different hydroxygallium porphyrazine derivatives each represented by the General Formula (A-2).

In addition, the present inventors conducted extensive studies to solve the above-described problems and as a result have found a hydroxygallium porphyrazine derivative mixture containing a plurality of different hydroxygallium porphyrazine derivatives each represented by the following General Formula (B-21), and a new method for producing the same. The present invention has been accomplished on the basis of the finding.

General Formula (B-21)

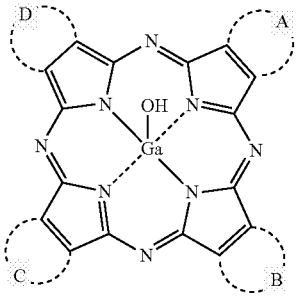

In General Formula (B-21), A, B, C and D each independently represent a group selected from the group consisting of an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group.

In addition, the present inventors conducted extensive studies to solve the above-described problems and as a result have found an electrophotographic photoconductor having a photoconductive layer containing a hydroxygallium porphyrazine derivative mixture containing a plurality of different hydroxygallium porphyrazine derivatives each represented by the General Formula (B-21). The present invention has been accomplished on the basis of the finding.

The present invention is based on the finding obtained by the present inventors. Specifically, the present invention provides an electrophotographic photoconductor including: an electrically conductive substrate; and a photoconductive layer laid on the electrically conductive substrate, wherein the photoconductive layer includes a hydroxygallium porphyrazine derivative mixture including a plurality of different hydroxygallium porphyrazine derivatives each represented by the above General Formula (B-21).

The present invention can provide: a mixture useful as an organic electrophotographic material used in an electrophotographic photoconductor excellent in sensitivity from the visible light region to the near-infrared region, charge stability to repeated fatigue, and stability to change in temperature and humidity; and a method for producing the mixture. These can solve the above existing problems.

The present invention can also provide an electrophotographic photoconductor having high sensitivity in the visible light region and the near-infrared region and involving the following to a less extent: decrease in chargeability and increase in residual potential (decrease in sensitivity) caused by repeated fatigue, and change in them depending on the temperature and humidity. This can solve the above existing problems.

Figure 1:
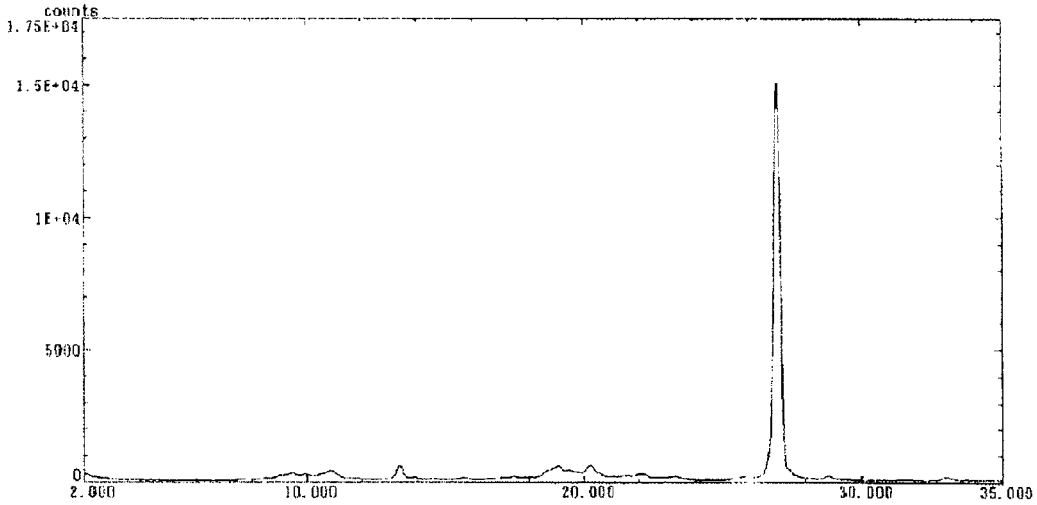
FIG. 1 is a powder X ray spectrum chart of a chlorogallium porphyrazine derivative mixture (mixture No. 1) synthesized in Production Example 1.

DETAILED DESCRIPTION OF THE INVENTION (Hydroxygallium Porphyrazine Derivative Mixture and Method for Producing the Mixture)

<Hydroxygallium Porphyrazine Derivative Mixture (A) and Method for Producing the Mixture>

A hydroxygallium porphyrazine derivative mixture of the present invention (hereinafter may be referred to as "hydroxygallium porphyrazine derivative mixture (A)") is a mixture containing a plurality of different hydroxygallium porphyrazine derivatives each represented by the following General Formula (A-2):

General Formula (A-2)

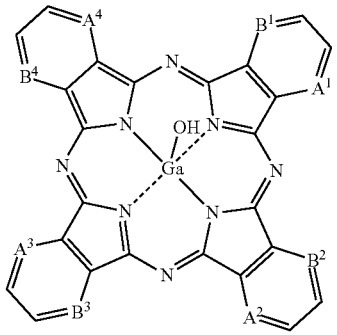

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

The hydroxygallium porphyrazine derivative mixture (A) preferably contains hydroxygallium phthalocyanine represented by General Formula (A-2) where $A^1$, $A^2$, $A^3$, $A^4$, $B^1$, $B^2$, $B^3$ and $B^4$ each are a carbon atom bonded to hydrogen;

and a plurality of different hydroxygallium porphyrazine derivatives each represented by General Formula (A-2) where at least one of $A^1$, $A^2$, $A^3$, $A^4$, $B^1$, $B^2$, $B^3$ and $B^4$ is a nitrogen atom.

The hydroxygallium porphyrazine derivative mixture (A) is obtained by, for example, treating with an acid a chlorogallium porphyrazine derivative mixture (hereinafter may be referred to as "chlorogallium porphyrazine derivative mixture (A)") containing: a plurality of different compounds each represented by the following General Formula (A-1), the chlorogallium porphyrazine derivative mixture being obtained by reacting together phthalonitrile, dicyanopyridine and gallium trichloride.

General Formula (A-1)

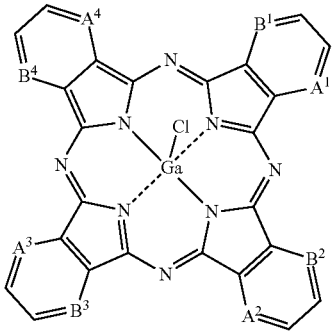

In General Formula (A-1), $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

Also, the hydroxygallium porphyrazine derivative mixture (A) is obtained by, for example, treating with an acid a chlorogallium porphyrazine derivative mixture containing: chlorogallium phthalocyanine represented by the above General Formula (A-1) where $A^1$, $A^2$, $A^3$, $A^4$, $B^1$, $B^2$, $B^3$ and $B^4$ each are a carbon atom bonded to hydrogen; and a plurality of different chlorogallium porphyrazine derivatives each represented by the above General Formula (A-1) where at least one of $A^1$, $A^2$, $A^3$, $A^4$, $B^1$, $B^2$, $B^3$ and $B^4$ is a nitrogen atom, the chlorogallium porphyrazine derivative mixture being obtained by reacting together phthalonitrile, dicyanopyridine and gallium trichloride.

The chlorogallium porphyrazine derivative mixture (A) can be obtained by, for example, allowing a mixture of phthalonitrile having the following Structural Formula (A-3) and dicyanopyridine having the following Structural Formula (A-4) to react together with gallium trichloride in the absence of a solvent or in the presence of α-chloronaphthalene, dichlorobenzene, trichlorobenzene, pentanol, octanol, benzyl alcohol, N,N-dimethylformamide, N-methylpyrrolidone, quinoline, benzene, toluene, xylene, mesitylene, nitrobenzene or dioxane. If necessary, this reaction may be performed in the presence of urea, formamide, acetamide, benzamide, 1,8-diazabicyclo[5,4,0]-7-undecene (DBU) or ammonia serving as a nitrogen source.

The reaction temperature of the above reaction is generally room temperature to 300° C., preferably 100° C. to 250° C.

Structural Formula (A-3)

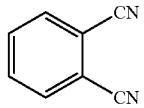

Structural Formula (A-4)

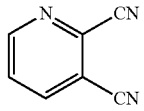

Here, the mixing ratio of phthalonitrile having Structural Formula (A-3) and dicyanopyridine having Structural Formula (A-4) (i.e., (A-3): (A-4), by mole) is generally 1:99999 to 99999:1, preferably 1:1 to 399:1. When the ratio of phthalonitrile having Structural Formula (A-3) is less than the above ratio, the obtained hydroxygallium porphyrazine derivative mixture (A) may decrease an electrophotographic photoconductor in electrophotographic characteristics such as chargeability and sensitivity. When the ratio of dicyanopyridine having Structural Formula (A-4) is less than the above ratio, the obtained electrophotographic photoconductor may be degraded in chargeability to a greater extent due to repeated use.

Subsequently, the chlorogallium porphyrazine derivative mixture (A) is subjected to a treatment with an acid; i.e., hydrolyzed with an acid, to thereby produce the hydroxygallium porphyrazine derivative mixture (A).

The above treatment with an acid refers to the following treatment. Specifically, the chlorogallium porphyrazine derivative mixture (A) is dissolved at 5° C. to room temperature in an acid such as sulfuric acid, chloric acid, phosphoric acid, methanesulfonic acid, trichloroacetic acid, or trifluoroacetic acid, then the resultant solution is added dropwise to ice, water, ice water or a mixture containing water and an organic solvent to precipitate crystals of the hydroxygallium porphyrazine derivative mixture (A), and the crystals of the hydroxygallium porphyrazine derivative mixture (A) are obtained using a means such as filtration. Among these acids, concentrated sulfuric acid is preferred since it dissolves the chlorogallium porphyrazine derivative mixture (A) to high extent, generates no smoke, and can easily be handled. The thus-precipitated hydroxygallium porphyrazine derivative mixture (A) is preferably washed using water or a mixture of an organic solvent and water, or optionally using an aqueous basic solution, to thereby remove or neutralize the acid, water-soluble organic solvent and impurities generated after hydrolysis.

The organic solvent to be mixed with water is not particularly limited and may be appropriately selected depending on the intended purpose. Examples of the organic solvent include lower alcohols such as methanol and ethanol; lower ketones such as acetone and methyl ethyl ketone; ethers such as diethyl ether, methyl cellosolve and dioxane; and water-soluble organic solvents such as dimethylformamide and dimethylsulfoxide.

Examples of the base used in the aqueous basic solution include alkali hydroxides such as sodium hydroxide and potassium hydroxide; alkali carbonates such as sodium carbonate and potassium carbonate; magnesium hydroxide, ammonia, and various quaternary ammonium hydroxides.

The amount of the base used is not particularly limited and may be appropriately selected depending on the intended purpose. It is property 0.5 mole equivalent to 1.5 mole equivalent, preferably 0.8 mole equivalent to 1.2 mole equivalent, with respect to the acid.

When the hydroxygallium porphyrazine derivative mixture (A) obtained through the above acid treatment is treated with a solvent, it can be transferred to a novel crystal which is further excellent in photosensitivity and durability.

In particular, the hydroxygallium porphyrazine derivative mixture (A) is a crystal having diffraction peaks at Bragg angles (2θ±0.2°) of 6.9°, 13.8°, 16.6° and 26.4° in an X ray diffraction spectrum using CuKα rays, since such a crystal has good characteristics and can easily be made to transfer to a novel crystal. The intensity of each diffraction peak is preferably higher.

In this specification, the method for measuring an X ray diffraction spectrum using CuKα rays is, for example, a method performed under the following conditions.

Measurement apparatus: X'Pert Pro (product of Philips)
X ray tube: Cu (wavelength: 1.54 angstroms (0.154 nm))
Voltage: 50 kV
Current: 30 mA
Scanning speed: 2 deg./min
Scanning range: 2 deg. to 35 deg. or 3 deg. to 35 deg.
Time constant: 2 sec The above treatment with a solvent refers to, for example, a suspension treatment of the hydroxygallium porphyrazine derivative mixture (A) in the solvent at room temperature or under heating. The solvent is not particularly limited and may be appropriately selected depending on the intended purpose. Examples thereof include benzene, toluene, dichlorobenzene, nitrobenzene, methanol, ethanol, benzyl alcohol, acetone, cyclohexanone, methyl ethyl ketone, n-butyl ether, ethylene glycol, tetrahydrofuran, N,N-dimethylformamide, N-methylpyrrolidone, quinoline, pyridine, dimethylsulfoxide and water. These may be used alone or in combination.

Such treatment with a solvent is performed by, for example, wet milling, dipping, and suspending/stirring. As to the conditions of this treatment, the amount of the solvent used is generally 1 part by mass to 200 parts by mass, preferably 10 parts by mass to 100 parts by mass, relative to 1 part by mass of the hydroxygallium porphyrazine derivative mixture (A); and the temperature for the treatment is 0° C. to 150° C., preferably room temperature to 100° C.

Also, the treatment with a solvent may be performed in a proper vessel while the mixture is being left or stirred.

In addition, a predetermined solvent may be used to wet mill the mixture using, for example, a ball mill, a mortar, a sand mill, a kneader or an attritor. Upon milling, there may be used inorganic compounds such as sodium chloride and sodium sulfate, or milling media such as glass beads, steel beads and alumina beads.

The above-described treatment with a solvent can form the hydroxygallium porphyrazine derivative mixture (A) into a preferred, novel crystal which is further stable and excellent in photosensitivity and durability.

Among others, the hydroxygallium porphyrazine derivative mixture (A) as a photoconductor for use in an electrophotographic photoconductor is preferably a crystal having diffraction peaks at Bragg angles (2θ±0.2°) of 7.4°, 16.2°, 25.2° and 28.3° in an X ray spectrum obtained by using CuKα rays (X ray spectrum obtained by using Cu-Kα characteristic X rays (λ=1.54 angstroms (0.154 nm)). The intensity of each diffraction peak is preferably higher.

The hydroxygallium porphyrazine derivative mixture (A) can suitably be used for an electrophotographic photoconductor.

Embodiments where the hydroxygallium porphyrazine derivative mixture (A) is applied to an electrophotographic photoconductor are, for example, the same embodiments as described below for hydroxygallium porphyrazine derivative mixture (B). Preferred embodiments where the hydroxygallium porphyrazine derivative mixture (A) is used are the same embodiments as described below for hydroxygallium porphyrazine derivative mixture (B).

The hydroxygallium porphyrazine derivative mixture (A) is useful for a photoconductor for an electrophotographic photoconductor, and also can be used as electronic devices in the electronics field treating, for example, solar cells and optical discs.

<Hydroxygallium Porphyrazine Derivative Mixture (B) and Method for Producing the Mixture>

A hydroxygallium porphyrazine derivative mixture of the present invention (hereinafter may be referred to as "hydroxygallium porphyrazine derivative mixture (B)") contains a plurality of different hydroxygallium porphyrazine derivatives each represented by the following General Formula (B-21):

General Formula (B-21)

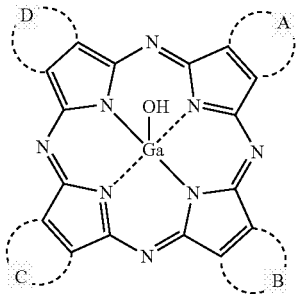

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group.

The hydroxygallium porphyrazine derivative mixture (B) preferably contains: a hydroxygallium phthalocyanine derivative represented by General Formula (B-21) where A, B, C and D each represent a benzo group which may have a substituent; and a plurality of different hydroxygallium porphyrazine derivatives each represented by General Formula (B-21) where at least one of A, B, C and D represents a pyrido group which may have a substituent.

The hydroxygallium porphyrazine derivative mixture (B) is obtained by, for example, treating with an acid a gallium porphyrazine derivative mixture (hereinafter may be referred to as "gallium porphyrazine derivative mixture (B)") containing a plurality of different gallium porphyrazine derivatives each represented by the following General Formula (B-20), the gallium porphyrazine derivative mixture being obtained by reacting together at least one selected from the group consisting of compounds represented by the following General Formulas (B-1) to (B-6) (benzene derivatives), at least one selected from the group consisting of compounds represented by the following General Formulas (B-7) to (B-18) (pyridine derivatives), and a gallium compound represented by the following General Formula (B-19).

The hydroxygallium porphyrazine derivative mixture (B) is obtained by, for example, treating with an acid a gallium porphyrazine derivative mixture containing: a gallium phthalocyanine derivative represented by the following General Formula (B-20) where A, B, C and D each represent a benzo group which may have a substituent; and a plurality of different gallium porphyrazine derivatives each represented by the following General Formula (B-20) where at least one of A, B, C and D represents a pyrido group which may have a substituent, the gallium porphyrazine derivative mixture being obtained by reacting together at least one selected from the group consisting of compounds represented by the following General Formulas (B-1) to (B-6) (benzene derivatives), at least one selected from the group consisting of compounds represented by the following General Formula (B-7) to (B-18) (pyridine derivatives), and a gallium compound represented by the following General Formula (B-19).

General Formula (B-20)

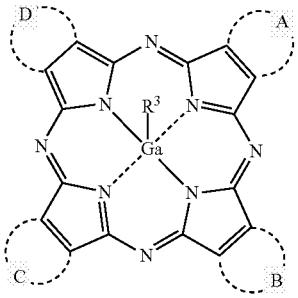

In General Formula (B-20), A, B, C and D each independently represent a group selected from the group consisting of an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group, and $R^3$ represents an halogen atom or an alkoxy group.

The gallium porphyrazine derivative mixture (B) is obtained by, for example, reacting together at least one selected from the group consisting of the compounds represented by the following General Formulas (B-1) to (B-6), at least one selected from the group consisting of the compounds represented by the following General Formulas (B-7) to (B-18), and the gallium compound represented by the following General Formula (B-19) in the absence of a solvent or in the presence of α-chloronaphthalene, dichlorobenzene, trichlorobenzene, pentanol, octanol, benzyl alcohol, N,N-dimethylformamide, N-methylpyrrolidone, quinoline, benzene, toluene, xylene, mesitylene, nitrobenzene or dioxane. If necessary, this reaction may be performed in the presence of urea, formamide, acetamide, benzamide, 1,8-diazabicyclo[5,4,0]-7-undecene (DBU) or ammonia serving as a nitrogen source. The reaction temperature of the above reaction is generally room temperature to 300° C., preferably 140° C. to 260° C.

General Formula (B-1)

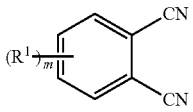

-continued

General Formula (B-2)

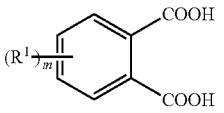

General Formula (B-3)

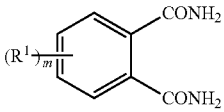

General Formula (B-4)

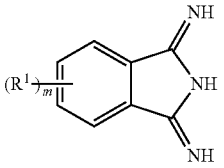

General Formula (B-5)

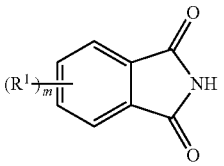

General Formula (B-6)

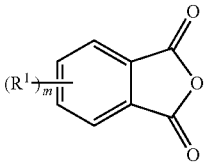

In each of the above General Formulas (B-1) to (B-6), $R^1$ represents a halogen atom, an alkyl group, a hydroxyl group or a benzo group, and m is an integer of 0 to 4, where when m is an integer of 2 or greater, R's may be identical or different.

General Formula (B-7)

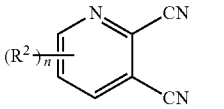

General Formula (B-8)

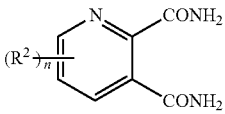

General Formula (B-9)

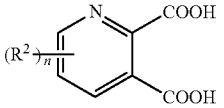

General Formula (B-10)

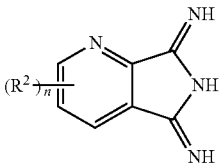

-continued

General Formula (B-11)

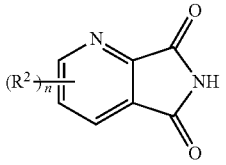

General Formula (B-12)

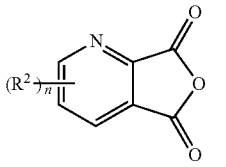

General Formula (B-13)

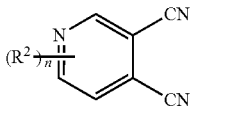

General Formula (B-14)

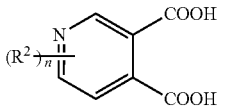

General Formula (B-15)

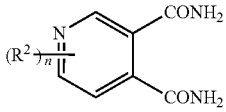

General Formula (B-16)

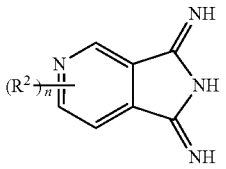

General Formula (B-17)

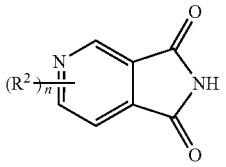

General Formula (B-18)

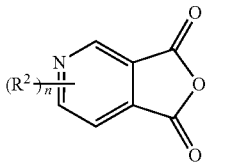

In each of the above General Formulas (B-7) to (B-18), $R^2$ represents a nitro group, a halogen atom, an alkyl group, an alkoxy group, a hydroxyl group or a benzo group, and n is an integer of 0 to 3, where when n is an integer of 2 or greater, $R^2$s may be identical or different.

$Ga(R^3)_3$ General Formula (B-19)

In General Formula (B-19), $R^3$ represents a halogen atom or an alkoxy group.

Here, examples of the halogen atom, alkyl group and alkoxy group represented by $R^1$ or $R^2$ in General Formulas (B-1) to (B-18) include the following atoms and groups.

Examples of the halogen atom include a fluorine atom, a chlorine atom, a bromine atom and an iodine atom.

Examples of the alkyl group include C1-C20 linear or branched alkyl groups such as methyl, ethyl, n-propyl, i-propyl, n-butyl, i-butyl, sec-butyl, tert-butyl, n-pentyl, i-pentyl, tert-pentyl, n-hexyl, n-octyl, i-octyl, dodecyl and acetyl; C5-C7 cycloalkyl groups such as cyclohexyl; and alkyl groups each having as a substituent a cycloalkyl group or an aromatic group such as a phenyl group (e.g., a hexahydrobenzyl group and a benzyl group).

Examples of the alkoxy group include C1-C20 linear or branched alkoxy groups such as methoxy, ethoxy, n-propoxy, i-propoxy, n-butoxy, i-butoxy, sec-butoxy, tert-butoxy, n-pentyloxy, i-pentyloxy, tert-pentyloxy, n-hexyloxy, n-octyloxy, i-octyloxy, dodecyloxy and cetyloxy; C5-C7 cycloalkyloxy groups such as cyclohexyloxy; and alkoxy groups each having as a substituent a cycloalkoxy group or an aromatic group such as a phenyl group (e.g., a hexahydrobenzyloxy group and a benzyloxy group).

Examples of the halogen atom and alkoxy group represented by $R^3$ include those which are similar to the above-listed halogen atoms and alkoxy groups.

Here, the mixing ratio of at least one selected from the group consisting of the compounds represented by General Formulas (B-1) to (B-6) (benzene derivatives) to at least one selected from the group consisting of the compounds represented by General Formulas (B-7) to (B-18) (pyridine derivatives) (i.e., (the benzene derivative:the pyridine derivative), by mole) is generally 1:99999 to 99999:1, preferably 1:1 to 399:1. When the ratio of the at least one selected from the group consisting of the compounds represented by General Formulas (B-1) to (B-6) is less than the above ratio, the obtained hydroxygallium porphyrazine derivative mixture (B) may decrease an electrophotographic photoconductor in electrophotographic characteristics such as chargeability and sensitivity. When the ratio of the at least one selected from the group consisting of the compounds represented by General Formulas (B-7) to (B-18) is less than the above ratio, the obtained electrophotographic photoconductor may be degraded in chargeability to a greater extent due to electrostatic or light degradation.

Subsequently, the chlorogallium porphyrazine derivative mixture (B) is subjected to a treatment with an acid; i.e., hydrolyzed with an acid, to thereby produce the hydroxygallium porphyrazine derivative mixture (B).

The above treatment with an acid refers to the following treatment. Specifically, the chlorogallium porphyrazine derivative mixture (B) is dissolved at −5° C. to room temperature in an acid such as sulfuric acid, chloric acid, phosphoric acid, methanesulfonic acid, trichloroacetic acid, or trifluoroacetic acid, then the resultant solution is added dropwise to ice, water, ice water or a mixture containing water and an organic solvent to precipitate crystals of the hydroxygallium porphyrazine derivative mixture (B), and the crystals of the hydroxygallium porphyrazine derivative mixture (B) are obtained using a means such as filtration. Among these acids, concentrated sulfuric acid is preferred since it dissolves the chlorogallium porphyrazine derivative mixture (B) to high extent, generates no smoke, and can easily be handled. The thus-precipitated hydroxygallium porphyrazine derivative mixture (B) is preferably washed using water or a mixture of an organic solvent and water, or optionally using an aqueous basic solution, to thereby remove or neutralize the acid, water-soluble organic solvent and impurities generated after hydrolysis.

The organic solvent to be mixed with water is not particularly limited and may be appropriately selected depending on the intended purpose. Examples of the organic solvent include lower alcohols such as methanol and ethanol; lower ketones such as acetone and methyl ethyl ketone; ethers such as diethyl ether, methyl cellosolve and dioxane; and water-soluble organic solvents such as dimethylformamide and dimethylsulfoxide.

Examples of the base used in the aqueous basic solution include alkali hydroxides such as sodium hydroxide and potassium hydroxide; alkali carbonates such as sodium carbonate and potassium carbonate; magnesium hydroxide, ammonia, and various quaternary ammonium hydroxides.

The amount of the base used is not particularly limited and may be appropriately selected depending on the intended purpose. It is property 0.5 mole equivalent to 1.5 mole equivalent, preferably 0.8 mole equivalent to 1.2 mole equivalent, with respect to the acid.

When the hydroxygallium porphyrazine derivative mixture (B) obtained through the above acid treatment is treated with a solvent, it can be transferred to a novel crystal which is further excellent in photosensitivity and durability.

The above treatment with a solvent refers to, for example, a suspension treatment of the hydroxygallium porphyrazine derivative mixture (B) in the solvent at room temperature or under heating. The solvent is not particularly limited and may be appropriately selected depending on the intended purpose. Examples thereof include benzene, toluene, dichlorobenzene, nitrobenzene, methanol, ethanol, benzyl alcohol, acetone, cyclohexanone, methyl ethyl ketone, n-butyl ether, ethylene glycol, tetrahydrofuran, N,N-dimethylformamide, N-methylpyrrolidone, quinoline, pyridine, dimethylsulfoxide and water. These may be used alone or in combination.

Such treatment with a solvent is performed by, for example, wet milling, dipping, and suspending/stirring. As to the conditions of this treatment, the amount of the solvent used is generally 1 part by mass to 200 parts by mass, preferably 10 parts by mass to 100 parts by mass, relative to 1 part by mass of the hydroxygallium porphyrazine derivative mixture (B); and the temperature for the treatment is 0° C. to 150° C., preferably room temperature to 100° C.

Also, the treatment with a solvent may be performed in a proper vessel while the mixture is being left or stirred.

In addition, a predetermined solvent may be used to wet mill the mixture using, for example, a ball mill, a mortar, a sand mill, a kneader or an attritor. Upon milling, there may be used inorganic compounds such as sodium chloride and sodium sulfate, or milling media such as glass beads, steel beads and alumina beads.

The above-described treatment with a solvent can form the hydroxygallium porphyrazine derivative mixture into a preferred, novel crystal which is further stable and excellent in photosensitivity and durability.

Among others, the hydroxygallium porphyrazine derivative mixture (B) as a photoconductor for use in an electrophotographic photoconductor is preferably a crystal having diffraction peaks at Bragg angles (2θ±0.2°) of 7.4°, 16.2°, 25.2° and 28.3° in an X ray spectrum obtained by using CuKα rays (X ray spectrum obtained by using Cu-Kα characteristic X rays (λ=1.54 angstroms (0.154 nm)). The intensity of each diffraction peak is preferably higher.

(Electrophotographic Photoconductor)

An electrophotographic photoconductor of the present invention includes: an electrically conductive substrate; and a photoconductive layer laid on the electrically conductive substrate, wherein the photoconductive layer contains at least the hydroxygallium porphyrazine derivative mixture (B); and, if necessary, further contains other ingredients.

Depending on the characteristics required for the electrophotographic photoconductor, even when two or more of the hydroxygallium porphyrazine derivative mixture (B) having different mixing ratios are mixed together or the hydroxygallium porphyrazine derivative mixture (B) is mixed with an azo pigment and/or a phthalocyanine pigment, the electrophotographic photoconductor of the present invention can be obtained. In other words, the photoconductive layer may further contain an azo pigment, and also may further contain a phthalocyanine pigment.

Examples of the azo pigment include azo pigments such as C.I. Pigment Blue 25 (Color Index (C.I.) 21180), C.I. Pigment Red 41 (C.I. 21200), C.I. Acid Red 52 (C.I. 45100), C.I. Basic Red 3 (C.I. 45210), azo pigments each having a carbazole skeleton (described in JP-A No. 53-95033), azo pigments each having a distyrylbenzene skeleton (described in JP-A No. 53-133445), azo pigments each having a triphenylamine skeleton (described in JP-A No. 53-132347), azo pigments each having a dibenzothiophene skeleton (described in JP-A No. 54-21728), azo pigments each having an oxadiazole skeleton (described in JP-A No. 54-12742), azo pigments each having a fluorenone skeleton (described in JP-A No. 54-22834), azo pigments each having a bisstilbene skeleton (described in JP-A No. 54-17733), azo pigments each having a distyryloxadiazole skeleton (described in JP-A No. 54-2129), azo pigments each having a distyrylcarbazole skeleton (described in JP-A No. 54-14967).

Examples of the phthalocyanine pigment include copper phthalocyanine, metal-free phthalocyanine, aluminum phthalocyanine, magnesium phthalocyanine, chlorogallium phthalocyanine, hydroxygallium phthalocyanine, vanadyl phthalocyanine, titanyl phthalocyanine, chloroindium phthalocyanine, hydroxylindium phthalocyanine, zinc phthalocyanine, iron phthalocyanine and cobalt phthalocyanine.

The hydroxygallium porphyrazine derivative mixture (B) can be used alone or in combination with the charge transport material to produce a single-layer or multi-layer (functionally separated) electrophotographic photoconductor.

In the case of the single-layer electrophotographic photoconductor, the photoconductive layer provided on the electrically conductive substrate is, for example, a layer where the hydroxygallium porphyrazine derivative mixture (B) is dispersed in a binding agent alone or in combination with the charge transport material. In the case of the functionally separated electrophotographic photoconductor, a charge generation layer made of the hydroxygallium porphyrazine derivative mixture (B) and a charge transport layer made of the charge transport material are formed on the electrically conductive substrate in this order. Notably, the charge transport layer and the charge generation layer may be formed on the electrically conductive substrate in this order.

In order to improve adhesion property and charge blocking property, an under layer may be provided between the photoconductive layer and the electrically conductive substrate. In addition, in order to improve abrasion resistance and mechanical durability, a protective layer may be formed on or above the photoconductive layer.

The photoconductive layer containing the hydroxygallium porphyrazine derivative mixture (B) can be formed as follows. Specifically, the hydroxygallium porphyrazine derivative mixture (B) is dissolved or dispersed in an appropriate solvent together with an optionally used binder resin, and the resultant mixture is coated and dried.

Examples of the method for dispersing the hydroxygallium porphyrazine derivative mixture (B) include a method using, for example, a ball mill, ultrasonic waves, or a homomixer. Examples of the coating method include a dipping coating method, a blade coating method, a spray coating method.

When the hydroxygallium porphyrazine derivative mixture (B) is dispersed to form the photoconductive layer, the average particle diameter of the hydroxygallium porphyrazine derivative mixture (B) is 2 μm or less, preferably 1 μm or less, in order to improve dispersibility of the hydroxygallium porphyrazine derivative mixture (B) in the photoconductive layer. However, when the particle diameter is too small, the hydroxygallium porphyrazine derivative mixture (B) tends to aggregate. As a result, the resultant layer is increased in resistance to have increased number of crystal defects, leading to a drop in sensitivity and durability to repeated use. Meanwhile, there is the lower limit of the particle diameter that can be achieved, and thus the lower limit of the average particle diameter is preferably 0.01 μm.

The solvent used for preparing the dispersion liquid or solution for forming the photoconductive layer is not particularly limited and may be appropriately selected depending on the intended purpose. Examples thereof include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate, butyl acetate and dioxane.

The binding agent used for forming the photoconductive layer is not particularly limited so long as it may be a conventionally-known, high insulating binding agent for an electrophotographic photoconductor. Examples of the binding agent include addition polymerization resins, polyaddition resins and condensation polymerization resins such as polyethylene, polyvinylbutyral, polyvinylformal, polystyrene resins, phenoxy resins, polypropylene, acrylic resins, methacylic resins, vinyl chloride resins, vinyl acetate resins, epoxy resins, polyurethane resins, phenol resins, polyester resins, alkyd resins, polycarbonate resins, polyamide resins, silicone resins, melamine resins, and copolymer resins containing two or more repeating units of the above-listed resins and including insulating resins such as vinyl chloride-vinyl acetate copolymers, styrene-acryl copolymers, vinyl chloride-vinyl acetate-maleic anhydride copolymers, and polymeric organic semiconductors such as poly-N-vinylcarbazole. These binding agents may be used alone or in combination.

When an electrophotographic photoconductor is produced from the above materials so as to have the above layer structure, the film thickness and the amount of each material have preferable ranges. In the case of the functionally separated electrophotographic photoconductor (electrically conductive substrate/charge generation layer/charge transport layer), the binding agent is optionally used in the charge generation layer. In this case, preferably, the amount of the hydroxygallium porphyrazine derivative mixture (B) relative to the binding agent is 20% by mass or more and the film thickness is 0.01 μm to 5 μm. In the charge transport layer, preferably, the amount of the charge transport material relative to the binding agent is 20% by mass to 200% by mass and the film thickness is 5 μm to 100 μm. In addition, when a polymeric charge transport material is used, the charge transport layer may be formed only of the polymeric charge transport material.

Furthermore, the charge generation layer preferably contains the charge transport material. Incorporating the charge transport material into the charge generation layer allows the resultant layer to have effects of suppressing residual potential and improving sensitivity. In this case, the charge transport material is preferably contained in an amount of 20% by mass to 200% by mass relative to the binding agent.

In the case of the single-layer electrophotographic photoconductor, preferably, the amount of the hydroxygallium porphyrazine derivative mixture (B) relative to the binding agent in the photoconductive layer is 5% by mass to 95% by mass and the film thickness is 10 μm to 100 μm. When the hydroxygallium porphyrazine derivative mixture (B) is used in combination with the charge transport material, the amount of the charge transport material relative to the binding agent is preferably 30% by mass to 200% by mass. Alternatively, the photoconductive layer may be formed of the polymeric charge transport material and the hydroxygallium porphyrazine derivative mixture (B). In this case, preferably, the amount of the hydroxygallium porphyrazine derivative mixture (B) relative to the polymeric charge transport material is 5% by mass to 95% by mass and the film thickness is 10 μm to 100 μm.

In order to improve chargeability, the photoconductive layer may additionally contain a phenol compound, a hydroquinone compound, a hindered phenol compound, a hindered amine compound, and/or a compound having in the molecule thereof both a hindered amine and a hindered phenol.

In the present invention, examples of the electrically conductive substrate include: metal plates, metal drums or metal foils of aluminum, nickel, copper, titanium, gold or stainless steel; plastic films on which aluminum, nickel, copper, titanium, gold, tin oxide or indium oxide is vapor deposited; and paper, plastic films or drums on which an electrically conductive material is coated.

In addition, an under layer may be provided on the electrically conductive substrate as required. The under layer is generally made of a resin as a major component. However, it is desirable that the resin has high resistance to commonly-used organic solvents, considering that a photoconductive layer-coating liquid containing such a solvent is coated on the resin. Examples of the resin include: water-soluble resins such as polyvinyl alcohol, casein and sodium polyacrylate; alcohol-soluble resins such as copolymerized nylon and methoxymethylated nylon; and curable resins which will form a three-dimensional network structure, such as polyurethane, melamine resins, phenol resins, alkyd-melamine resins and epoxy resins.

Fine pigment particles of metal oxides exemplified by titanium oxide, silica, alumina, zirconium oxide, tin oxide and indium oxide may be added to the under layer in order to prevent moire and lower residual potential. The under layer can be formed by using a proper solvent and coating method similar to those used for forming the photoconductive layer. Furthermore, a silane coupling agent, a titanium coupling agent, a chromium coupling agent may be used in the under layer. Besides, there can also be used under layers where $Al_2O_3$ is provided by anodic oxidation; under layers where organic materials such as polyparaxylylene (parylene) or inorganic materials such as $SiO_2$, $SnO_2$, $TiO_2$, ITO and $CeO_2$ are provided with vacuum thin film deposition method; and other known layers. The thickness of the under layer is preferably 0.01 μm to 5 μm.

The material of the protective layer is not particularly limited and may be appropriately selected depending on the intended purpose. Examples thereof include ABS resins, ACS resins, copolymers of olefin-vinyl monomer, chlorinated polyether, aryl resins, phenol resins, polyacetal, polyamide, polyamideimide, polyacrylate, polyallylsulfon, polybutylene, polybutylene terephthalate, polycarbonate, polyethersulfone, polyethylene, polyethylene terephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, fluororesins (e.g., polytetrafluoroethylene) and silicone resins.

In order for the protective layer to be improved in abrasion resistance and releasing property from toner particles and contaminants, inorganic particles such as titanium oxide, tin oxide, potassium titanate, alumina and silica; fine particles of fluororesins such as polytetrafluoroethylene; and/or fine silicon particles may be added to the protective layer.

The method for forming the protective layer is not particularly limited and may be appropriately selected depending on the intended purpose. Examples thereof include conventional methods such as a dip coating method, a spray coating method, a bead coating method, a nozzle coating method, a spinner coating method, and a ring coating method. Among them, a spray coating method is preferred from the viewpoint of achieving uniform coating. The thickness of the protective layer is properly about 0.1 μm to about 10 μm. Besides the above-listed materials, known materials such as A-C and A-SiC formed with vacuum thin film formation method can also be used for the protective layer.

Examples of the charge transport material include hole transport materials, electron transport materials and charge transport polymers.

Examples the hole transport material include poly-N-carbazole and derivatives thereof, poly-γ-carbazolyl ethylglutamate and derivatives thereof, pyrene-formaldehyde condensates and derivatives thereof, polyvinyl pyrene, polyvinyl phenanthrene, oxazole derivatives, imidazole derivatives, triphenylamine derivatives, and compounds represented by the following General Formulas (11) to (34).

General Formula (11)

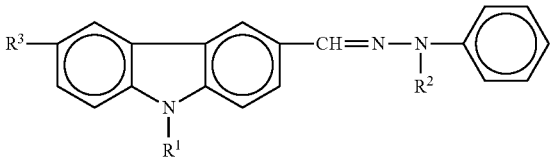

In General Formula (11), $R^1$ represents a methyl group, ethyl group, 2-hydroxyethyl group or 2-chloroethyl group; $R^2$ represents a methyl group, ethyl group, benzyl group or phenyl group; and $R^3$ represents a hydrogen atom, chlorine atom, bromine atom, alkyl group having 1 to 4 carbon atoms, alkoxy group having 1 to 4 carbon atoms, dialkylamino group or nitro group.

Examples of the compounds represented by General Formula (11) include 9-ethylcarbazole-3-carbaldehyde-1-methyl-1-phenylhydrazone, 9-ethylcarbazole-3-carbaldehyde-1-benzyl-1-phenylhydrazone, and 9-ethylcarbazole-3-carbaldehyde-1,1-diphenylhydrazone.

General Formula (12)

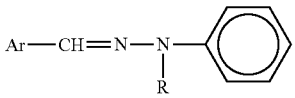

In General Formula (12), Ar represents a naphthalene ring, anthracene ring, pyrene ring, substituted naphthalene ring, substituted anthracene ring, substituted pyrene ring, pyridine ring, furan ring or thiophene ring; and R represents an alkyl group, phenyl group, or benzyl group.

Examples of the compounds represented by General Formula (12) include 4-diethylaminostyryl-β-carbaldehyde-1-methyl-1-phenylhydrazone and 4-methoxynaphthalene-1-carbaldehyde-1-benzyl-1-phenylhydrazone.

General Formula (13)

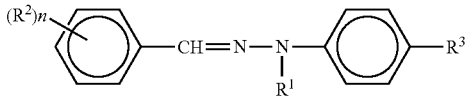

In General Formula (13), $R^1$ represents an alkyl group, benzyl group, phenyl group or naphthyl group; $R^2$ represents a hydrogen atom, alkyl group having 1 to 3 carbon atoms, alkoxy group having 1 to 3 carbon atoms, dialkylamino group, diaralkylamino group or diarylamino group; n is an integer of 1 to 4; when n is two or more, $R^2$s may be identical or different; and $R^3$ represents a hydrogen atom or methoxy group.

Examples of the compounds represented by General Formula (13) include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

General Formula (14)

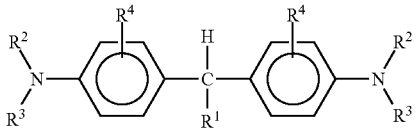

In General Formula (14), $R^1$ represents an alkyl group having 1 to 11 carbon atoms, a substituted or unsubstituted phenyl group, or a substituted or unsubstituted heterocyclic group; $R^2$ and $R^3$, which may be identical or different, each represent a hydrogen atom, an alkyl group having 1 to 4 carbon atoms, a hydroxyalkyl group, a chloroalkyl group, or substituted or unsubstituted aralkyl group; $R^2$ and $R^3$ may be linked to form a heterocyclic ring including a nitrogen atom; and $R^4$s, which may be identical or different, each represent a hydrogen atom, an alkyl group having 1 to 4 carbon atoms, an alkoxy group or a halogen atom.

Examples of the compounds represented by General Formula (14) include 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)-triphenylmethane.

General Formula (15)

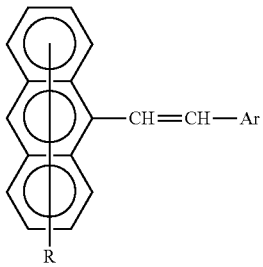

In General Formula (15), R represents a hydrogen atom or halogen atom; Ar represents a substituted or unsubstituted phenyl group, a substituted or unsubstituted naphthyl group, a substituted or unsubstituted anthryl group, or a substituted or unsubstituted carbazolyl group.

Examples of the compounds represented by General Formula (15) include 9-(4-diethylaminostyryl)anthracene and 9-bromo-10-(4-diethylaminostyryl)anthracene.

General Formula (16)

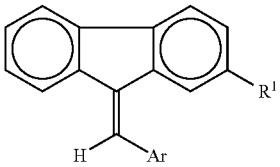

In General Formula (16), $R^1$ represents a hydrogen atom, halogen atom, cyano group, alkoxy group having 1 to 4 carbon atoms or alkyl group having 1 to 4 carbon atoms; and Ar represents a group represented by the following General Formula (17) or (18).

General Formula (17)

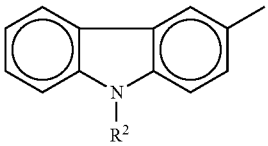

General Formula (18)

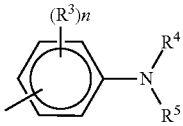

In General Formula (17), $R^2$ represents an alkyl group having 1 to 4 carbon atoms.

In General Formula (18), $R^3$ represents a hydrogen atom, halogen atom, alkyl group having 1 to 4 carbon atoms, alkoxy group having 1 to 4 carbon atoms or dialkylamino group; n is 1 or 2; when n is 2, $R^3$s may be identical or different; $R^4$ or $R^5$ represents a hydrogen atom, a substituted or unsubstituted alkyl group having 1 to 4 carbon atoms, or a substituted or unsubstituted benzyl group.

Examples of the compounds represented by General Formula (16) include 9-(4-dimethylaminobenzylidene)fluorene and 3-(9-fluorenylidene)-9-ethylcarbazole.

General Formula (19)

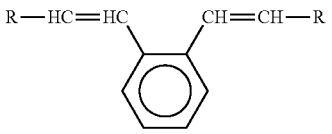

In General Formula (19), R represents a carbazolyl group, pyridyl group, thienyl group, indolyl group, furyl group, substituted or unsubstituted phenyl group, substituted or unsubstituted styryl group, substituted or unsubstituted naphthyl group, or substituted or unsubstituted anthryl group, wherein each substituted group has a substituent selected from the group consisting of a dialkylamino group, alkyl group, alkoxy group, carboxy group, esterified carboxy group, halogen atom, cyano group, aralkylamino group, N-alkyl-N-aralkylamino group, amino group, nitro group and acethylamino group.

Examples of the compounds represented by General Formula (19) include 1,2-bis(4-diethylaminostyryl)benzene and 1,2-bis(2,4-dimethoxystyryl)benzene.

General Formula (20)

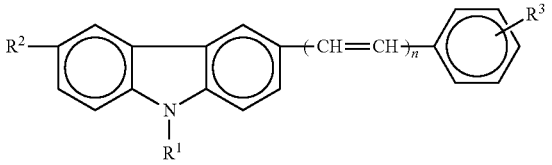

In General Formula (20), $R^1$ represents a lower alkyl group, substituted or unsubstituted phenyl group, or substituted or unsubstituted benzyl group; $R^2$ and $R^3$ each represent a hydrogen atom, lower alkyl group, lower alkoxy group, halogen atom, nitro group, amino group, or amino group having as a substituent a lower alkyl group or a benzyl group; and n is an integer of 1 or 2.

Examples of the compounds represented by General Formula (20) include 3-styryl-9-ethylcarbazole and 3-(4-methoxystyryl)-9-ethylcarbazole.

General Formula (21)

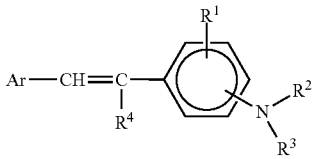

In General Formula (21), $R^1$ represents a hydrogen atom, alkyl group, alkoxy group or halogen atom; $R^2$ and $R^3$ each represent a substituted or unsubstituted aryl group; $R^4$ represents a hydrogen atom, lower alkyl group or substituted or unsubstituted phenyl group; and Ar represents a substituted or unsubstituted phenyl group, or substituted or unsubstituted naphthyl group.

Examples of the compounds represented by General Formula (21) include 4-diphenylaminostilbene, 4-dibenzylaminostilbene, 4-ditolylaminostilbene, 1-(4-diphenylaminostyryl)naphthalene and 1-(4-diphenylaminostyryl) naphthalene.

General Formula (22)

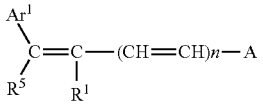

In General Formula (22), n is an integer of 0 or 1; $R^1$ represents a hydrogen atom, alkyl group or substituted or unsubstituted phenyl group; $Ar^1$ represents a substituted or unsubstituted aryl group; $R^5$ represents a substituted or unsubstituted alkyl group or a substituted or unsubstituted aryl group; A represents a 9-anthryl group, a substituted or unsubstituted carbazolyl group, or a group represented by the following General Formula (23) or (24); and when n is 0, A and $R^1$ may be linked to form a ring.

General Formula (23)

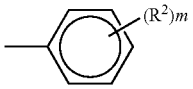

General Formula (24)

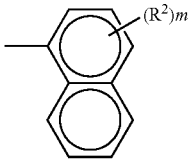

In General Formulas (23) and (24), $R^2$ represents a hydrogen atom, an alkyl group, an alkoxy group, a halogen atom, or a group represented by the following General Formula (25); m is an integer; and when m is two or more, $R^2$s may be identical or different.

General Formula (25)

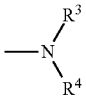

In General Formula (25), $R^3$ and $R^4$, which may be identical or different, each represent a substituted or unsubstituted aryl group; and $R^3$ and $R^4$ may be linked to form a ring.

Examples of the compounds represented by General Formula (22) include 4'-diphenylamino-α-phenylstilbene and 4'-bis(4-methylphenyl)amino-α-phenylstilbene.

General Formula (26)

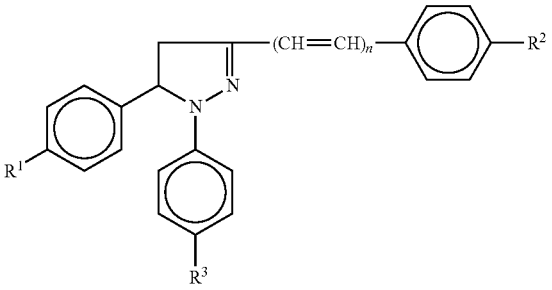

In General Formula (26), $R^1$, $R^2$ and $R^3$ each represent a hydrogen atom, lower alkyl group, lower alkoxy group, halogen atom or dialkylamino group; and n is 0 or 1.

Examples of the compounds represented by General Formula (26) include 1-phenyl-3-(4-diethylaminostyryl)-5-(4-diethylaminophenyl)pyrazoline.

General Formula (27)

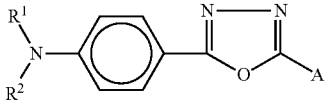

In General Formula (27), $R^1$ and $R^2$ each represent a substituted or unsubstituted alkyl group or a substituted or unsubstituted aryl group; A represents a substituted amino group, a substituted or unsubstituted aryl group, or an allyl group.

Examples of the compounds represented by General Formula (27) include 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

General Formula (28)

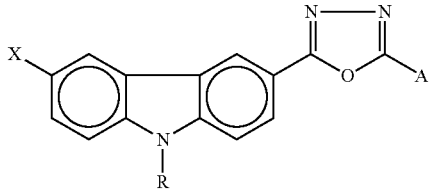

In General Formula (28), X represents a hydrogen atom, lower alkyl group or halogen atom; R represents a substituted or unsubstituted alkyl group or a substituted or unsubstituted aryl group; and A represents a substituted amino group or a substituted or non-substituted aryl group.

Examples of the compounds represented by General Formula (28) include 2-N,N-diphenylamino-5-(N-ethylcarbazol-3-yl)-1,3,4-oxadiazole and 2-(4-diethylaminophenyl)-5-(N-ethylcarbazol-3-yl)-1,3,4-oxadiazole.

General Formula (29)

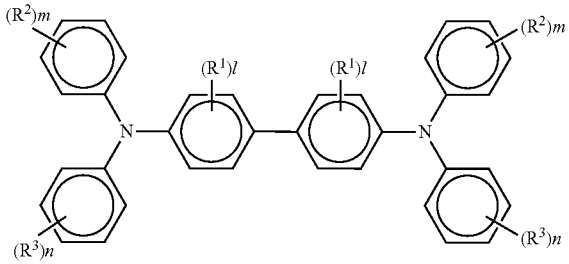

In General Formula (29), $R^1$ represents a lower alkyl group, lower alkoxy group or halogen atom; $R^2$ and $R^3$, which may be identical or different, each represent a hydrogen atom, lower alkyl group, lower alkoxy group or halogen atom; and l, m or n is an integer of 0 to 4.

Examples of the benzidine compounds represented by General Formula (29) include N,N'-diphenyl-N,N'-bis(3-methylphenyl) [1,1'-biphenyl]-4,4'-diamine and 3,3'-dimethyl-N,N,N',N'-tetrakis(4-methylphenyl)-[1,1'-biphenyl]-4,4'-diamine.

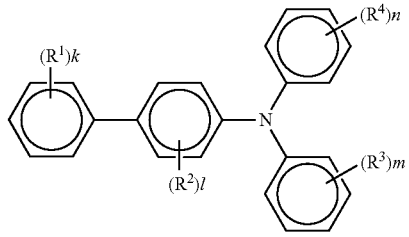

In General Formula (30), $R^1$, $R^3$ and $R^4$ each represent a hydrogen atom, amino group, alkoxy group, thioalkoxy group, aryloxy group, methylenedioxy group, substituted or unsubstituted alkyl group, halogen atom, or substituted or unsubstituted aryl group; $R^2$ represents a hydrogen atom, alkoxy group, substituted or unsubstituted alkyl group, or halogen atom; k, l, m or n is an integer of 1, 2, 3 or 4; and when k, l, m or n is an integer of 2, 3 or 4, $R^1$s, $R^2$s, $R^3$s or $R^4$s may be identical or different; with compounds where all of $R^1$, $R^2$, $R^3$ and $R^4$ are hydrogen atoms being excluded.

Examples of the biphenylylamine compounds represented by general formula (30) include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

General Formula (31)

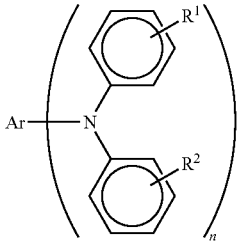

In General Formula (31), Ar represents a condensed polycyclic hydrocarbon group which may have a substituent and which has carbon atoms equal to or less than 18; $R^1$ and $R^2$, which may be identical or different, each represent a hydrogen atom, halogen atom, substituted or unsubstituted alkyl group, alkoxy group, or substituted or unsubstituted phenyl group; and n is an integer of 1 or 2.

Examples of the triarylamine compounds represented by General Formula (31) include N,N-diphenyl-pyrene-1-amine, N,N-di-p-tolyl-pyrene-1-amine, N,N-di-p-tolyl-1-naphthylamine, N,N-di(p-tolyl)-1-phenanthrylamine, 9,9-dimethyl-2-(di-p-tolylamino)fluorene, N,N,N',N'-tetrakis(4-methylphenyl)-phenanthrene-9,10-diamine and N,N,N',N'-tetrakis(3-methylphenyl)-m-phenylenediamine.

A-CH═CH—Ar—CH═CH-A General Formula (32)

In General Formula (32), Ar represents a substituted or unsubstituted aromatic hydrocarbon group; and A represents a group represented by the following General Formula (33).

General Formula (33)

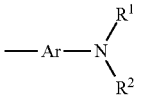

In General Formula (33), Ar represents a substituted or unsubstituted aromatic hydrocarbon group; $R^1$ and $R^2$ each represent a substituted or unsubstituted alkyl group or a substituted or unsubstituted aryl group.

Examples of the diolefin aromatic compounds represented by General Formula (32) include 1,4-bis(4-diphenylaminostyryl)benzene and 1,4-bis[4-di(p-tolyl)aminostyryl]benzene.

General Formula (34)

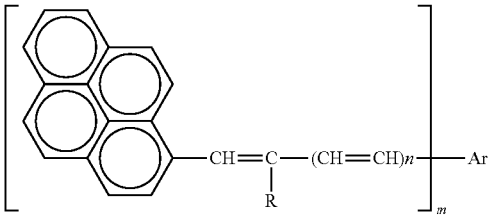

In General Formula (34), Ar represents a substituted or unsubstituted aromatic hydrocarbon group; R represents a hydrogen atom, a substituted or unsubstituted alkyl group, or a substituted or unsubstituted aryl group; n is 0 or 1; m is 1 or 2; and when n is 0 and m is 1, Ar and R may be linked to form a ring.

Examples of the styrylpyrene compounds represented by General Formula (34) include 1-(4-diphenylaminostyryl) pyrene and 1-(N,N-di-p-tolyl-4-aminostyryl)pyrene.

Examples of the electron transport material include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno-4H-indeno[1,2-b]thiophen-4-one, and 1,3,7-trinitrodibenzothiophene-5,5-dioxide. Preferred are electron transport materials represented by the following General Formula (35), (36), (37) or (38).

General Formula (35)

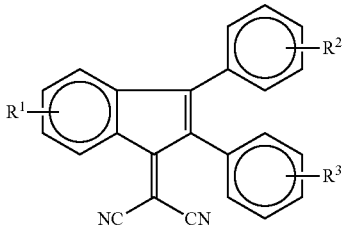

In General Formula (35), $R^1$, $R^2$ and $R^3$, which may be identical or different, each represent a hydrogen atom, halogen atom, substituted or unsubstituted alkyl group, alkoxy group, or substituted or unsubstituted phenyl group.

General Formula (36)

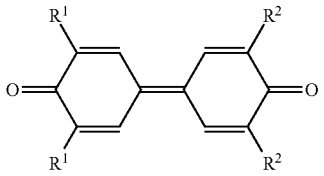

In General Formula (36), $R^1$ and $R^2$, which may be identical or different, each represent a hydrogen atom, substituted or unsubstituted alkyl group, substituted or unsubstituted phenyl group.

General Formula (37)

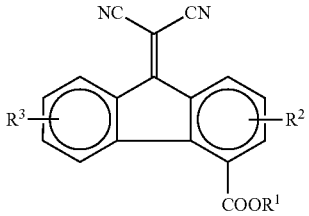

In General Formula (37), $R^1$, $R^2$ and $R^3$, which may be identical or different, each represent a hydrogen atom, halogen atom, substituted or unsubstituted alkyl group, alkoxy group, or substituted or unsubstituted phenyl group.

General Formula (38)

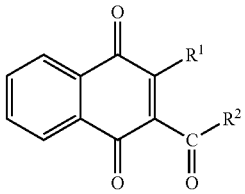

In General Formula (38), $R^1$ represents an alkyl group which may have a substituent or an aryl group which may have a substituent; and $R^2$ represents an alkyl group which may have a substituent, an aryl group which may have a substituent, or a group represented by the following General Formula (39) or (40).

General Formula (39)

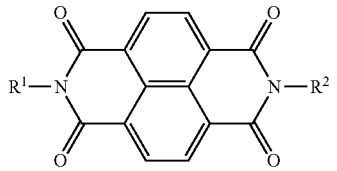

General Formula (40)

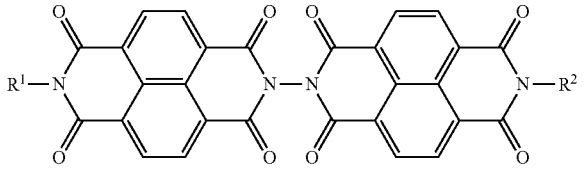

In General Formulas (39) and (40), $R^1$ and $R^2$, which may be identical or different, each represent a hydrogen atom, a substituted or unsubstituted alkyl group or a substituted or unsubstituted aromatic hydrocarbon group.

The charge transport polymer may be known polymers. Among them, polycarbonate having a triarylamine structure in its main and/or side chain(s) is preferred, with the charge transport polymers represented by the following General Formulas (I) to (XIII) being more preferred.

General Formula (I)

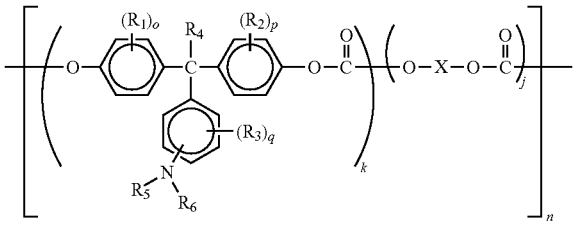

In General Formula (I), $R^1$, $R^2$ and $R^3$ each represent a substituted or unsubstituted alkyl group or a halogen atom; $R^4$ represents a hydrogen atom or a substituted or unsubstituted alkyl group; $R^5$ and $R^6$ each represent a substituted or unsubstituted aryl group; o, p or q is an integer of 0 to 4; k and j satisfy the following relationships: $0.1 \leq k \leq 1$ and $0 \leq j \leq 0.9$, respectively; n is the number of repeating units and is an integer of 5 to 5,000; and X represents a divalent aliphatic group, a divalent alicyclic group, or a divalent group represented by the following General Formula (II).

General Formula (II)

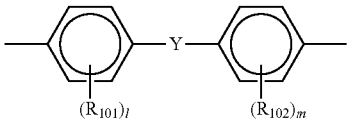

In General Formula (II), $R_{101}$ and $R_{102}$ each represent a substituted or unsubstituted alkyl group, aryl group or halogen atom; 1 or m is an integer of 0 to 4; Y represents a single bond, a linear, branched or cyclic alkylene group having 1 to 12 carbon atoms, —O—, —S—, —SO—, —$SO_2$—, —CO—, —CO—O—Z—O—CO— (wherein Z represents a divalent aliphatic group), or a group represented by the following General Formula (III).

General Formula (III)

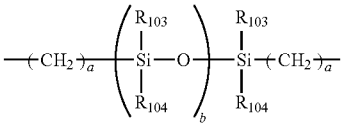

In General Formula (III), a is an integer of 1 to 20; b is an integer of 1 to 2,000; $R_{103}$ and $R_{104}$ each represent a substituted or unsubstituted alkyl group or aryl group; and $R_{101}$, $R_{102}$, $R_{103}$ and $R_{104}$ may be identical or different.

General Formula (IV)

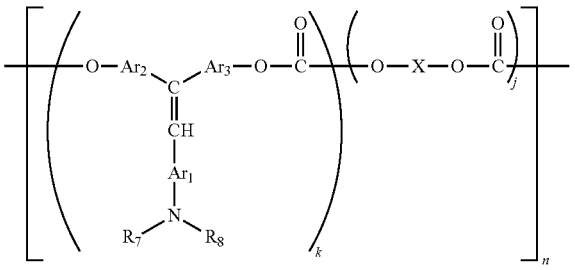

In General Formula (IV), $R_7$ and $R_8$ each represent a substituted or unsubstituted aryl group; $Ar_1$, $Ar_2$ and $Ar_3$ represent the same arylene group or different arylene groups; and X, k, j and n have the same meanings as described in the above General Formula (I).

General Formula (V)

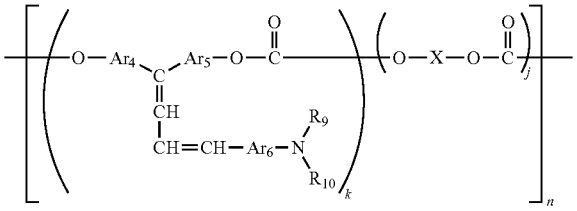

In General Formula (V), $R_9$ and $R_{10}$ each represent a substituted or unsubstituted aryl group; $Ar_4$, $Ar_5$ and $Ar_6$ represent the same arylene group or different arylene groups; and X, k, j and n have the same meanings as described in the above General Formula (I).

General Formula (VI)

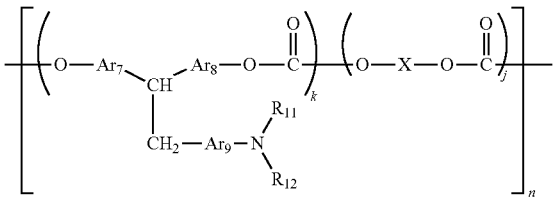

In General Formula (VI), $R_{11}$ and $R_{12}$ each represent a substituted or unsubstituted aryl group; $Ar_7$, $Ar_8$ and $Ar_9$ represent the same arylene group or different arylene groups; and X, k, j and n have the same meanings as described in the above General Formula (I).

General Formula (VII)

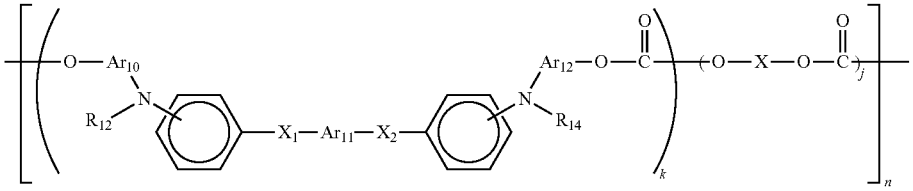

In General Formula (VII), $R_{13}$ and $R_{14}$ each represent a substituted or unsubstituted aryl group; $Ar_{10}$, $Ar_{11}$ and $Ar_{12}$ represent the same arylene group or different arylene groups; $X_1$ and $X_2$ each represent a substituted or unsubstituted ethylene group, or a substituted or unsubstituted vinylene group; and X, k, j and n have the same meanings as described in the above General Formula (I).

General Formula (VIII)

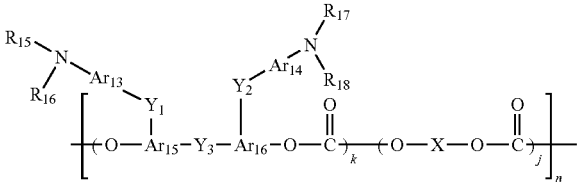

In General Formula (VIII), $R_{15}$, $R_{16}$, $R_{17}$ and $R_{18}$ each represent a substituted or unsubstituted aryl group; $Ar_{13}$, $Ar_{14}$, $Ar_{15}$ and $Ar_{16}$ represent the same arylene group or different arylene groups; $Y_1$, $Y_2$ and $Y_3$, which may be identical or different, each represent a single bond, substituted or unsubstituted alkylene group, substituted or unsubstituted cycloalkylene group, substituted or unsubstituted alkylene ether group, oxygen atom, sulfur atom or vinylene group; and X, k, j and n have the same meanings as described in the above General Formula (I).

General Formula (IX)

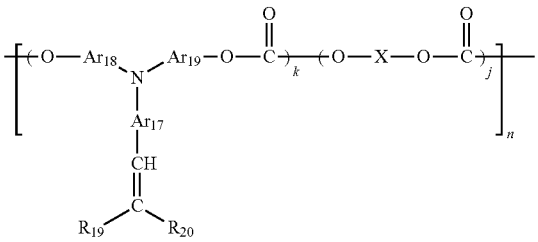

In General Formula (IX), $R_{19}$ and $R_{20}$ each represent a hydrogen atom, a substituted or non-substituted aryl group; $R_{19}$ and $R_{20}$ may be linked to form a ring; $Ar_{17}$, $Ar_{18}$ and $Ar_{19}$ represent the same arylene group or different arylene groups; and X, k, j and n have the same meanings as described in the above General Formula (I).

General Formula (X)

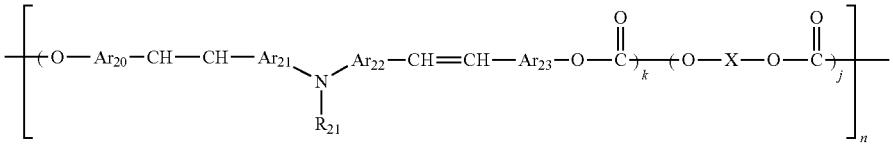

In General Formula (X), $R_{21}$ represents a substituted or unsubstituted aryl group; $Ar_{20}$, $Ar_{21}$, $Ar_{22}$ and $Ar_{23}$ represent the same arylene group or different arylene groups; and X, k, j and n have the same meanings as described in the above General Formula (I).

General Formula (XI)

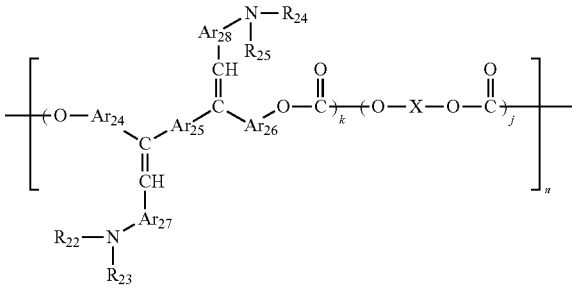

In General Formula (XI), $R_{22}$, $R_{23}$, $R_{24}$ and $R_{25}$ each represent a substituted or unsubstituted aryl group; $Ar_{24}$, $Ar_{25}$, $Ar_{26}$, $Ar_{27}$ and $Ar_{28}$ represent the same arylene group or different arylene groups; and X, k, j and n have the same meanings as described in the above General Formula (I).

General Formula (XII)

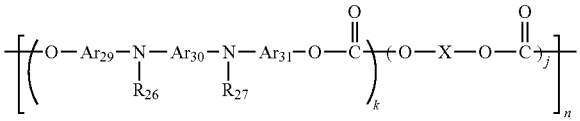

In General Formula (XII), $R_{26}$ and $R_{27}$ each represent a substituted or unsubstituted aryl group; $Ar_{29}$, $Ar_{30}$ and $Ar_{31}$ represent the same arylene group or different arylene groups; and X, k, j and n have the same meanings as described in the above General Formula (I).

General Formula (XIII)

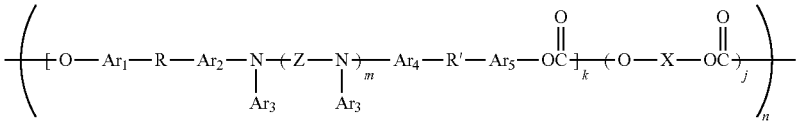

In General Formula (XIII), $Ar_1$, $Ar_2$, $Ar_3$, $Ar_4$ and $Ar_5$ each represent a substituted or unsubstituted aromatic ring group; Z represents an aromatic ring group or —$Ar_6$-Za-$Ar_6$—, wherein $Ar_6$ represents a substituted or unsubstituted aromatic ring group; Za represents O, S or an alkylene group; R and R' each represent a linear or branched alkylene group; m is 0 or 1; and k, j, n and X have the same meanings as described in the above General Formula (I).

The above charge transport materials may be used alone or in combination.

The hydroxygallium porphyrazine derivative mixture (B) is useful for a photoconductor for an electrophotographic photoconductor, and also can be used as electronic devices in the electronics field treating, for example, solar cells and optical discs.

(Electrophotographic Method, Electrophotographic Apparatus, and Process Cartridge for Electrophotographic Apparatus)

An electrophotographic method of the present invention repeatedly performs a series of a charging step, imagewise exposing step, a developing step and a transfer step on an electrophotographic photoconductor.

An electrophotographic apparatus of the present invention includes: a charging unit; an imagewise exposing unit, a developing unit, a transfer unit and an electrophotographic photoconductor; and, if necessary, further includes other units.

The electrophotographic method of the present invention can suitably be performed by the electrophotographic apparatus of the present invention. The charging step can be performed by the charging unit. The imagewise exposing step can be performed by the imagewise exposing unit. The developing step can be performed by the developing unit. The transfer step can be performed by the transfer unit.

A process cartridge for electrophotographic apparatus of the present invention is a process cartridge containing at least an electrophotographic photoconductor and used in an electrophotographic apparatus.

The above electrophotographic photoconductor is the electrophotographic photoconductor of the present invention.

The above electrophotographic method is preferably a digital electrophotographic method where a LD or LED is used in the imagewise exposing step to form a latent electrostatic image on the electrophotographic photoconductor.

The above electrophotographic apparatus is preferably a digital electrophotographic apparatus where a LD or LED is used in the imagewise exposing unit to form a latent electrostatic image on the electrophotographic photoconductor.

Next, the electrophotographic method, the electrophotographic apparatus, and the process cartridge for electrophotographic apparatus of the present invention will be described in detail with reference to drawings.

Figure 37:
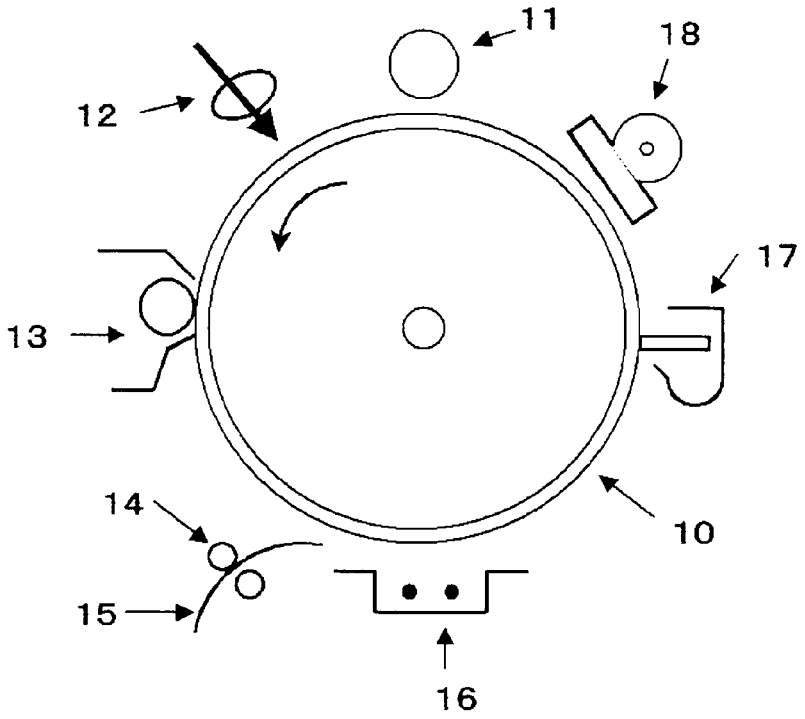
FIG. 37 is a schematic view for explaining one exemplary electrophotographic process or electrophotographic apparatus of the present invention.

FIG. 37 is a schematic view for explaining one example of the electrophotographic process or the electrophotographic apparatus of the present invention, and the following embodiment is also within the scope of the present invention.

The electrophotographic photoconductor (10) is rotated in the direction shown by the arrow in FIG. 37, and around the electrophotographic photoconductor (10), a charging member (11) serving as a charging unit, an imagewise exposing member (12) serving as an imagewise exposing unit, a developing member (13) serving as a developing unit, a transferring member (16) serving as a transferring unit, a cleaning member (17) serving as a cleaning unit, a diselectrification member (18) serving as a diselectrification unit are provided. There are cases where the cleaning member (17) and/or the diselectrification member (18) are omitted from the electrophotographic apparatus.

Basic operation of the electrophotographic apparatus illustrated in FIG. 37 is as follows. The surface of the electrophotographic photoconductor (10) is uniformly charged by means of the charging member (11), followed by imagewise writing corresponding to input signals by means of the imagewise exposing member (12) to thereby form an electrostatic latent image. Then, the formed electrostatic latent image is developed by means of the developing member (13) to thereby form a toner image on the surface of the electrophotographic photoconductor. The formed toner image is then transferred to a transferring paper (15), which has been sent to the transferring section by conveyance rollers (14), by means of the transferring member. This toner image is fixed on the transferring paper (15) by means of the fixing device. The residual toner, which has not been transferred to the transferring paper (15), is cleaned by the cleaning member (17). Then, the residual potential on the electrophotographic photoconductor (10) is diselectrificated by means of the diselectrification member (18) to thereby move on to the next cycle.

As illustrated FIG. 37, the electrophotographic photoconductor (10) has a drum shape, but the electrophotographic photoconductor may be in the shape of a sheet, or an endless belt. As the charging member (11), and the transferring member (16), a corotron, scorotron, and a solid state charger as well as a roller-shaped charging member a brush-shaped charging member are used, and any of the conventional charging units can be used.

As the light sources of the imagewise exposing unit (12) or the diselectrification unit (18), all luminous bodies such as fluorescent lamps, tungsten lamps, halogen lamps, mercury lamps, sodium lamps, light emitting diode (LED), laser diode (LD) (i.e. a semiconductor laser), and electroluminescence (EL) can be used. Among them, the laser diode (LD) and the light emitting diode (LED) are mainly used. Various filters may be used for applying only the light having the predetermined wavelength, and such examples of the filters include a sharp-cut filter, a band-pass filter, a near IR-cut filter, a dichroic filter, an interference filter, and a color conversion filter.

Light is applied to the electrophotographic photoconductor (10) in the transferring step, diselectrifying step, cleaning step or pre-exposing step, which also perform light irradiation. However, the application of light to the electrophotographic photoconductor (10) in the diselectrifying step largely gives fatigue to the electrophotographic photoconductor (10), especially which may reduce chargeability or increase residual potential.

Therefore, it is possible to diselectrify the electrophotographic photoconductor by applying reverse bias in the charging step or cleaning step, not by applying light, and such method for diselectrification may be advantageous for improving the resistance of the electrophotographic photoconductor.

When the electrophotographic photoconductor (10) is positively (negatively) charged to perform imagewise exposure, the positive (negative) latent electrostatic image is formed on the surface of the electrophotographic photoconductor. If this latent electrostatic image is developed with a toner (voltage detecting particles) of negative polarity (positive polarity), a positive image is obtained. If the image is developed with a toner of positive polarity (negative polarity), a negative image is obtained. Methods known in the art are used for the operations of the developing unit and the diselectrifying unit.

Among the contaminants attached to the surface of the electrophotographic photoconductor, discharge materials generated by charging and/or external additives contained in the toner are easily influenced by humidity, and are factors for causing formation of deficient images. Paper dust is also one of the factors for formation of deficient images. The attachment of the paper dust to the electrophotographic photoconductor causes not only formations of deficient images, but also deterioration of abrasion resistance, and partial abrasions. Therefore, the configuration that the electrophotographic photoconductor and the paper are not in direct contact with each other is preferable for improving the quality of the resulting images.

The toner used for developing the image on the electrophotographic photoconductor (10) by means of the developing member (13) is transferred to the transferring paper (15). However, all of the toner present on the electrophotographic photoconductor is not transferred, and some of the toner may remain on the electrophotographic photoconductor (10). Such residual toner is removed from the electrophotographic photoconductor (10) by the cleaning member (17). As the cleaning member, those known in the art, such as a cleaning blade and a cleaning brush are used. The cleaning blade and the cleaning brush are sometimes used in combination.

Since the electrophotographic photoconductor of the present invention has high photosensitivity and high stability, it can be applied to a small-diameter photoconductor. The electrophotographic apparatus and method to which such electrophotographic photoconductor is more effectively applied is a so-called tandem electrophotographic apparatus (image forming apparatus). The tandem electrophotographic apparatus is equipped with a plurality of electrophotographic photoconductors corresponding to respective developing units each containing a toner of respective color, and these electrophotographic photoconductors and the developing units are operated so as to perform parallel processing. To the tandem electrophotographic apparatus (image forming apparatus), at least four color toners, yellow (C), magenta (M), cyan (C), and black (K), which are necessary for full-color printing, and developing units containing these toners are provided, as well as at least four photoconductors corresponding to these developing units. Having such configuration, such electrophotographic apparatus (image forming apparatus) can realize remarkably high speed printing, compared with the printing speed of conventional image forming apparatuses (image forming apparatuses) for full color printing.

Figure 38:
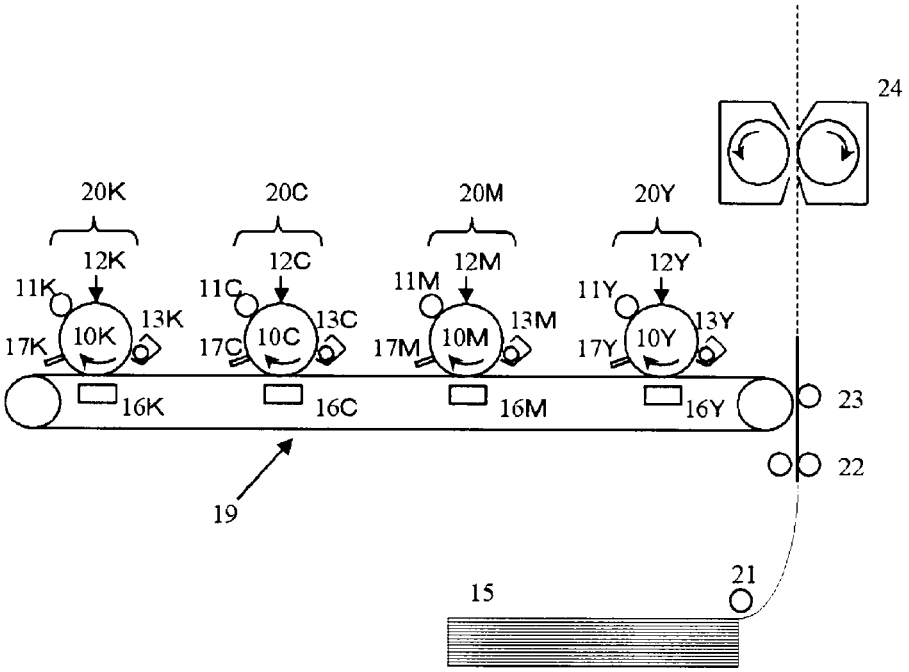
FIG. 38 is a schematic view for explaining one exemplary full color tandem electrophotographic apparatus of the present invention

FIG. 38 is a schematic view for explaining the full color tandem electrophotographic apparatus of the present invention, and the modification example described below is also within the scope of the present invention.

In FIG. 38, the electrophotographic photoconductors (10C (cyan)), (10M (magenta)), (10Y (yellow)), and (10K (black)) are each a drum-shaped electrophotographic photoconductor (10), and these electrophotographic photoconductors (10C, 10M, 10Y, and 10K) are each rotated in the direction shown by the arrow in this figure. Around each electrophotographic photoconductor, at least a respective charging member (11C, 11M, 11Y, or 11K) serving as a charging unit, developing member (13C, 13M, 13Y, or 13K) serving as a developing unit, and cleaning member (17C, 17M, 17Y, or 17K) serving as a cleaning unit are provided in the order of rotation.

Laser light (12C, 12M, 12Y, and 12K) is applied to the electrophotographic photoconductors (10C, 10M, 10Y, and 10K) from the exposing members serving as the exposing units each present between the charging units (11C, 11M, 11Y, and 11K) and the developing units (13C, 13M, 13Y, and 13K), respectively, to form electrostatic latent images on the electrophotographic photoconductors (10C, 10M, 10Y, and 10K), respectively.

Four image forming elements (20C, 20M, 20Y, and 20K), each of which is configured to have the electrophotographic photoconductor (10C, 10M, 10Y, or 10K) in its center, are arranged along the transferring conveyance belt (19) serving as a transferring material conveying unit.

The transferring conveyance belt (19) is provided so as to be in contact with the sections of the electrophotographic photoconductors (10C, 10M, 10Y, and 10K) each of which is provided in the section between the developing member (13C, 13M, 13Y, or 13K) of each image forming element (20C, 20M, 20Y, or 20K) and the cleaning member (17C, 17M, 17Y, or 17K), and transferring units (16C, 16M, 16Y, and 16K) for applying transferring bias are provided on the other side (the back surface) of the transferring conveyance belt (19) to the side where the electrophotographic photoconductors (10C, 10M, 10Y, and 10K) are provided. The difference between the image forming elements (20C, 20M, 20Y, and 20K) is color of the toner housed in the developing device, and the other configurations are the same in the all image forming elements.

The image forming operations of the color electrophotographic apparatus having the configuration as illustrated in FIG. 38 are performed in the following manner. First, in each image forming element (20C, 20M, 20Y, or 20K), the electrophotographic photoconductor (10C, 10M, 10Y, or 10K) is charged by the charging member (11C, 11M, 11Y, or 11K) which is rotated in the same direction as the rotational direction of the electrophotographic photoconductor (10C, 10M, 10Y, or 10K), and latent electrostatic images, each corresponding to the respective color of the image to be formed, are formed by laser light (12C, 12M, 12Y, or 12K) applied from the exposing section provided outside of the the electrophotographic photoconductor (10C, 10M, 10Y, or 10K).

Next, the formed latent electrostatic images are developed with the developing member (13C, 13M, 13Y, and 13K) to form toner images. The developing members (13C, 13M, 13Y, and 13K) are developing members each perform developing the toner of C (cyan), M (magenta), Y (yellow), or K (black), and the toner images each having a single color of C (cyan), M (magenta), Y (yellow), or K (black) respectively formed on the four electrophotographic photoconductors (10C, 10M, 10Y, and 10K) are superimposed on the transferring belt (19).

The transferring paper (15) is fed from the tray by means of the feeding roller (21), and then temporarily stopped by a pair of registration rollers (22) so that the transferring paper (15) is sent to the transferring member (23) so as to meet the timing to the image formation on the electrophotographic photoconductor. The toner image held on the transferring belt (19) is transferred to the transferring paper (15) by the electric field generated by the potential difference between the transferring bias applied to the transferring member (23) and the transferring belt (19). The toner image transferred onto the transferring paper (15) is conveyed and fixed thereon by the fixing member (24), and the transferring paper (15) bearing the fixed image is then discharged to the discharging unit. The residual toner remaining on the electrophotographic photoconductors (10C, 10M, 10Y, and 10K) without being transferred to the transferring unit is collected by the cleaning units (17C, 17M, 17Y, and 17K) each provided in the respective image forming element.

The intermediate transferring system as illustrated in FIG. 38 is particularly effective for an electrophotographic apparatus (image forming apparatus) capable of full color printing. In this system, as a plurality of toner images are formed on an intermediate transferring member first, and then transferred to paper at the same time, it is easy to control and prevent dislocations of colors, and is advantageous for attaining high quality images.

As the intermediate transferring member, intermediate transferring members of various materials and shapes, such as a drum shape and a belt shape are available. In the present invention, any of the conventional intermediate transferring members known in the art can be used, and use of the intermediate transferring member is effective and useful for improving the durability of the photoconductor and improving the quality of the resulting images.

Note that, in the example illustrated in FIG. 38, the image forming elements are arranged in the order of C (cyan), M (magenta), Y (yellow), and K (black) from the upstream to downstream in terms of the transferring paper conveying direction. However, the arrangement of the image forming elements is not necessarily limited to this order, and the order of the colors can be appropriately set. Moreover, it is particularly effective for the present invention to provide a mechanism that the image forming elements (20C, 20M, and 20Y) other than that of black is stopped when documents in the color of only black are formed.

The image forming unit (element) as described above may be fixed and incorporated in copying devices, facsimiles, and printers, or may be incorporated therein in the form of a process cartridge.

Figure 39:
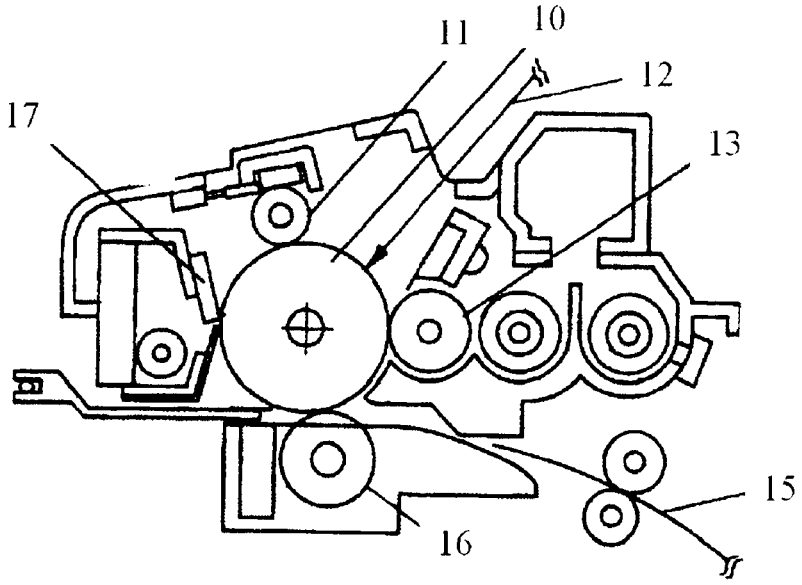
FIG. 39 is a schematic view for explaining one exemplary process cartridge of the present invention.

The process cartridge is, for example, a device (part) containing the electrophotographic photoconductor (10), the charging member (11), the imagewise exposing member (12), the developing member (13), the transferring member (16), the cleaning member (17), and the diselectrification unit, as illustrated in FIG. 39.

The above-described tandem electrophotographic apparatus (image forming apparatus) can realize high speed full color printing because it can transfer a plurality of toner images at one time.

However, the conventional tandem image forming device still has many problems to be solved. For example, the tandem image forming device requires at least four electrophotographic photoconductors, and thus the size of the apparatus inevitably becomes large. In addition, when the amount of each toner used is varied in the color, each photoconductor has a different amount of abrasion depending on the amount of the toner used, which may reduce color reproduction ability, or may form deficient images.

Comparing to the above, the electrophotographic photoconductor of the present invention can be applied as a small diameter photoconductor because the electrophotographic photoconductor of the present invention realizes high photosensitivity and high stability. Since the electrophotographic photoconductor of the present invention reduces adverse phenomena such as increased residual potential and deterioration of sensitivity, the difference formed in the residual potential or sensitivity among the four electrophotographic photoconductors over time is small even though the abrasion amounts of the four electrophotographic photoconductors are different from each other, and thus full color images having excellent color reproduceability can be attained even after repetitive use for a long period of time.

EXAMPLES

The present invention will next be described by way of Examples, which should not be construed as limiting the present invention thereto.

Production Example 1

Production of Chlorogallium Porphyrazine Derivative Mixture (Mixture No. 1)

Gallium trichloride (5.00 g, 28.4 mmol) was added to phthalonitrile (14.48 g, 0.5679 mmol×199) and 2,3-dicyanopyridine (73.33 mg, 0.5679 mmol) in 1-chloronaphthalene (70 mL), and the mixture was heated and stirred under argon flow at 240° C. to 246° C. for 12 hours. The resultant mixture was left to cool to 130° C., followed by filtration. The obtained crystals were washed with N,N-dimethylformamide and water, and then dried with heating under reduced pressure, to thereby obtain 13.94 g of a chlorogallium porphyrazine derivative mixture (mixture No. 1) as blue powder.

Figure 2:
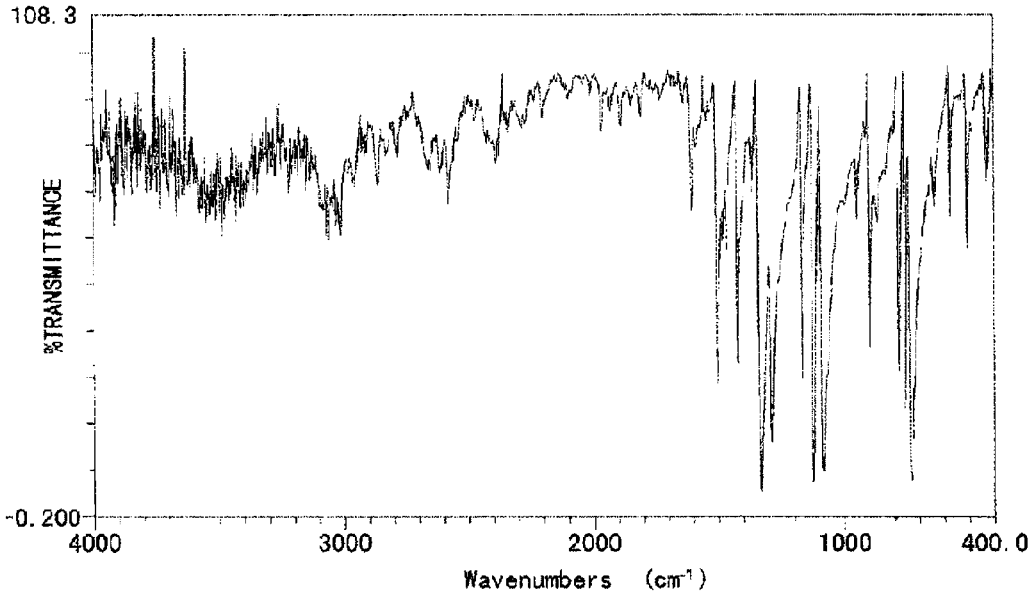
FIG. 2 is an IR absorption spectrum chart of a chlorogallium porphyrazine derivative mixture (mixture No. 1) synthesized in Production Example 1.

FIGS. 1 and 2 respectively show a powder X ray spectrum and an infrared absorption spectrum (measured by the KBr tablet method) of the powder of the chlorogallium porphyrazine derivative mixture.

Here, the X ray spectrum was measured with CuKα rays under the following conditions.

Measurement apparatus: X'Pert Pro (product of Philips)
X ray tube: Cu (wavelength: 1.54 angstroms (0.154 nm))
Voltage: 50 kV
Current: 30 mA
Scanning speed: 2 deg./min
Scanning range: 2 deg. to 35 deg. or 3 deg. to 35 deg.
Time constant: 2 sec Meanwhile, the infrared absorption spectrum was measured under the following conditions.

Measurement apparatus: Fourier transform infrared spectroscope FT-720 (product of HORIBA Ltd.)
Conditions: KBr tablet method

Production Example 2

Production of Chlorogallium Porphyrazine Derivative Mixture (Mixture No. 2)

Figure 3:
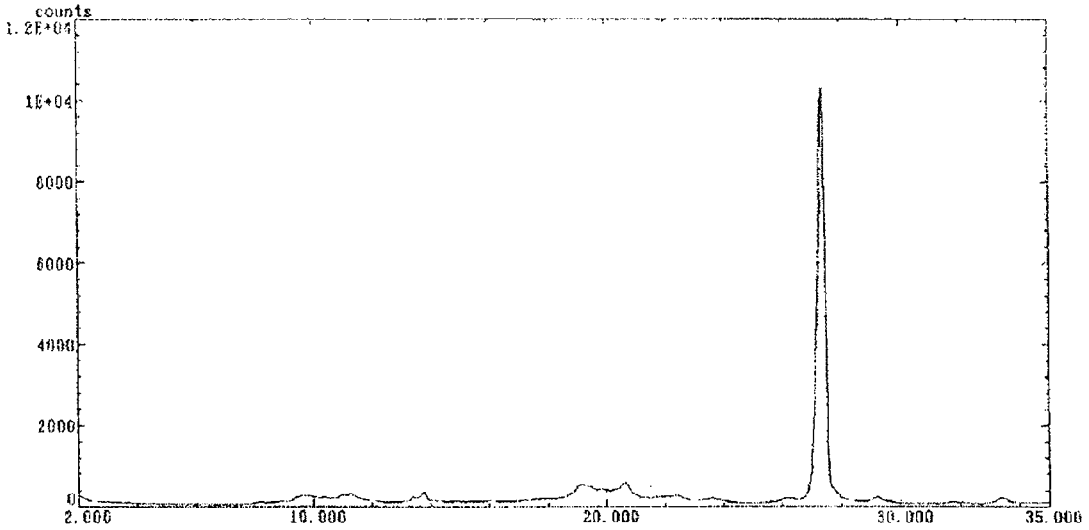
FIG. 3 is a powder X ray spectrum chart of a chlorogallium porphyrazine derivative mixture (mixture No. 2) synthesized in Production Example 2.
Figure 4:
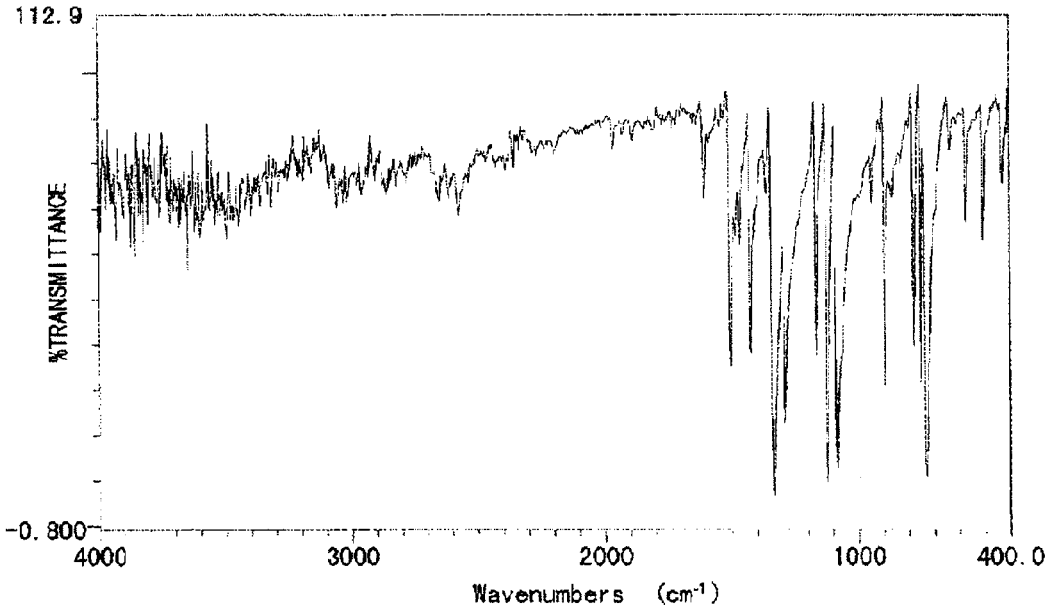
FIG. 4 is an IR absorption spectrum chart of a chlorogallium porphyrazine derivative mixture (mixture No. 2) synthesized in Production Example 2.

The procedure of Production Example 1 was repeated, except that the mixing ratio of phthalonitrile and 2,3-dicyanopyridine was changed as described in Table 1, to thereby produce a chlorogallium porphyrazine derivative mixture (mixture No. 2). Table 1 shows the yield and the result of elemental analysis of the mixture. FIGS. 3 and 4 respectively show a powder X ray spectrum and an infrared absorption spectrum (measured by the KBr tablet method) of the mixture.

Production Example 3

Production of Chlorogallium Porphyrazine Derivative Mixture (Mixture No. 3)

Figure 5:
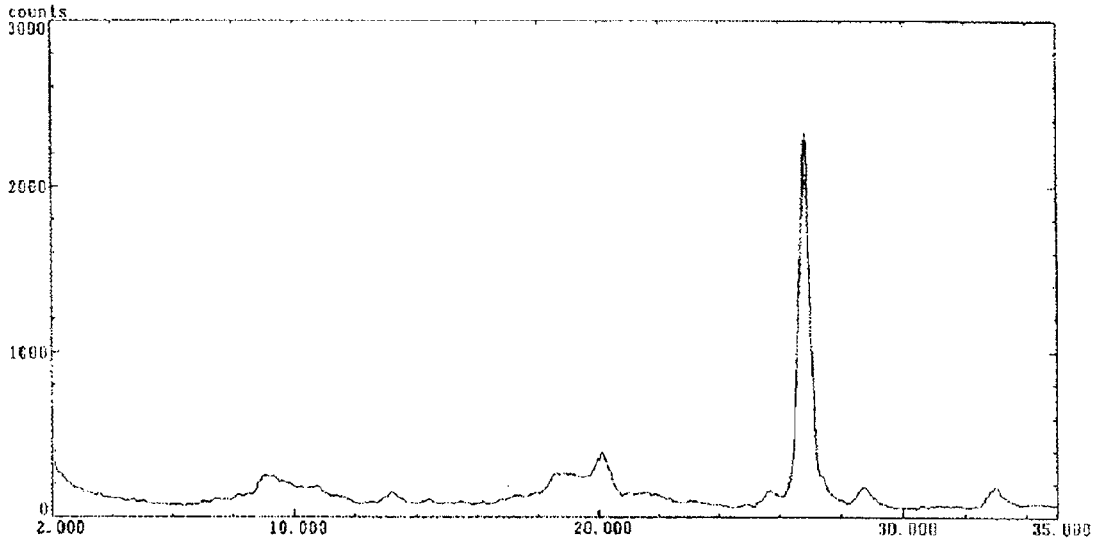
FIG. 5 is a powder X ray spectrum chart of a chlorogallium porphyrazine derivative mixture (mixture No. 3) synthesized in Production Example 3.
Figure 6:
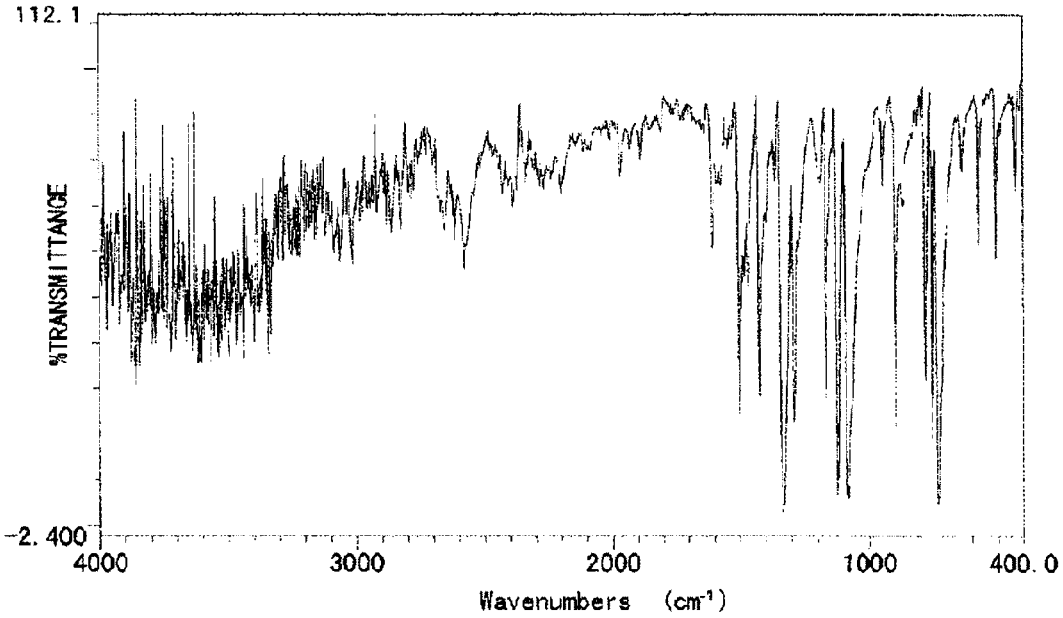
FIG. 6 is an IR absorption spectrum chart of a chlorogallium porphyrazine derivative mixture (mixture No. 3) synthesized in Production Example 3.

The procedure of Production Example 1 was repeated, except that the mixing ratio of phthalonitrile and 2,3-dicyanopyridine was changed as described in Table 1, to thereby produce a chlorogallium porphyrazine derivative mixture (mixture No. 3). Table 1 shows the yield and the result of elemental analysis of the mixture. FIGS. 5 and 6 respectively show a powder X ray spectrum and an infrared absorption spectrum (measured by the KBr tablet method) of the mixture.

TABLE 1

| Production Ex. | Mixture No. | Phthalonitrile:2, 3-Dicyanopyridine (ratio by mole) | Yield (g) | Results of elemental analysis (%) C | H | N |
|---|---|---|---|---|---|---|
| 1 | 1 | 199:1 | 13.94 | 62.04 | 2.69 | 18.33 |
| 2 | 2 | 39:1 | 13.36 | 61.82 | 2.66 | 18.00 |
| 3 | 3 | 7:1 | 11.08 | 61.77 | 2.68 | 19.10 |

Production Example 4

Production of Chlorogallium Porphyrazine Derivative Mixture (Mixture No. 4)

Gallium trichloride (5.00 g, 28.4 mmol) was added to 1,3-diiminoisoindoline (16.08 g, 2.840 mmol×39) and 3,4-dicyanopyridine (0.3666 g, 2.840 mmol) in quinoline (100 mL), and the mixture was heated and stirred under argon flow at 196° C. to 200° C. for 6 hours. The resultant mixture was left to cool to 130° C., followed by filtration. The obtained crystals were washed with N,N-dimethylformamide and water, and then dried with heating under reduced pressure, to thereby obtain 15.15 g of a chlorogallium porphyrazine derivative mixture (mixture No. 4) as blue powder.

Figure 7:
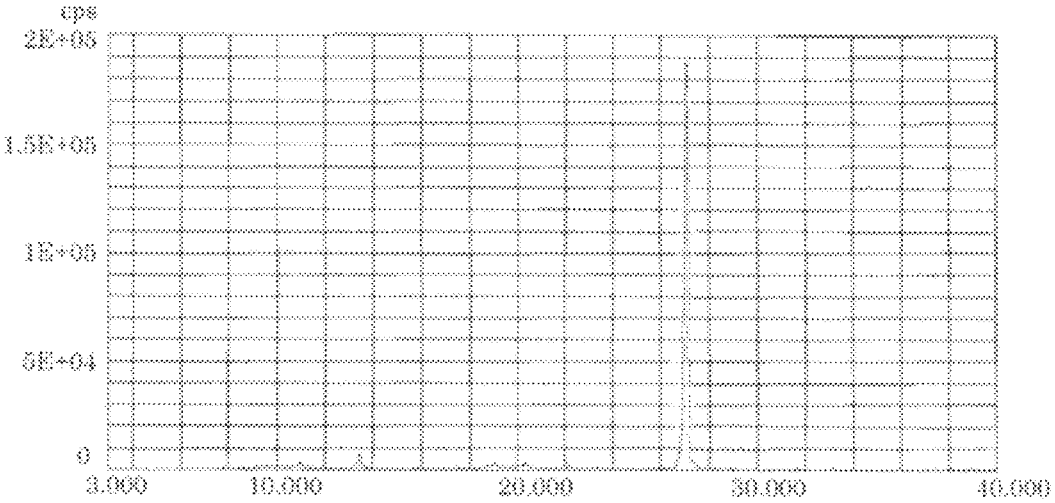
FIG. 7 is a powder X ray spectrum chart of a chlorogallium porphyrazine derivative mixture (mixture No. 4) synthesized in Production Example 4.

FIG. 7 shows a powder X ray spectrum of the powder of the chlorogallium porphyrazine derivative mixture.

Production Example 5

Production of Chlorogallium Porphyrazine Derivative Mixture (Mixture No. 5)

Gallium trichloride (5.00 g, 28.4 mmol) was added to 1,3-diiminoisoindoline (16.08 g, 2.840 mmol×39) and 2,3-dicyano-5,6-dimethylpyridine (0.4464 g, 2.840 mmol) in quinoline (100 mL), and the mixture was heated and stirred under argon flow at 190° C. to 198° C. for 6 hours. The resultant mixture was left to cool to 130° C., followed by filtration. The obtained crystals were washed with N,N-dimethylformamide and water, and then dried with heating under reduced pressure, to thereby obtain 15.08 g of a chlorogallium porphyrazine derivative mixture (mixture No. 5) as blue powder.

Figure 8:
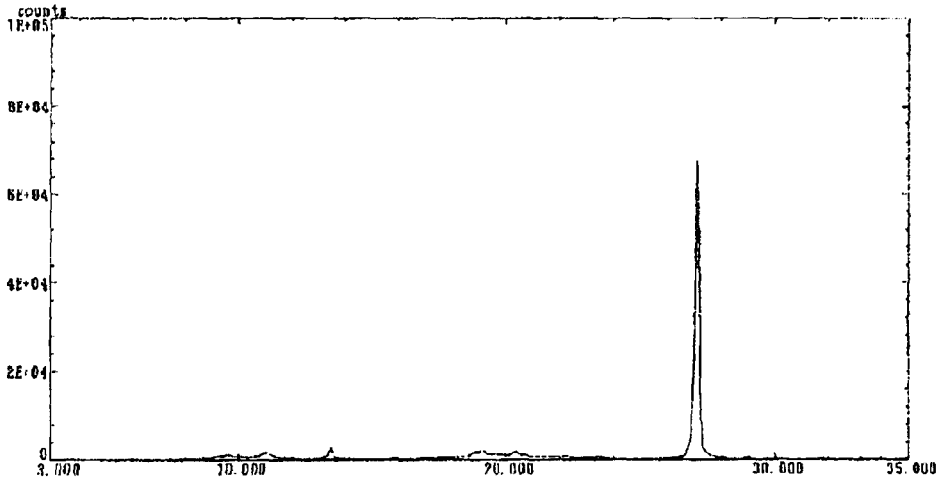
FIG. 8 is a powder X ray spectrum chart of a chlorogallium porphyrazine derivative mixture (mixture No. 5) synthesized in Production Example 5.

FIG. 8 shows a powder X ray spectrum of the powder of the chlorogallium porphyrazine derivative mixture.

Production Example 6

Production of Chlorogallium Porphyrazine Derivative Mixture (Mixture No. 6)

Gallium trichloride (5.00 g, 28.4 mmol) was added to phthalonitrile (13.83 g, 2.840 mmol×38), 4-hydroxyphthalonitrile (0.4093 g, 2.840 mmol) and 2,3-dicyano-5-chloropyridine (0.4645 g, 2.840 mmol) in dimethylsulfoxide (90 mL), and the mixture was heated and stirred under argon flow at 190° C. to 198° C. for 6 hours. The resultant mixture was left to cool to 130° C., followed by filtration. The obtained crystals were washed with N,N-dimethylformamide and water, and then dried with heating under reduced pressure, to thereby obtain 14.98 g of a chlorogallium porphyrazine derivative mixture (mixture No. 6) as blue powder.

Figure 9:
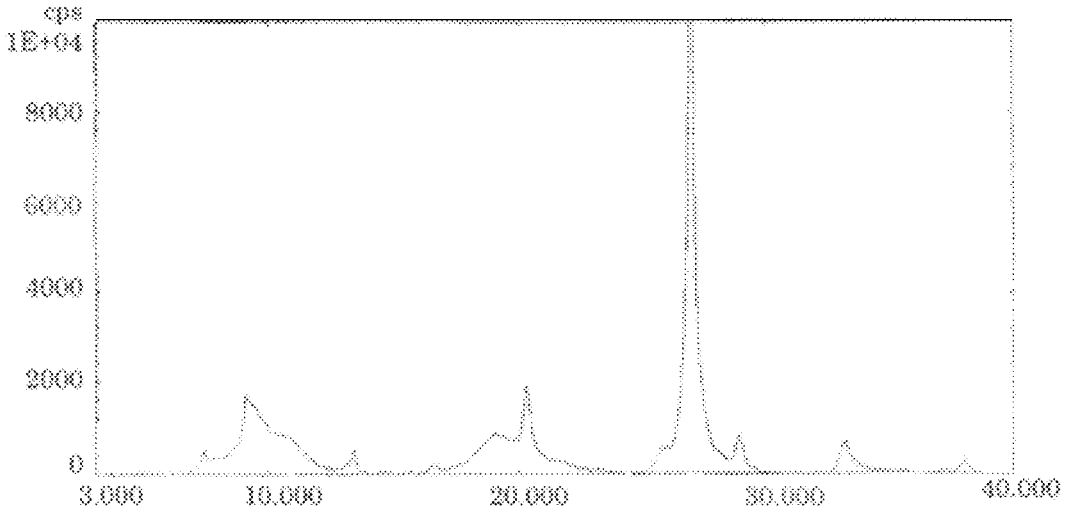
FIG. 9 is a powder X ray spectrum chart of a chlorogallium porphyrazine derivative mixture (mixture No. 6) synthesized in Production Example 6.

FIG. 9 shows a powder X ray spectrum of the powder of the chlorogallium porphyrazine derivative mixture.

Production Example 7

Production of Hydroxygallium Porphyrazine Derivative Mixture (Mixture No. B-7)

Concentrated sulfuric acid (180 g) was stirred and cooled in an ice water bath, and 6.00 g of the chlorogallium porphyrazine derivative mixture (mixture No. 1) produced in Production Example 1 was added portionwise thereto for 10 min for dissolution. After stirring for 1 hour, the mixture was added dropwise to 900 g of ice water under stirring. The resultant mixture was stirred for 1 hour and then filtrated to obtain a wet cake. The obtained wet cake was washed with ion exchange water twice, 2% by mass aqueous ammonia once, and ion exchange water three times, followed by drying with heating under reduced pressure, to thereby obtain 5.76 g of a hydroxygallium porphyrazine derivative mixture.

The obtained hydroxygallium porphyrazine derivative mixture (3.00 g), N,N-dimethylformamide (45 g) and glass beads 1 mm in diameter (175 g) were added to a ball mill pot, followed by milling at room temperature for 48 hours and collecting of crystals. The obtained crystals were heated and dried under reduced pressure to obtain 3.00 g of a hydroxygallium porphyrazine derivative mixture (mixture No. B-7) as blue powder. Through measurement for X ray spectrum using CuKα rays, this mixture was found to have strong diffraction peaks at Bragg angles (2θ±0.2°) of at least 7.4°, 16.2°, 25.2° and 28.3°.

Figure 10:
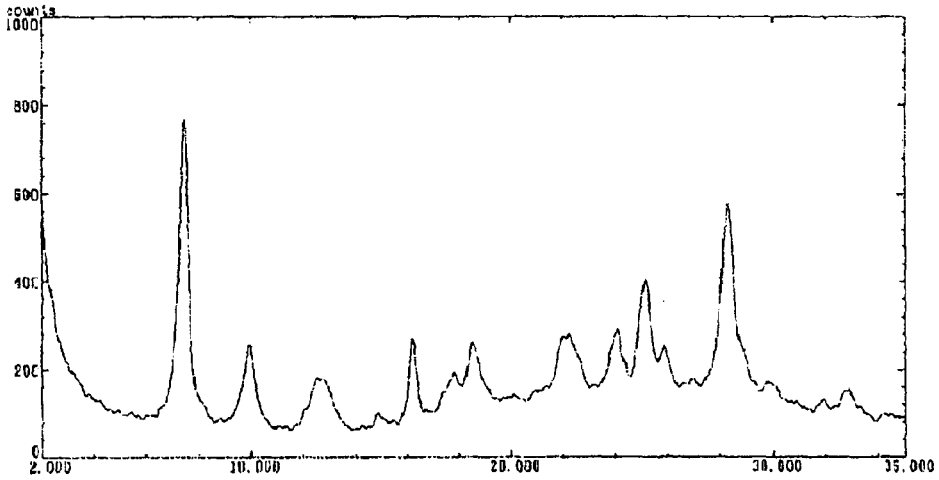
FIG. 10 is a powder X ray spectrum chart of a hydroxygallium porphyrazine derivative mixture (mixture No. 7) synthesized in Production Example 7.
Figure 11:
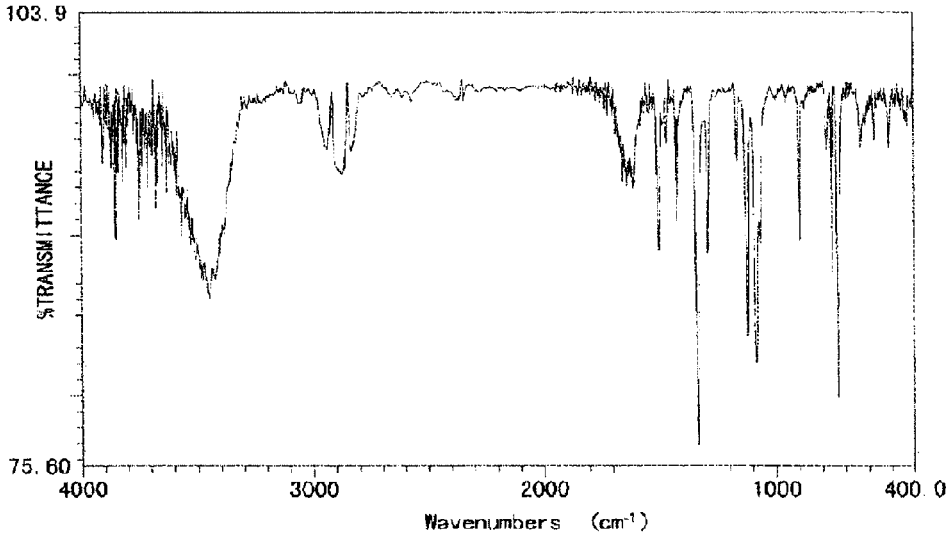
FIG. 11 is an IR absorption spectrum chart of a hydroxygallium porphyrazine derivative mixture (mixture No. B-7) synthesized in Production Example 7.

FIGS. 10 and 11 respectively show a powder X ray spectrum and an infrared absorption spectrum (measured by the KBr tablet method) of the mixture.

Production Example 8

Production of Hydroxygallium Porphyrazine Derivative Mixture (Mixture No. B-8)

The procedure of Production Example 7 was repeated, except that the chlorogallium porphyrazine derivative mixture (mixture No. 1) was changed to mixture No. 2, to thereby produce a hydroxygallium porphyrazine derivative mixture (mixture No. B-8). Table 2 shows the yield and the result of elemental analysis of the obtained hydroxygallium porphyrazine derivative mixture.

Figure 12:
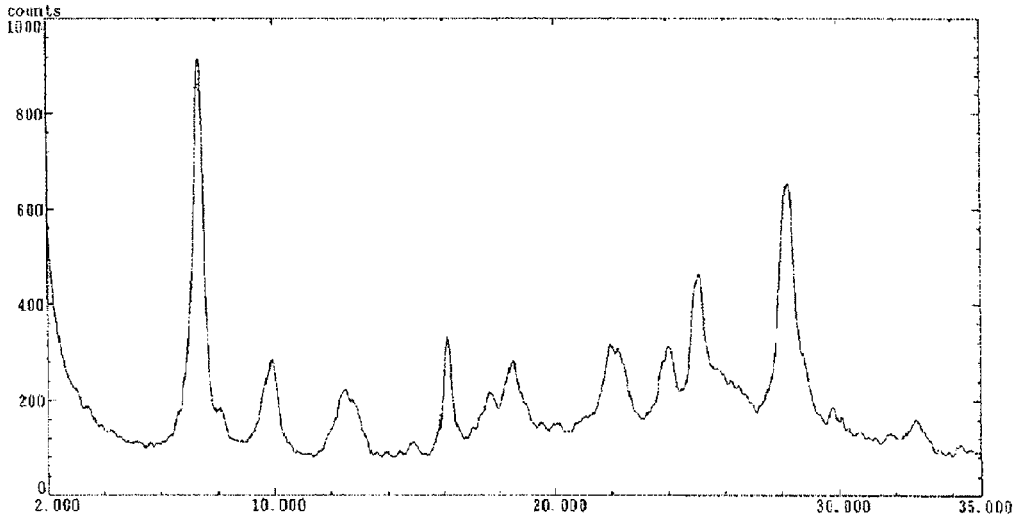
FIG. 12 is a powder X ray spectrum chart of a hydroxygallium porphyrazine derivative mixture (mixture No. B-8) synthesized in Production Example 8.

FIG. 12 shows a powder X ray spectrum of the hydroxygallium porphyrazine derivative mixture. In the X ray spectrum obtained using CuKα rays, the hydroxygallium porphyrazine derivative mixture was found to have strong diffraction peaks at Bragg angles (2θ±0.2°) of at least 7.4°, 16.2°, 25.2° and 28.3°.

Production Example 9

Production of Hydroxygallium Porphyrazine Derivative Mixture (Mixture No. B-9)

The procedure of Production Example 7 was repeated, except that the chlorogallium porphyrazine derivative mixture (mixture No. 1) was changed to mixture No. 3, to thereby produce a hydroxygallium porphyrazine derivative mixture (mixture No. B-9). Table 2 shows the yield and the result of elemental analysis of the obtained hydroxygallium porphyrazine derivative mixture.

Figure 13:
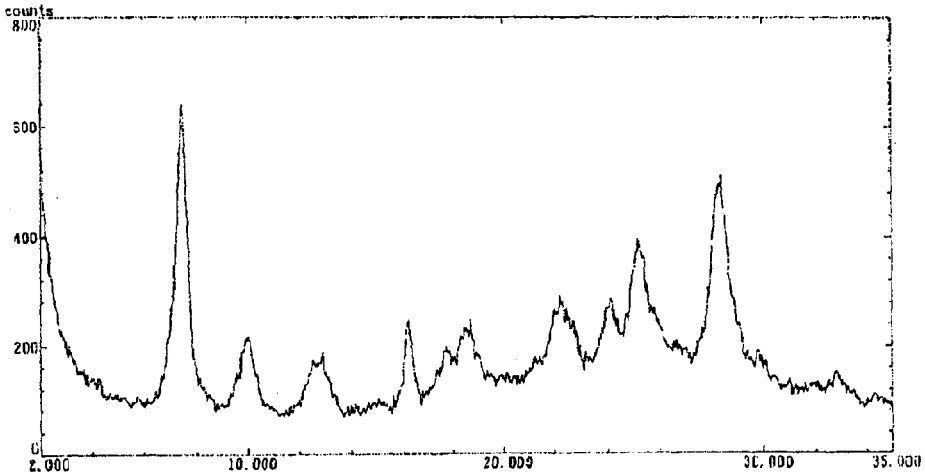
FIG. 13 is a powder X ray spectrum chart of a hydroxygallium porphyrazine derivative mixture (mixture No. B-9) synthesized in Production Example 9.

FIG. 13 shows a powder X ray spectrum of the hydroxygallium porphyrazine derivative mixture. In the X ray spectrum obtained using CuKα rays, the hydroxygallium porphyrazine derivative mixture was found to have strong diffraction peaks at Bragg angles (2θ±0.2°) of at least 7.4°, 16.2°, 25.2° and 28.3°.

Production Example 10

Production of Hydroxygallium Porphyrazine Derivative Mixture (Mixture No. B-10)

The procedure of Production Example 7 was repeated, except that the chlorogallium porphyrazine derivative mixture (mixture No. 1) was changed to mixture No. 4, to thereby produce a hydroxygallium porphyrazine derivative mixture (mixture No. B-10). Table 2 shows the yield and the result of elemental analysis of the obtained hydroxygallium porphyrazine derivative mixture.

Figure 14:
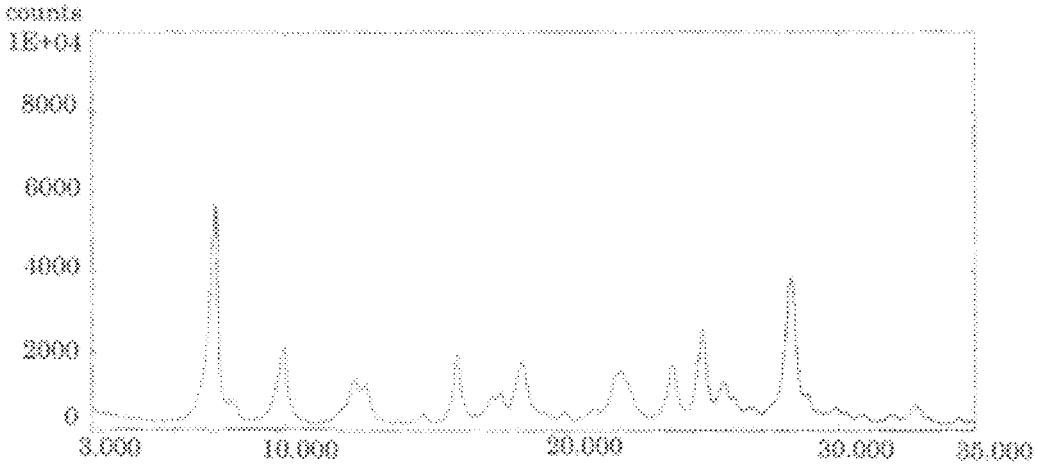
FIG. 14 is a powder X ray spectrum chart of a hydroxygallium porphyrazine derivative mixture (mixture No. B-10) synthesized in Production Example 10.

FIG. 14 shows a powder X ray spectrum of the hydroxygallium porphyrazine derivative mixture. In the X ray spectrum obtained using CuKα rays, the hydroxygallium porphyrazine derivative mixture was found to have strong diffraction peaks at Bragg angles (2θ±0.2°) of at least 7.4°, 16.2°, 25.2° and 28.3°.

Production Example 11

Production of Hydroxygallium Porphyrazine Derivative Mixture (Mixture No. B-11)

The procedure of Production Example 7 was repeated, except that the chlorogallium porphyrazine derivative mixture (mixture No. 1) was changed to mixture No. 5, to thereby produce a hydroxygallium porphyrazine derivative mixture (mixture No. B-11). Table 2 shows the yield and the result of elemental analysis of the obtained hydroxygallium porphyrazine derivative mixture.

Figure 15:
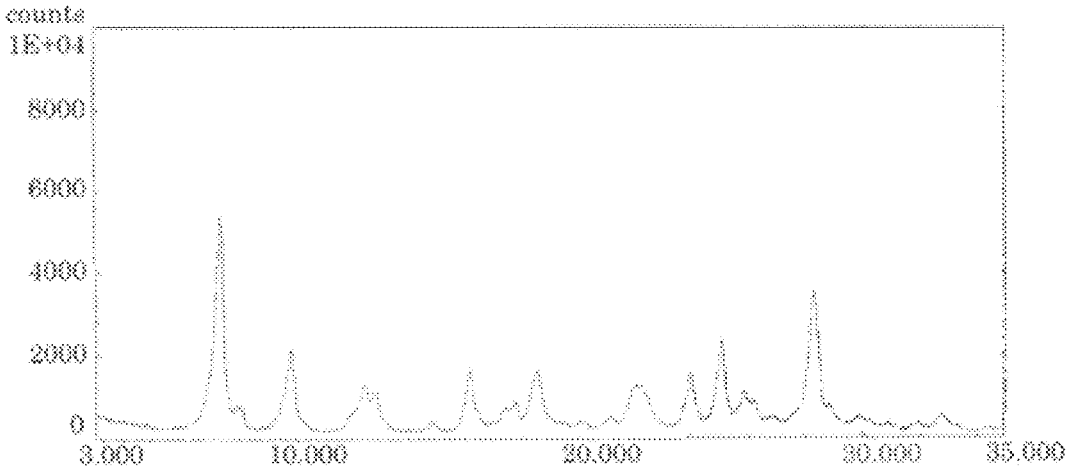
FIG. 15 is a powder X ray spectrum chart of a hydroxygallium porphyrazine derivative mixture (mixture No. B-11) synthesized in Production Example 11.

FIG. 15 shows a powder X ray spectrum of the hydroxygallium porphyrazine derivative mixture. In the X ray spectrum obtained using CuKα rays, the hydroxygallium porphyrazine derivative mixture was found to have strong diffraction peaks at Bragg angles (2θ±0.2°) of at least 7.4°, 16.2°, 25.2° and 28.3°.

Production Example 12

Production of Hydroxygallium Porphyrazine Derivative Mixture (Mixture No. B-12)

The procedure of Production Example 7 was repeated, except that the chlorogallium porphyrazine derivative mixture (mixture No. 1) was changed to mixture No. 6, to thereby produce a hydroxygallium porphyrazine derivative mixture (mixture No. B-12). Table 2 shows the yield and the result of elemental analysis of the obtained hydroxygallium porphyrazine derivative mixture.

Figure 16:
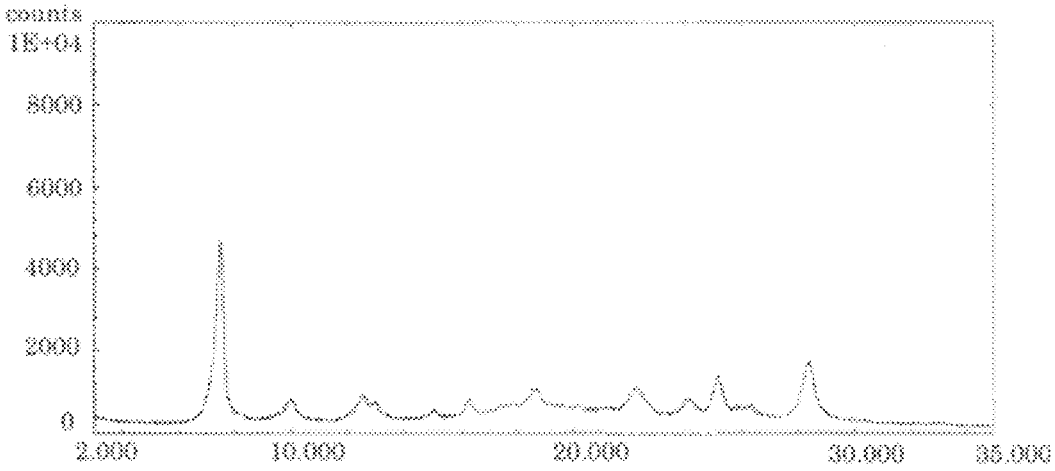
FIG. 16 is a powder X ray spectrum chart of a hydroxygallium porphyrazine derivative mixture (mixture No. B-12) synthesized in Production Example 12.

FIG. 16 shows a powder X ray spectrum of the hydroxygallium porphyrazine derivative mixture. In the X ray spectrum obtained using CuKα rays, the hydroxygallium porphyrazine derivative mixture was found to have strong diffraction peaks at Bragg angles (2θ±0.2°) of at least 7.4°, 16.2°, 25.2° and 28.3°.

TABLE 2

| Production Mixture | | | Yield | Results of elemental analysis (%) | | |
|---|---|---|---|---|---|---|
| Ex. | No. | Mixture No. used | (g) | C | H | N |
| 7 | B-7 | 1 | 3.00 | 63.85 | 2.90 | 18.95 |
| 8 | B-8 | 2 | 2.94 | 63.70 | 2.86 | 19.01 |
| 9 | B-9 | 3 | 2.96 | 63.05 | 2.77 | 19.95 |
| 10 | B-10 | 4 | 2.99 | 63.72 | 2.83 | 19.02 |
| 11 | B-11 | 5 | 2.78 | 63.77 | 2.90 | 19.07 |
| 12 | B-12 | 6 | 2.84 | 63.70 | 2.85 | 18.98 |

Production Example 13

Production of Hydroxygallium Porphyrazine Derivative Mixture (Mixture No. 13)

Gallium tri-n-butoxide (9.03 g, 31.24 mmol) and urea (1.71 g, 28.4 mmol) were added to phthalonitrile (14.52 g, 0.2840 mmol×399) and 2,3-dicyanoquinoline (50.89 mg, 0.2840 mmol) in 1-octanol (70 mL), and the mixture was heated and stirred under argon flow at 150° C. to 155° C. for 6 hours. The resultant mixture was left to cool to 130° C., followed by filtration. The obtained crystals were washed with N,N-dimethylformamide, methanol and water, and then dried with heating under reduced pressure, to thereby obtain 13.45 g of a n-butoxygallium porphyrazine derivative mixture as blue powder.

Figure 17:
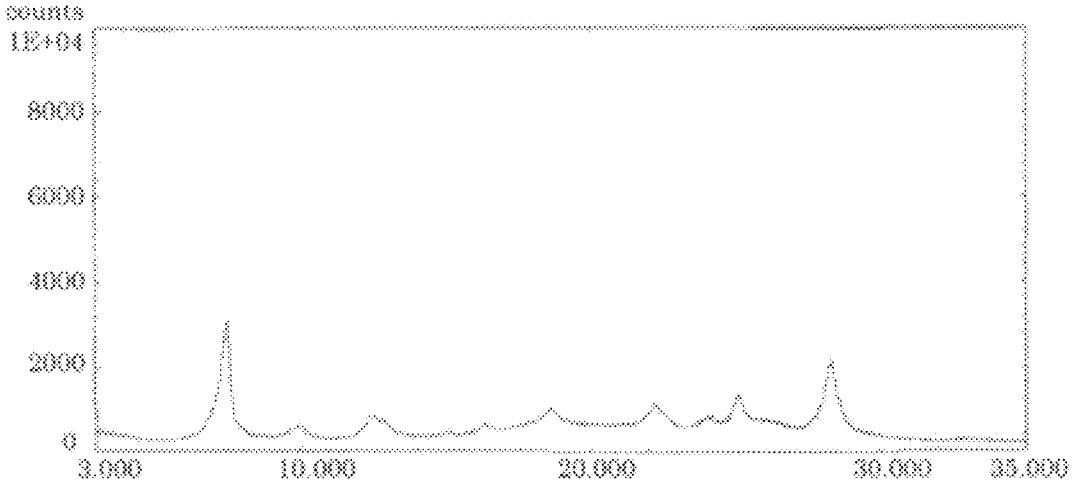
FIG. 17 is a powder X ray spectrum chart of a hydroxygallium porphyrazine derivative mixture (mixture No. B-13) synthesized in Production Example 13.

The obtained n-butoxygallium porphyrazine derivative mixture was subjected to hydrolyzation and crystal conversion in the same manner as in Production Example 7, to thereby obtain 2.98 g of a hydroxygallium porphyrazine derivative mixture (mixture No. B-13). The obtained mixture was found to have the following elemental analysis (%): C, 63.83; H, 2.91; N: 18.93. FIG. 17 shows a powder X ray spectrum of the hydroxygallium porphyrazine derivative mixture. In the X ray spectrum obtained using CuKα rays, the hydroxygallium porphyrazine derivative mixture was found to have strong diffraction peaks at Bragg angles (2θ±0.2°) of at least 7.4°, 16.2°, 25.2° and 28.3°.

Example A-1

Example A-1

Production of Hydroxygallium Porphyrazine Derivative Mixture A-1

Concentrated sulfuric acid (180 g) was stirred and cooled in an ice water bath, and 6.00 g of the chlorogallium porphyrazine derivative mixture (mixture No. 1) produced in Production Example 1 was added portionwise thereto for 10 min for dissolution. After stirring for 1 hour, the mixture was added dropwise to 900 g of ice water under stirring. The resultant mixture was stirred for 1 hour and then filtrated to obtain a wet cake. The obtained wet cake was washed with ion exchange water twice, 2% by mass aqueous ammonia once, and ion exchange water three times, followed by drying with heating under reduced pressure, to thereby obtain 5.76 g of a hydroxygallium porphyrazine derivative mixture A-1 (mixture A-4).

Figure 18:
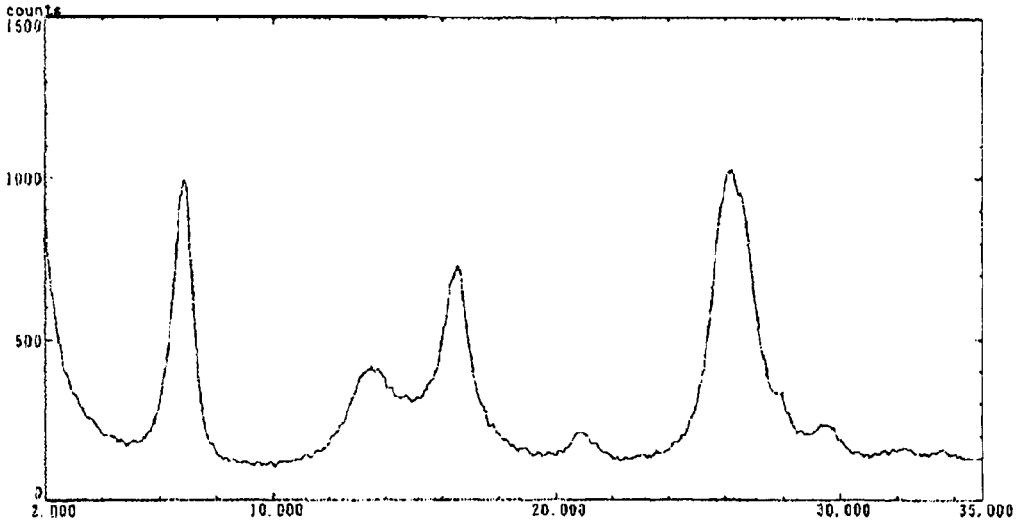
FIG. 18 is a powder X ray spectrum chart of a hydroxygallium porphyrazine derivative mixture (mixture No. A-4) synthesized in Production Example A-1.
Figure 19:
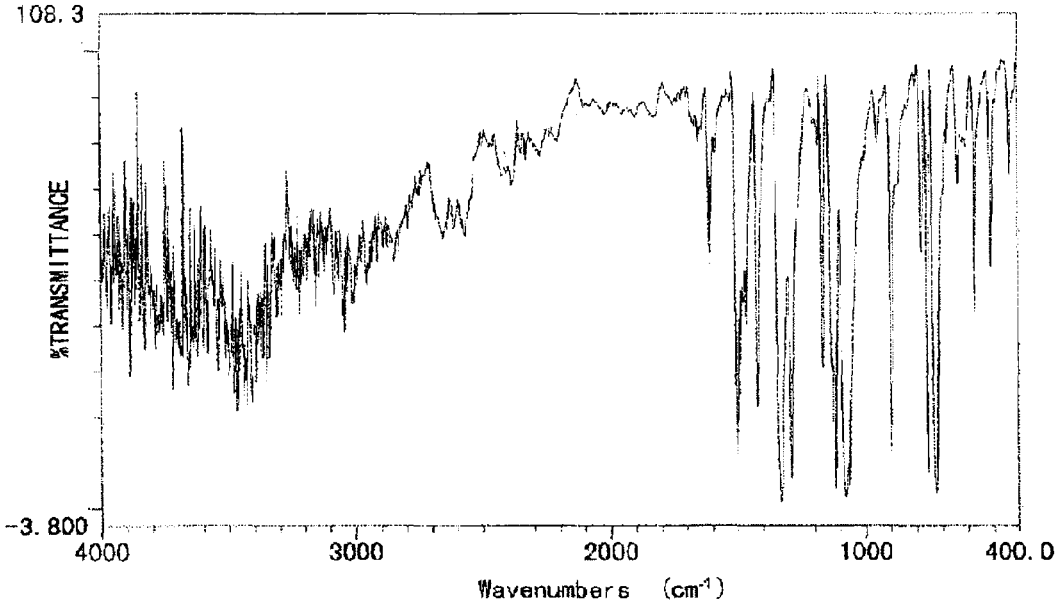
FIG. 19 is an IR absorption spectrum chart of a hydroxygallium porphyrazine derivative mixture (mixture No. A-4) synthesized in Production Example A-1.

The results of elemental analysis are shown in Table 3. From FIG. 18 showing a powder X ray spectrum, the obtained mixture was found to have strong diffraction peaks at Bragg angles (2θ±0.2°) of at least 6.9°, 13.8°, 16.6° and 26.4°. The infrared absorption spectrum chart thereof is shown in FIG. 19.

Example A-2

Example A-2

Production of Hydroxygallium Porphyrazine Derivative Mixture A-2

The procedure of Example A-1 was repeated, except that the mixture No. 1 was changed to mixture No. 2, to thereby produce a hydroxygallium porphyrazine derivative mixture A-2 (mixture No. A-5).

Table 3 shows the yield and the result of elemental analysis of the mixture.

Figure 20:
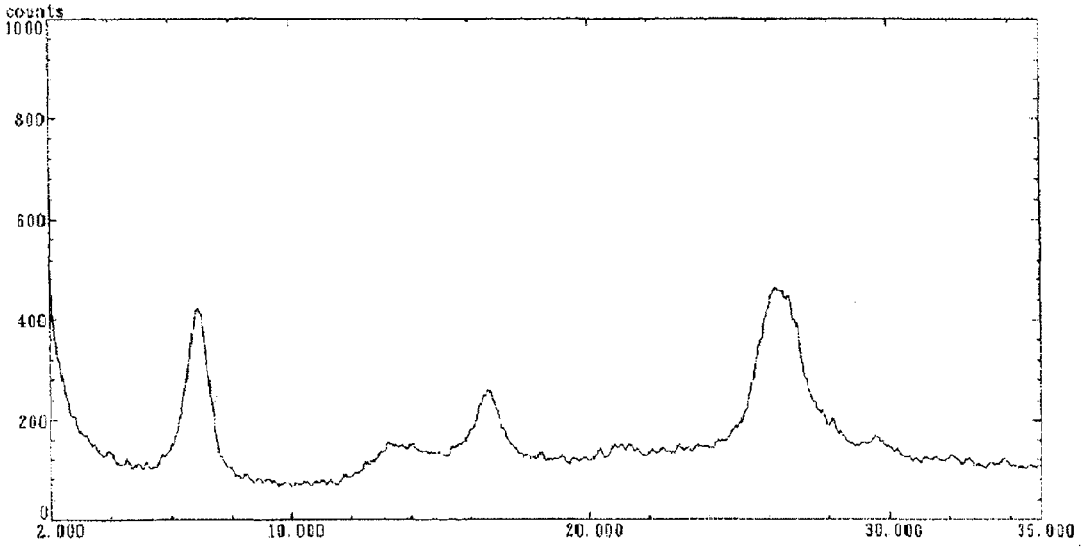
FIG. 20 is a powder X ray spectrum chart of a hydroxygallium porphyrazine derivative mixture (mixture No. A-5) synthesized in Production Example A-2.

From FIG. 20 showing a powder X ray spectrum, the obtained mixture was found to have strong diffraction peaks at Bragg angles (2θ±0.2°) of at least 6.9°, 13.8°, 16.6° and 26.4°.

Figure 21:
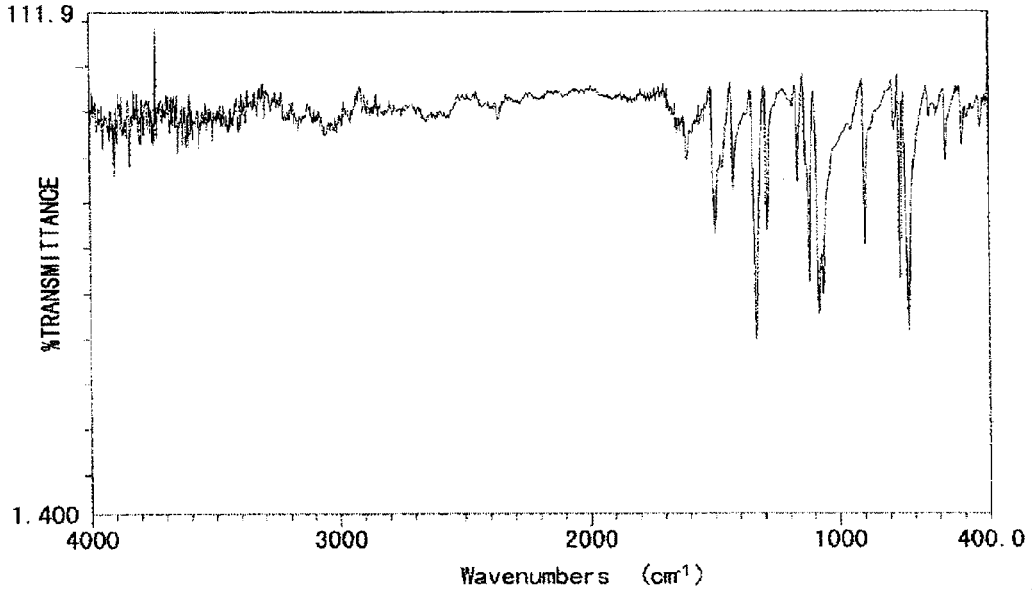
FIG. 21 is an IR absorption spectrum chart of a hydroxygallium porphyrazine derivative mixture (mixture No. A-5) synthesized in Production Example A-2.

The infrared absorption spectrum chart thereof is shown in FIG. 21.

Example A-3

Example A-3

Production of Hydroxygallium Porphyrazine Derivative Mixture A-3

The procedure of Example A-1 was repeated, except that the mixture No. 1 was changed to mixture No. 3, to thereby produce a hydroxygallium porphyrazine derivative mixture A-3 (mixture No. A-6).

Table 3 shows the yield and the result of elemental analysis of the mixture.

Figure 22:
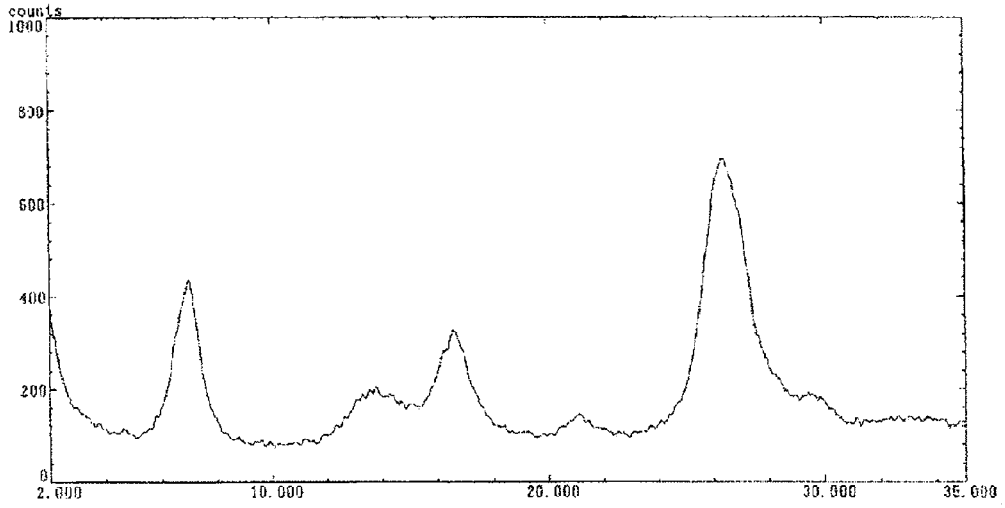
FIG. 22 is a powder X ray spectrum chart of a hydroxygallium porphyrazine derivative mixture (mixture No. A-6) synthesized in Production Example A-3.

From FIG. 22 showing a powder X ray spectrum, the obtained mixture was found to have strong diffraction peaks at Bragg angles (2θ±0.2°) of at least 6.9°, 13.8°, 16.6° and 26.4°.

Figure 23:
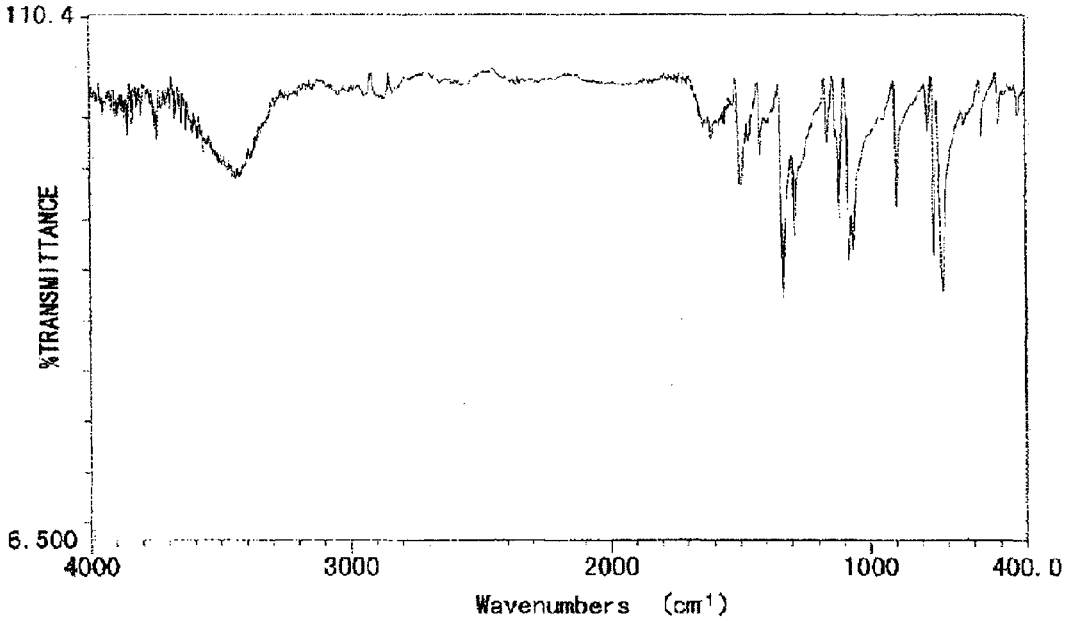
FIG. 23 is an IR absorption spectrum chart of a hydroxygallium porphyrazine derivative mixture (mixture No. A-6) synthesized in Production Example A-3.

The infrared absorption spectrum chart thereof is shown in FIG. 23.

TABLE 3

| Ex. | Mixture No. | Mixture No. used | Yield (g) | Results of elemental analysis (%) C | H | N |
|---|---|---|---|---|---|---|
| A-1 | A-4 | 1 | 5.76 | 63.98 | 2.89 | 18.88 |
| A-2 | A-5 | 2 | 5.76 | 63.82 | 2.84 | 19.00 |
| A-3 | A-6 | 3 | 5.45 | 63.07 | 2.78 | 19.76 |

Example A-4

Example A-4

Crystal Conversion of Hydroxygallium Porphyrazine Derivative Mixture A-1

The hydroxygallium porphyrazine derivative mixture A-1 (mixture No. A-4) (3.00 g), N,N-dimethylformamide (45 g) and glass beads 1 mm in diameter (175 g) were added to a ball mill pot, followed by milling at room temperature for 48 hours and collecting of crystals. The obtained crystals were heated and dried under reduced pressure to obtain 3.00 g of crystals of a hydroxygallium porphyrazine derivative mixture (mixture No. A-7) as blue powder. Through measurement for X ray spectrum using CuKα rays, this mixture was found to have strong diffraction peaks at Bragg angles (2θ±0.2°) of at least 7.4°, 16.2°, 25.2° and 28.3°.

Figure 24:
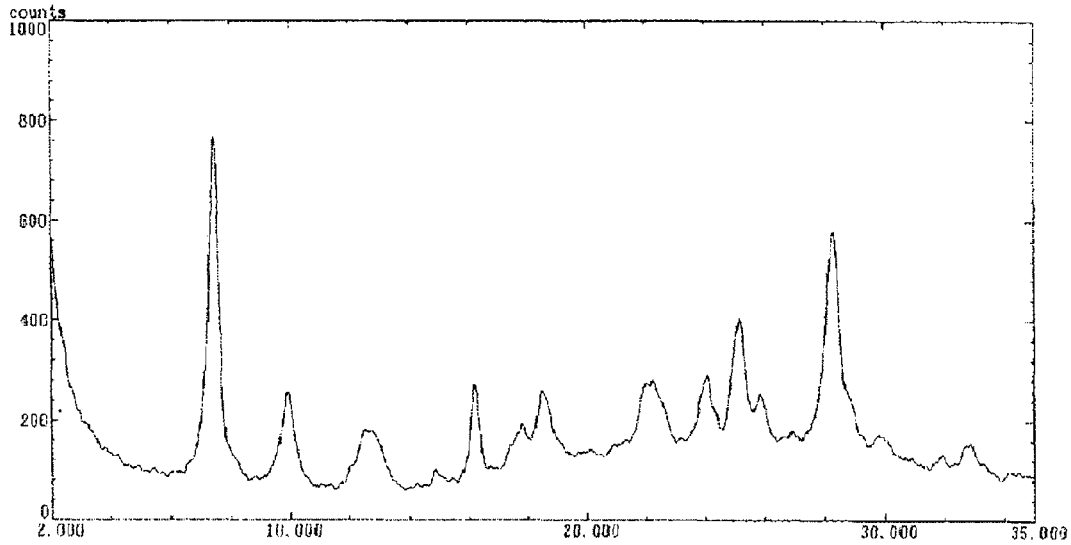
FIG. 24 is a powder X ray spectrum chart of a hydroxygallium porphyrazine derivative mixture (mixture No. A-7) synthesized in Production Example A-4.
Figure 25:
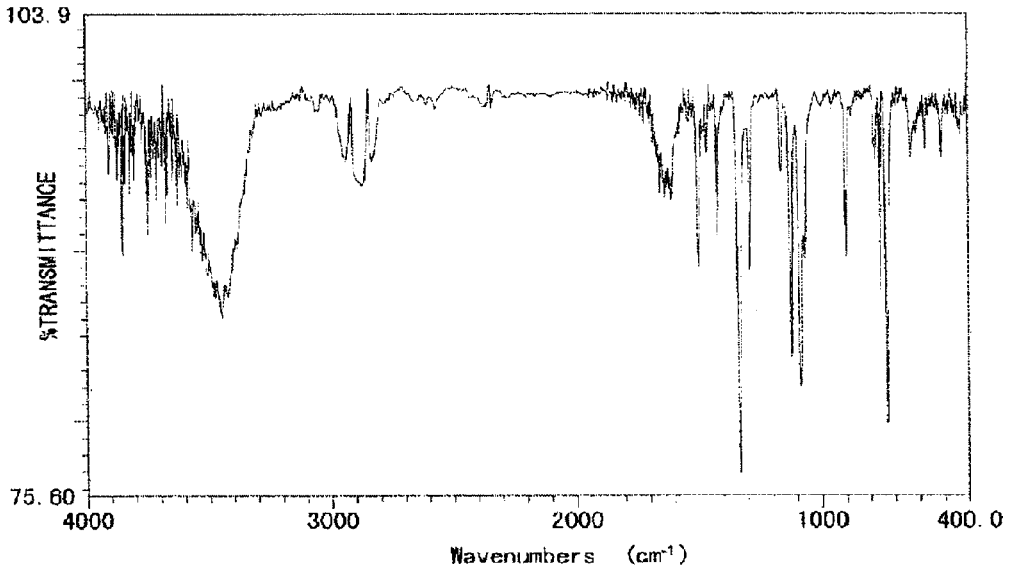
FIG. 25 is an IR absorption spectrum chart of a hydroxygallium porphyrazine derivative mixture (mixture No. A-7) synthesized in Production Example A-4.

FIGS. 24 and 25 respectively show a powder X ray spectrum and an infrared absorption spectrum of the mixture.

Example A-5

Example A-5

Crystal Conversion of Hydroxygallium Porphyrazine Derivative Mixture A-2

The procedure of Example A-4 was repeated, except that the mixture No. A-4 was changed to mixture No. A-5, to thereby obtain crystals of a hydroxygallium porphyrazine derivative mixture (mixture No. A-8). Table 4 shows the yield and the result of elemental analysis of the obtained hydroxygallium porphyrazine derivative mixture.

Figure 26:
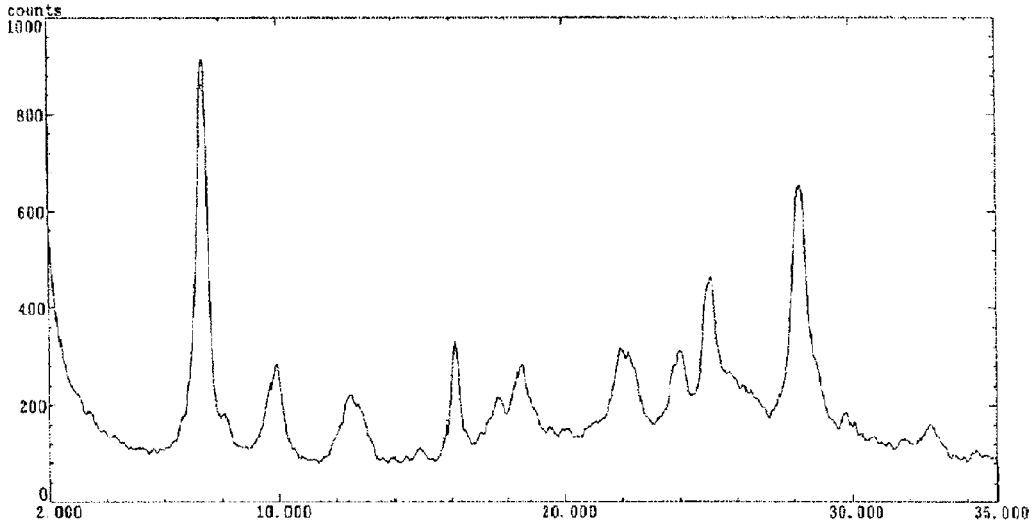
FIG. 26 is a powder X ray spectrum chart of a hydroxygallium porphyrazine derivative mixture (mixture No. A-8) synthesized in Production Example A-5.
Figure 27:
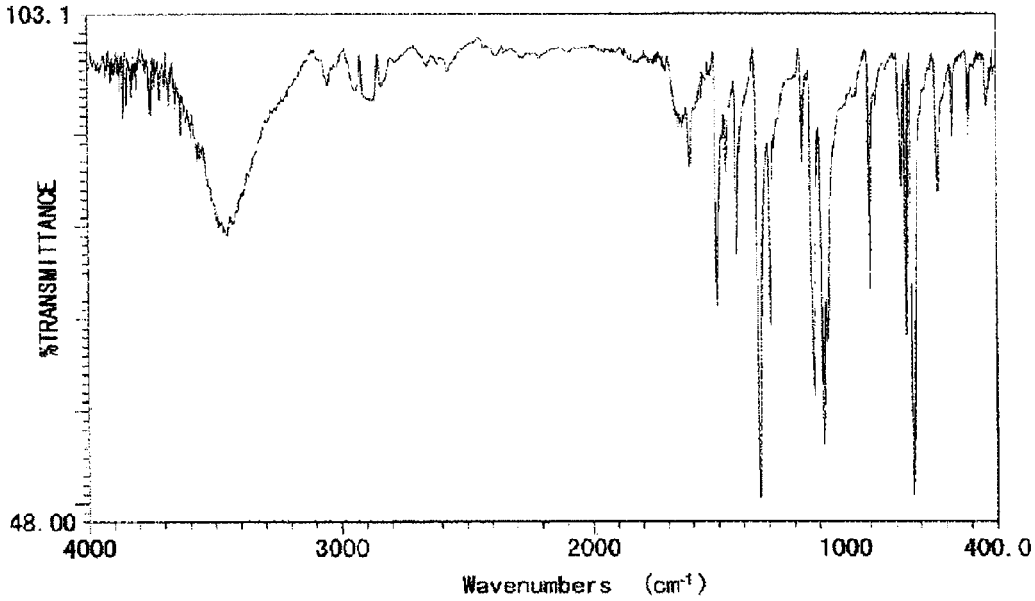
FIG. 27 is an IR absorption spectrum chart of a hydroxygallium porphyrazine derivative mixture (mixture No. A-8) synthesized in Production Example A-5.

FIGS. 26 and 27 respectively show a powder X ray spectrum and an infrared absorption spectrum of the mixture.

Example A-6

Example A-6

Crystal Conversion of Hydroxygallium Porphyrazine Derivative Mixture A-3

The procedure of Example A-4 was repeated, except that the mixture No. A-4 was changed to mixture No. A-6, to thereby obtain crystals of a hydroxygallium porphyrazine derivative mixture (mixture No. A-9). Table 4 shows the yield and the result of elemental analysis of the obtained hydroxygallium porphyrazine derivative mixture.

Figure 28:
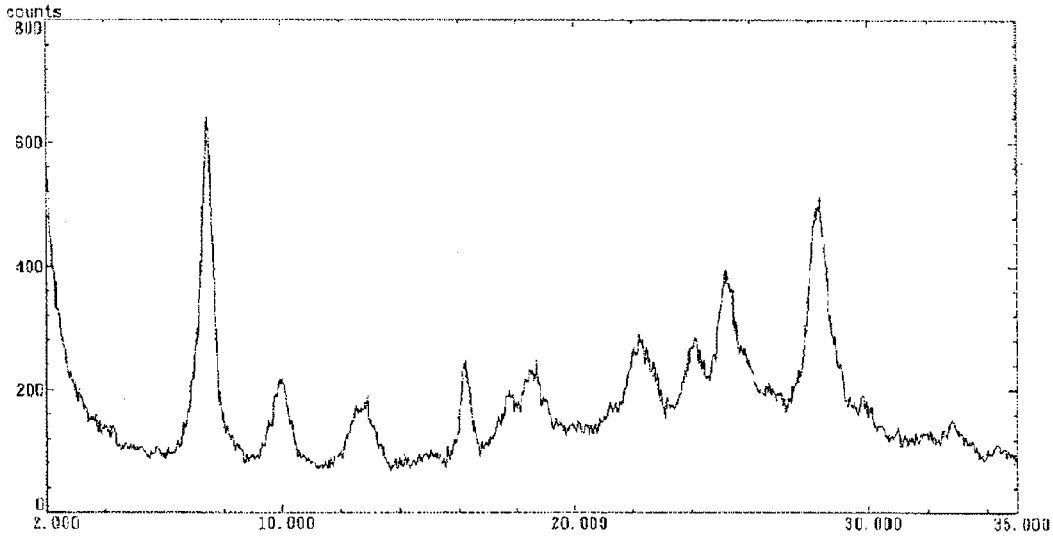
FIG. 28 is a powder X ray spectrum chart of a hydroxygallium porphyrazine derivative mixture (mixture No. A-9) synthesized in Production Example A-6.
Figure 29:
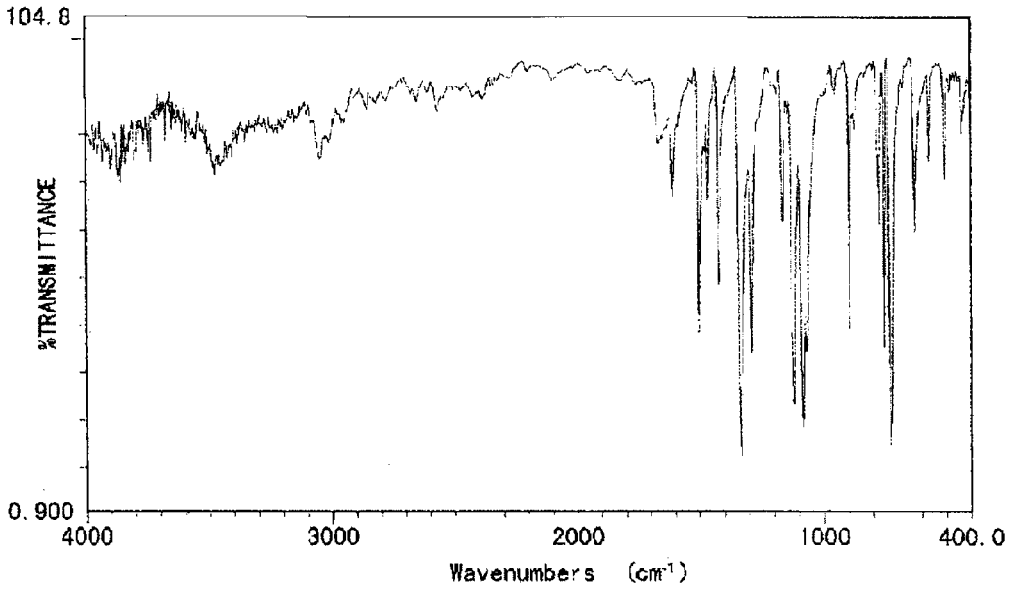
FIG. 29 is an IR absorption spectrum chart of a hydroxygallium porphyrazine derivative mixture (mixture No. A-9) synthesized in Production Example A-6.

FIGS. 28 and 29 respectively show a powder X ray spectrum and an infrared absorption spectrum of the mixture.

TABLE 4

| Ex. | Mixture No. | Mixture No. used | Yield (g) | Results of elemental analysis (%) C | H | N |
|---|---|---|---|---|---|---|
| A-4 | A-7 | A-4 | 3.00 | 63.85 | 2.90 | 18.95 |
| A-5 | A-8 | A-5 | 2.94 | 63.70 | 2.86 | 19.01 |
| A-6 | A-9 | A-6 | 2.96 | 63.05 | 2.77 | 19.95 |

Application Example A-1

A coating liquid having the following composition was added to a ball mill pot, and ball-milled for 48 hours using alumina balls 10 mm in diameter, to thereby prepare an under layer-coating liquid.

—Composition of Coating Liquid—

Oil-free alkyd resin (product of DIC, BECKOLITE M6401): 1.5 parts by mass

Melamine resin (product of DIC, SUPER BECKAMINE G821): 1 part by mass

Titanium dioxide (product of ISHIHARA SANGYO KAISHA LTD., TIPAQUE CR-EL): 5 parts by mass 2-Butanone: 22.5 parts by mass The prepared under layer-coating liquid was coated on an aluminum substrate and dried at 130° C. for 20 min, to thereby form an under layer having a thickness of about 2.5 μm.

Next, a dispersion liquid of the hydroxygallium porphyrazine derivative mixture crystals (mixture No. A-7) (3 parts by mass), a polyvinylbutyral resin (2 parts by mass) (BM-S, product of SEKISUI CHEMICAL CO., LTD.) and tetrahydrofuran (495 parts by mass) was added to a ball mill pot, and ball-milled for 3 hours using PSZ balls 2 mm in diameter, to thereby prepare a charge generation layer-coating liquid. The prepared charge generation layer-coating liquid was coated on the under layer and dried at 100° C. for 20 min, to thereby form a charge generation layer having a thickness of about 0.3 μm.

Then, charge transport material (1) having the following Structural Formula (7 parts by mass), a polycarbonate resin (PCX-5; product of TEIJIN CHEMICALS LTD.) (10 parts by mass), dichloromethane (83 parts by mass) and silicone oil (KF-50; product of Shin-Etsu Chemicals Co., Ltd.) (0.0002 parts by mass) were mixed together to prepare a charge transport layer-coating liquid. The prepared charge transport layer-coating liquid was applied to the charge generation layer and dried at 110° C. for 20 min, to thereby form a charge transport layer having a thickness of about 25 μm. Through the above procedure, an electrophotographic photoconductor was produced.

Charge transport material (1)

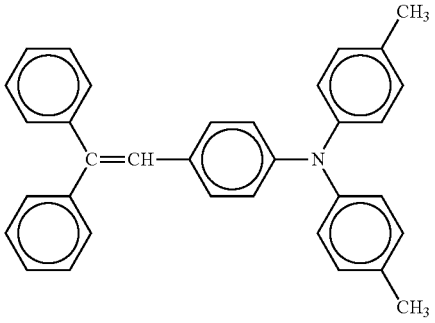

The thus-produced electrophotographic photoconductor was measured for electrostatic characteristics using EPA-8100 (product of Kawaguchi Electric Works) with a dynamic method (1,000 rpm). First, the electrophotographic photoconductor was charged for 20 sec with the applied voltage being −6 kV and then decayed for 20 sec. In this state, the surface potential Vo (V) of the electrophotographic photoconductor was measured. Then, the electrophotographic photoconductor was exposed to white light using a halogen lamp so that the surface luminance of the electrophotographic photoconductor became 5.3 lux. The sensitivity of the electrophotographic photoconductor was measured as the half decay exposure Ew1/2 (lux-sec) calculated from the time required that the surface potential changed from −800 (V) to −400 (V). In addition, the same device was used to apply monochromatic light of 780 nm to the electrophotographic photoconductor so that the surface luminance of the electrophotographic photoconductor became 1 μW/cm$^2$. Then, the sensitivity of the electrophotographic photoconductor in the LD light source region (near-infrared region) was measured as the half decay exposure Em1/2 (μJ/cm$^2$) calculated from the time required that the surface potential changed from −800 (V) to −400 (V). The Vo, Ew1/2 and Em1/2 are shown in Table 5.

TABLE 5

| | Mixture No. | Vo (V) | Ew ½ (lux · sec) | Em ½ (μJ/cm$^2$) |
|---|---|---|---|---|
| Application Ex. A-1 | A-7 | −1,086 | 0.30 | 0.19 |

Comparative Example A-1

Figure 30:
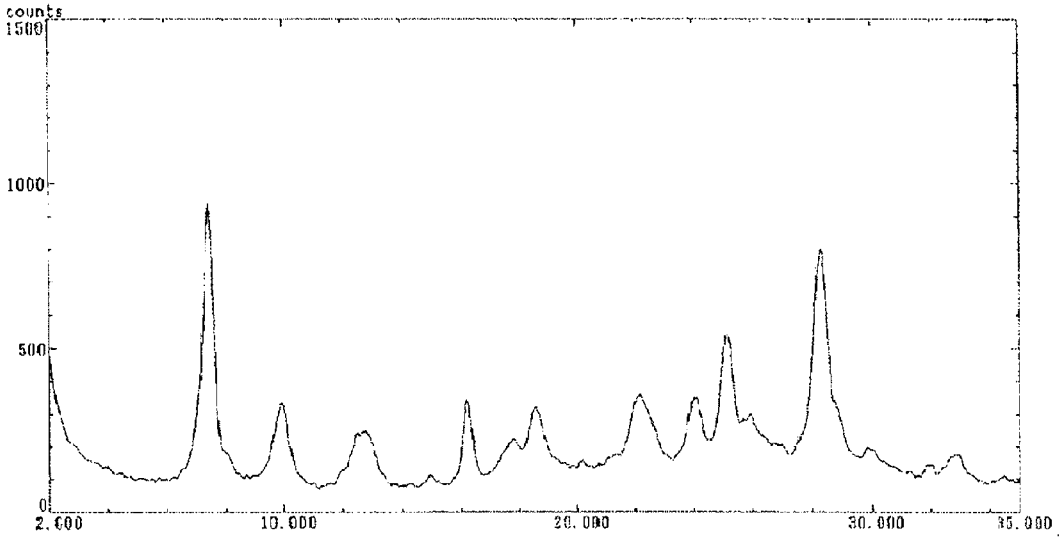
FIG. 30 is a powder X ray spectrum chart of a conventional V-type hydroxygallium phthalocyanine.

The procedure of Application Example A-1 was repeated, except that the hydroxygallium porphyrazine derivative mixture (mixture No. A-7) was changed to V-type hydroxygallium phthalocyanine giving the powder X ray spectrum shown in FIG. 30, to thereby produce an electrophotographic photoconductor. The thus-produced electrophotographic photoconductor was measured for electrostatic fatigue characteristics using EPA-8100 (product of Kawaguchi Electric Works) with a dynamic method (1,000 rpm). The electrophotographic photoconductor was charged with the applied voltage being about −6 kV and exposed to white light using a halogen lamp for 60 min (30 min+30 min) while the electric current passing was being maintained at about 5.6 μA and the charge potential was being maintained at −800 (V). The electrophotographic photoconductor obtained in Application Example A-1 was also measured for electrostatic fatigue characteristics under the same conditions. Changes in surface potential Vo (V) of these electrophotographic photoconductors are shown in FIG. 31.

Figure 31:
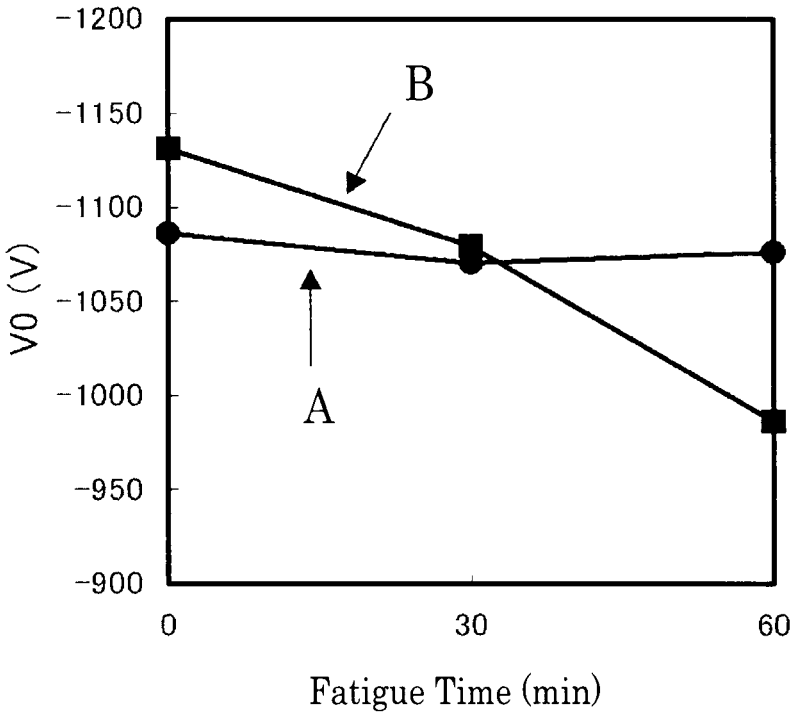
FIG. 31 is a graph showing electrostatic fatigue characteristics (degradation in $V_0$ after repeated light exposure) of an electrophotographic photoconductor of Application Example A-1 using the hydroxygallium porphyrazine derivative mixture (A) of the present invention and an electrophotographic photoconductor of Comparative Example A-1 using a conventional V-type hydroxygallium phthalocyanine.

From FIG. 31, the electrophotographic photoconductor of Application Example A-1 giving a curve indicated by "A" was found to be superior to that of Comparative Example A-1 giving a curve indicated by "B" in terms of stability of charge potential in fatigue characteristics.

Example B-1

A dispersion liquid of the hydroxygallium porphyrazine derivative mixture (mixture No. B-7) (3 parts by mass), a polyvinylbutyral resin (2 parts by mass) (BM-S, product of SEKISUI CHEMICAL CO., LTD.) and tetrahydrofuran (495 parts by mass) was added to a ball mill pot, and ball-milled for 3 hours using PSZ balls 2 mm in diameter, to thereby prepare a charge generation layer-coating liquid. The prepared charge generation layer-coating liquid was coated on a polyester film on which aluminum had been vapor deposited, followed by drying at 100° C. for 20 min, to thereby form a charge generation layer having a thickness of about 0.3 μm.

Then, a charge transport material having the following Structural Formula (41) (7 parts by mass), a polycarbonate resin (PCX-5; product of TEIJIN CHEMICALS LTD.) (10 parts by mass), tetrahydrofuran (83 parts by mass) and silicone oil (KF-50; product of Shin-Etsu Chemicals Co., Ltd.) (0.0002 parts by mass) were mixed together to prepare a charge transport layer-coating liquid. The prepared charge transport layer-coating liquid was applied to the charge generation layer and dried at 110° C. for 20 min, to thereby form a charge transport layer having a thickness of about 25 μm. Through the above procedure, an electrophotographic photoconductor was produced.

Structural Fromula (41)

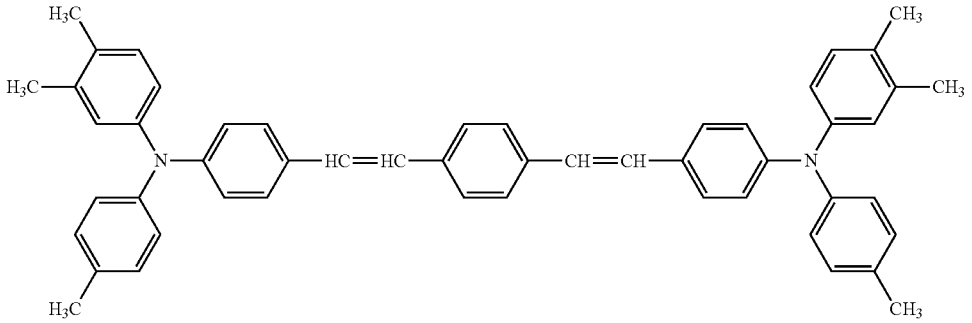

The thus-produced electrophotographic photoconductor was measured for electrostatic characteristics using EPA-8100 (product of Kawaguchi Electric Works) with a dynamic method (1,000 rpm). First, the electrophotographic photoconductor was charged for 20 sec with the applied voltage being −6 kV and then decayed for 20 sec. In this state, the surface potential Vo (V) of the electrophotographic photoconductor was measured. Then, the electrophotographic photoconductor was exposed to white light using a halogen lamp so that the surface luminance of the electrophotographic photoconductor became 5.3 lux. The sensitivity of the electrophotographic photoconductor was measured as the half decay exposure Ew1/2 (lux-sec) calculated from the time required that the surface potential changed from −800 (V) to −400 (V). In addition, the same device was used to apply monochromatic light of 780 nm to the electrophotographic photoconductor so that the surface luminance of the electrophotographic photoconductor became 1 $\mu W/cm^2$. Then, the sensitivity of the electrophotographic photoconductor in the LD light source region (near-infrared region) was measured as the half decay exposure Em1/2 ($\mu J/cm^2$) calculated from the time required that the surface potential changed from −800 (V) to −400 (V). The Vo, Ew1/2 and Em1/2 are shown in Table 6.

Example B-2

The procedure of Example B-1 was repeated, except that the hydroxygallium porphyrazine derivative mixture was changed to mixture No. B-8, to thereby produce and evaluate an electrophotographic photoconductor. The results are shown in Table 6.

Example B-3

The procedure of Example B-1 was repeated, except that the hydroxygallium porphyrazine derivative mixture was changed to mixture No. B-9, to thereby produce and evaluate an electrophotographic photoconductor. The results are shown in Table 6.

Example B-4

The procedure of Example B-1 was repeated, except that the hydroxygallium porphyrazine derivative mixture was changed to mixture No. B-10, to thereby produce and evaluate an electrophotographic photoconductor. The results are shown in Table 6.

Example B-5

The procedure of Example B-1 was repeated, except that the hydroxygallium porphyrazine derivative mixture was changed to mixture No. B-11, to thereby produce and evaluate an electrophotographic photoconductor. The results are shown in Table 6.

Example B-6

The procedure of Example B-1 was repeated, except that the hydroxygallium porphyrazine derivative mixture was changed to mixture No. B-12, to thereby produce and evaluate an electrophotographic photoconductor. The results are shown in Table 6.

Example B-7

The procedure of Example B-1 was repeated, except that the hydroxygallium porphyrazine derivative mixture was changed to mixture No. B-13, to thereby produce and evaluate an electrophotographic photoconductor. The results are shown in Table 6.

Example B-8

The charge transport layer-coating liquid used in Example B-1 was blade coated on a polyester film on which aluminum had been vapor deposited, followed by drying at 120° C. for 10 min, to thereby form a charge transport layer having a thickness of about 20 μm. The hydroxygallium porphyrazine derivative mixture (mixture No. B-8) produced in Production Example 8 (13.5 parts by mass), a polyvinylbutyral resin (product of Union Carbide Plastic Co., XYHL) (5.4 parts by mass), tetrahydrofuran (680 parts by mass) and ethylcellosolve (1,020 parts by mass) were mixed together in a ball mill. Then, ethylcellosolve (1,700 parts by mass) was added to and mixed with the resultant mixture, to thereby prepare a charge generation layer-coating liquid. The prepared charge generation layer-coating liquid was spray coated on the charge transport layer and dried at 100° C. for 10 min, to thereby form a charge generation layer having a thickness of about 0.2 μm. In addition, a methanol/n-butanol solution of a polyamide resin (product of Toray, CM-8000) was spray coated on the charge generation layer, followed by drying at 120° C. for 30 min, to thereby form a protective layer having a thickness of about 0.5 μm. Through the above procedure, an electrophotographic photoconductor was produced. The produced electrophotographic photoconductor was evaluated for characteristics in the same manner as in Example B-1 except that the applied voltage was changed to +6 kV. The results are shown in Table 6.

Structural Formula (42)

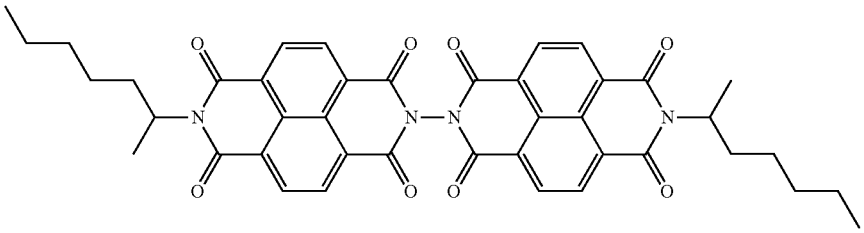

Structural Formula (43)

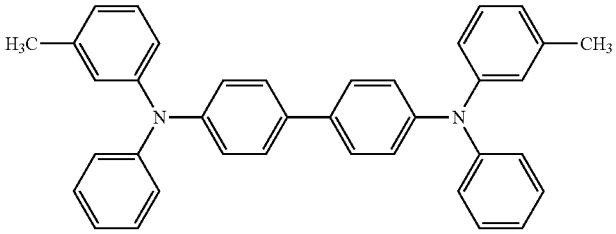

Example B-9

Methyl ethyl ketone (158 parts by mass) was added to the hydroxygallium porphyrazine derivative mixture (mixture No. B-10) produced in Production Example 10 (1 part by mass). The resultant mixture was ball milled for 24 hours using alumina balls 5 mm in diameter. Next, a charge transport material having the following Structural Formula (42) (7 parts by mass), a hole transport material having the following Structural Formula (43) (5 parts by mass) and a polyester resin (product of Du Pont Co., POLYESTER ADHESIVE 49000) (18 parts by mass) were added thereto, followed by mixing. The resultant dispersion liquid was coated with a doctor blade on a polyester film on which aluminum had been vapor deposited, followed by drying at 100° C. for 30 min, to thereby form a photoconductive layer having a thickness of about 25 μm. Through the above procedure, an electrophotographic photoconductor was produced.

The produced electrophotographic photoconductor was evaluated for characteristics in the same manner as in Example B-1 except that the applied voltage was changed to +6 kV. The results are shown in Table 6.

Example B-10

The procedure of Example B-1 was repeated, except that an azo pigment having the following Structural Formula (44) (1 part by mass) was added to the charge generation layer-coating liquid, followed by mixing and ball milling, to thereby produce and evaluate an electrophotographic photoconductor. The results are shown in Table 6.

Structural Formula (44)

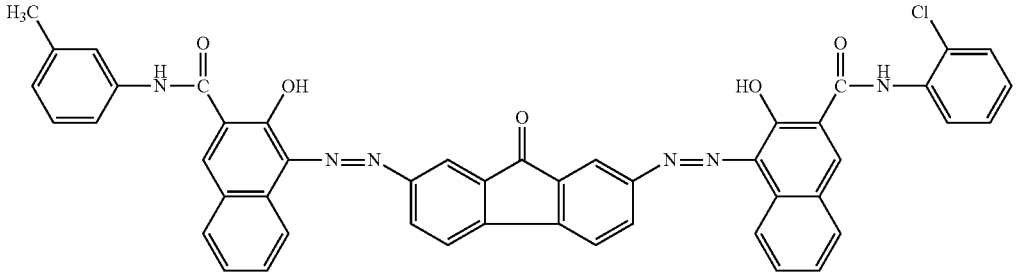

Example B-11

Figure 32:
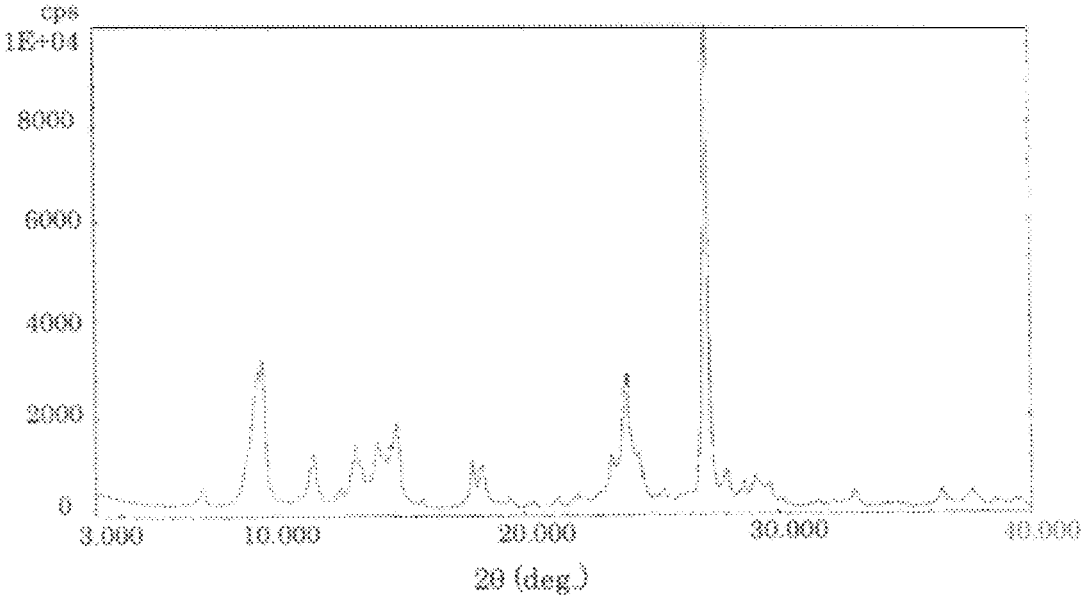
FIG. 32 is a powder X ray spectrum chart of Y-type Ti-phthalocyanine having Structural Formula (45) used Example B-11 in combination.

The procedure of Example B-10 was repeated, except that the azo pigment in the charge generation layer-coating liquid was changed to Y-type titanyl phthalocyanine having the following Structural Formula (45) giving the powder X ray spectrum shown in FIG. 32 (1 part by mass), to thereby produce and evaluate an electrophotographic photoconductor. The results are shown in Table 6.

Structural Formula (45)

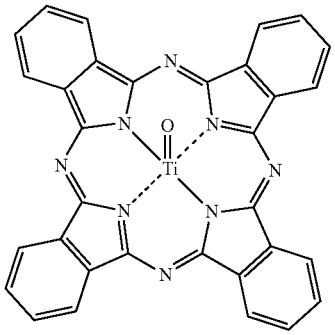

Comparative Example B-1

Figure 33:
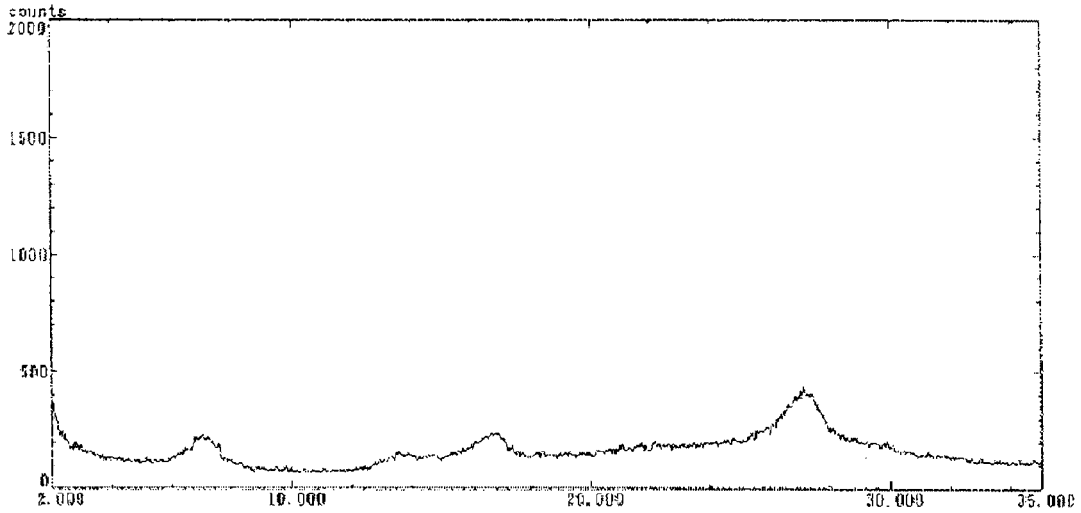
FIG. 33 is a powder X ray spectrum chart of HO—Ga porphyrazine having Structural Formula (46) used in Comparative Example B-1 (comparative compound No. B-1).

The procedure of Production Example 1 was repeated, except that the phthalonitrile was changed to an equimolar of 2,3-dicyanopyridine, to thereby produce 5.90 g of chlorogallium tetrapyridoporphyrazine (yield: 66.8%). The produced chlorogallium tetrapyridoporphyrazine was treated in the same manner as in Production Example 7 to thereby produce 2.94 g of hydroxygallium tetrapyridoporphyrazine having the following Structural Formula (46) (comparative compound No. B-1). The powder X ray spectrum of the hydroxygallium tetrapyridoporphyrazine is shown in FIG. 33.

In addition, the procedure of Example B-1 was repeated, except that the hydroxygallium porphyrazine derivative mixture (mixture No. B-7) was changed to the comparative compound No. B-1, to thereby produce and evaluate an electrophotographic photoconductor. The results are shown in Table 6.

Structural Formula (46): Comparative Compound No. B-1

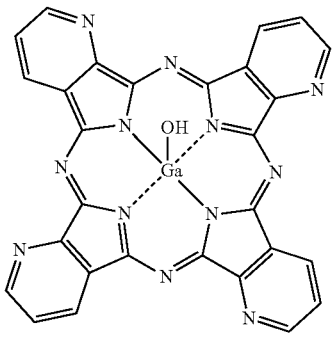

Comparative Example B-2

According to the method of Example 16 described in JP-B No. 03-27111, a copper porphyrazine derivative mixture (comparative mixture No. B-2) was produced in the following manner and evaluated.

Specifically, pyridine-3,4-dicarboxylic acid (0.84 g, 5.0 mmol), phthalic anhydride (14.07 g, 95.0 mmol), urea (24.02 g, 400 mmol), copper(I) chloride (2.48 g, 25 mmol), sodium molybdate tetrahydrate (0.04 g) and trichlorobenzene (80 g) were stirred and heated at 181° C. to 182° C. under nitrogen flow for 15 hours. After the resultant mixture had been left to cool, methanol (80 mL) was added thereto, followed by refluxing for min, cooling to room temperature and filtrating. The obtained crystals were washed sequentially with toluene, methanol, 3% by mass aqueous sodium hydroxide solution, water, 1% by mass hydrochloric acid and water, followed by drying with heating under reduced pressure at 100° C. for 2 days. The obtained blue powder was washed with dioxane for 2 days using a Soxhlet extractor, and dried with heating under reduced pressure at 100° C. for 2 days, to thereby produce 12.51 g of a copper porphyrazine derivative mixture (comparative mixture No. B-2) as blue powder.

Figure 34:
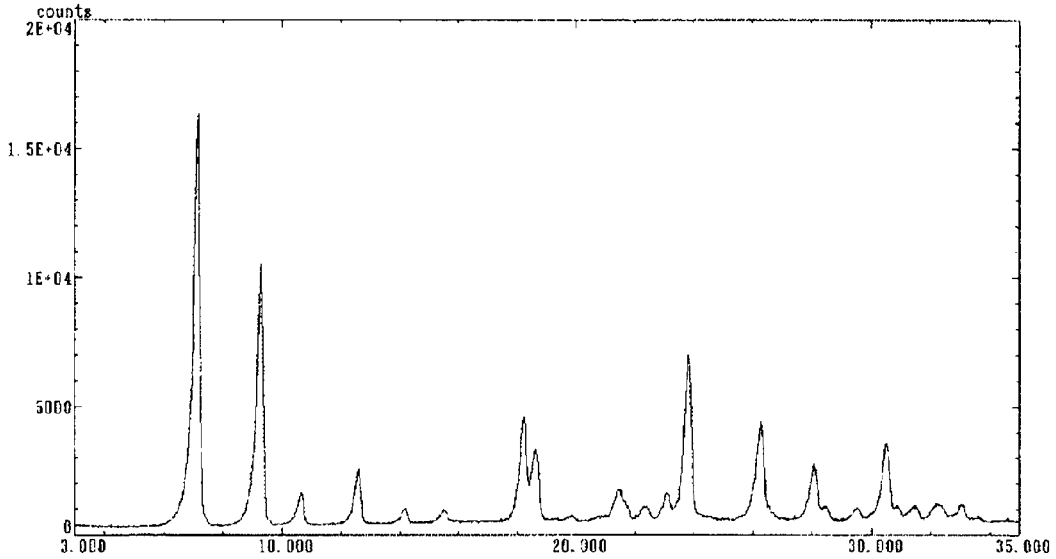
FIG. 34 is an X ray spectrum chart of a copper porphyrazine derivative mixture used in Comparative Example B-2.

The powder X ray spectrum of the obtained copper porphyrazine derivative mixture is shown in FIG. 34.

In addition, the procedure of Example B-1 was repeated, except that the hydroxygallium porphyrazine derivative mixture (mixture No. B-7) was changed to the comparative compound No. B-2, to thereby produce and evaluate an electrophotographic photoconductor. The results are shown in Table 6.

TABLE 6

| Ex. No. | Mixture No. | Vo (V) | Ew ½ (lux · sec) | Em ½ (μJ/cm$^2$) |
|---|---|---|---|---|
| B-1 | B-7 | −1,086 | 0.30 | 0.19 |
| B-2 | B-8 | −982 | 0.32 | 0.22 |
| B-3 | B-9 | −1,034 | 0.45 | 0.30 |
| B-4 | B-10 | −994 | 0.31 | 0.20 |
| B-5 | B-11 | −838 | 0.43 | 0.31 |
| B-6 | B-12 | −825 | 0.44 | 0.37 |
| B-7 | B-13 | −1,024 | 0.34 | 0.25 |
| B-8 | B-8 | +1,034 | 0.35 | 0.25 |
| B-9 | B-10 | +1,093 | 0.40 | 0.29 |
| B-10 | B-7 | −1,122 | 0.29 | 0.18 |
| B-11 | B-7 | −826 | 0.24 | 0.16 |
| Comp. Ex. B-1 | Comp. Compound No. B-1 | −467 | 3.02 | 2.26 |
| Comp. Ex. B-2 | Comp. Mixture No. B-2 | −585 | Photosensitivity was not observed | Photosensitivity was not observed |

As is clear from Table 6, the electrophotographic photoconductors produced using the hydroxygallium porphyrazine derivative mixtures (B) were found to much superior to the electrophotographic photoconductors of Comparative Examples B-1 and B-2 in terms of charge potential Vo and sensitivities Ew1/2 and Em1/2.

Example B-12

An aluminum cylinder was coated through dip coating sequentially with an under layer-coating liquid, a charge generation layer-coating liquid and a charge transport layer-coating liquid each having the following composition, followed by drying a 3.5 μm thick under layer, a 0.2 μm thick charge generation layer, and a 23 μm thick charge transport layer.

Under Layer-Coating Liquid

Titanium dioxide powder (product of ISHIHARA SANGYO KAISHA LTD., TIPAQUE CR-EL): 400 parts by mass Melamine resin (product of DIC, SUPER BECKAMINE G821-60): 65 parts by mass Alkyd resin (product of DIC, BECKOLITE M6401-50): 120 parts by mass 2-Butanone: 400 parts by mass Charge Generation Layer-Coating Liquid Hydroxygallium porphyrazine derivative mixture (mixture No. B-7): 18 parts by mass Polyvinylbutyral resin (BX-1, product of SEKISUI CHEMICAL CO., LTD.): 12 parts by mass 2-Butanone: 970 parts by mass Charge Transport Layer-Coating Liquid Polycarbonate resin (Z POLYCA, product of TEIJIN CHEMICALS LTD.): 10 parts by mass Hole transport material having the following Structural Formula (47): 7 parts by mass
Tetrahydrofuran: 100 parts by mass Structural Formula (47)

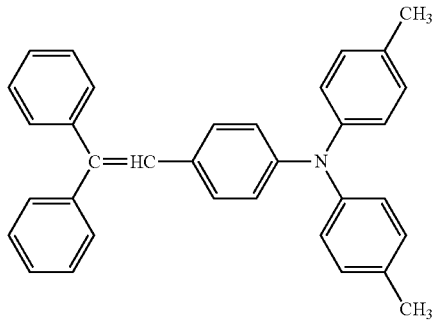

The thus-produced electrophotographic photoconductor was mounted in an electrophotographic process cartridge. The electrophotographic process cartridge was mounted in a remodeled IMAGIO MF2200 (product of Ricoh Company, Ltd.), employing a roller charging method and a laser diode (LD, wavelength: 780 nm) serving as a light source for image-wise light exposure. The remodeled IMAGIO MF2200 was set to −800 (V) in post-charge potential and to −100 (V) in post-exposure potential, and then subjected to a repeated printing test comparable to continuous printing of 100,000 sheets, to thereby evaluate the post-charge potential (V) and the post-exposure potential (V). The results are shown in Table 7.

Example B-13

The procedure of Example B-12 was repeated, except that the hydroxygallium porphyrazine derivative mixture (mixture No. B-7) was changed to mixture No. B-8, to thereby produce and evaluate an electrophotographic photoconductor. The results are shown in Table 7.

Example B-14

The procedure of Example B-12 was repeated, except that the hydroxygallium porphyrazine derivative mixture (mixture No. B-7) was changed to mixture No. B-9, to thereby produce and evaluate an electrophotographic photoconductor. The results are shown in Table 7.

Example B-15

The procedure of Example B-12 was repeated, except that the hydroxygallium porphyrazine derivative mixture (mixture No. B-7) was changed to mixture No. B-10, to thereby produce and evaluate an electrophotographic photoconductor. The results are shown in Table 7.

Example B-16

The procedure of Example B-12 was repeated, except that the hydroxygallium porphyrazine derivative mixture (mixture No. B-7) was changed to mixture No. B-11, to thereby produce and evaluate an electrophotographic photoconductor. The results are shown in Table 7.

Example B-17

The procedure of Example B-12 was repeated, except that the hydroxygallium porphyrazine derivative mixture (mixture No. B-7) was changed to mixture No. B-12, to thereby produce and evaluate an electrophotographic photoconductor. The results are shown in Table 7.

Example B-18

The procedure of Example B-12 was repeated, except that the hydroxygallium porphyrazine derivative mixture (mixture No. B-7) was changed to mixture No. B-13, to thereby produce and evaluate an electrophotographic photoconductor. The results are shown in Table 7.

Example B-19

The procedure of Example B-12 was repeated, except that the charge generation layer-coating liquid was changed to the charge generation layer-coating liquid used in Example B-10, to thereby produce and evaluate an electrophotographic photoconductor. The results are shown in Table 7.

Example B-20

The procedure of Example B-12 was repeated, except that the charge generation layer-coating liquid was changed to the charge generation layer-coating liquid used in Example B-11, to thereby produce and evaluate an electrophotographic photoconductor. The results are shown in Table 7.

Comparative Example B-3

Figure 35:
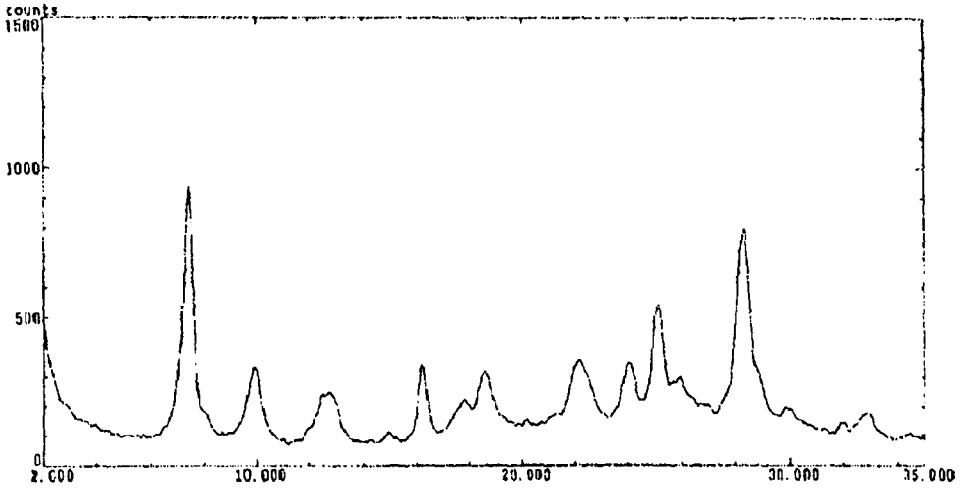
FIG. 35 is a powder X ray spectrum chart of V-type HO—Ga derivative mixture used in Comparative Example B-3 (comparative compound No. B-3).

The procedure of Example B-12 was repeated, except that the hydroxygallium porphyrazine derivative mixture (mixture No. B-7) was changed to a type V hydroxygallium phthalocyanine (comparative compound No. B-3) having the following Structural Formula (48) and giving the powder X ray spectrum shown in FIG. 35, to thereby produce and evaluate an electrophotographic photoconductor. The results are shown in Table 7.

Structural Formula (48)

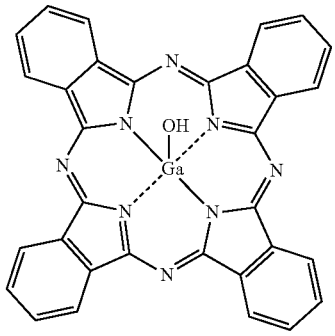

Comparative Compound No. B-3

TABLE 7

| Ex. No. | Mixture No. | After repeated printing test comparable to continuous printing of 100,000 sheets: Post-charge potential (V) | Post-exposure potential (V) |
|---|---|---|---|
| B-12 | B-7 | −795 | −115 |
| B-13 | B-8 | −755 | −105 |
| B-14 | B-9 | −805 | −105 |
| B-15 | B-10 | −805 | −115 |
| B-16 | B-11 | −795 | −110 |
| B-17 | B-12 | −795 | −120 |
| B-18 | B-13 | −800 | −120 |
| B-19 | B-7 | −790 | −110 |
| B-20 | B-7 | −785 | −135 |
| Comp. Ex. B-3 | Comp. Compound B-3 | −585 | −165 |

As is clear from Table 7, any of the electrophotographic photoconductors of the present invention was found to be superior to the electrophotographic photoconductor of Comparative Example B-3 in terms of charge potential and stability of sensitivity after the repeated printing test.

Example B-21

The electrophotographic photoconductor produced in Example B-12 was mounted in a remodeled IMAGIO MF2200 (product of Ricoh Company, Ltd.), which was set so that the post-charge potential was −800 (V) and the post-exposure potential was −100 (V) under normal-temperature, normal-humidity conditions (23° C., 55%). This electrophotographic photoconductor was left to stand for 4 hours in an environmental test room under low-temperature, low-humidity conditions (10° C., 15%), to thereby evaluate the post-charge potential (V) and the post-exposure potential (V) under low-temperature, low-humidity conditions.

The results are shown in Table 8.

Example B-22

The procedure of Example B-21 was repeated, except that the charge generation layer-coating liquid was changed to the charge generation layer-coating liquid used in Example B-11, to thereby produce an electrophotographic photoconductor and evaluate the electrophotographic photoconductor for changes in the post-charge potential (V) and the post-exposure potential (V) under low-temperature, low-humidity conditions. The results are shown in Table 8.

Comparative Example B-4

The procedure of Example B-21 was repeated, except that the hydroxygallium porphyrazine derivative mixture (mixture No. B-7) was changed to a type Y titanylphthalocyanine pigment (comparative compound No. B-4) having the following Structural Formula (49) and giving the powder X ray spectrum shown in FIG. 32, to thereby produce an electrophotographic photoconductor and evaluate the electrophotographic photoconductor for changes in the post-charge potential (V) and the post-exposure potential (V) under low-temperature, low-humidity conditions. The results are shown in Table 8.

Structural Formula (49)

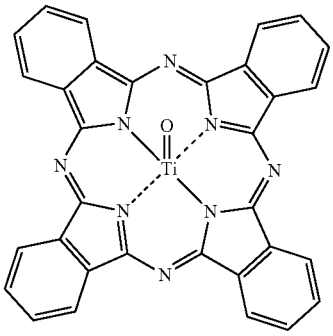

Comparative Compound No. B-4

Comparative Example B-5

Phthalonitrile (19.48, g, 152.0 mmol), 2,3-dicyanopyridine (1.03 g, 8.00 mmol), tetra-n-butyl orthotitanate (14.97 g, 44.00 mmol), urea (4.80 g, 80.00 mmol) and 1-octanol (24.48 g) were stirred and heated under nitrogen flow at 150° C. to 161° C. for 6 hours. After the resultant mixture had been left to cool, methanol (80 mL) was added thereto, followed by refluxing for 30 min, cooling to room temperature, and filtrating. The obtained crystals were washed with toluene, methanol and water, and then dried and heated under reduced pressure, to thereby produce 19.38 g of titanylporphyrazine derivative mixture as blue powder (yield: 84.0%). Next, concentrated sulfuric acid (80 g) was stirred and cooled in an ice water bath. The obtained titanylporphyrazine derivative mixture (5.00 g) was added portionwise thereto for 30 min for dissolution. After stirring for one hour, the mixture was added dropwise to ice water (500 g), followed by stirring for 30 min and then filtrating, to thereby obtain 28.9 g of a wet cake (solid content concentration: 17.3%).

Ion exchange water (9.7 g) and tetrahydrofuran (120 g) were added to 17.3 g of the wet cake, followed by stirring at room temperature for 6 hours, filtrating and drying under reduced pressure, to thereby obtain 2.72 g of a titanylporphyrazine derivative mixture (comparative mixture No. B-5) as blue crystals.

Figure 36:
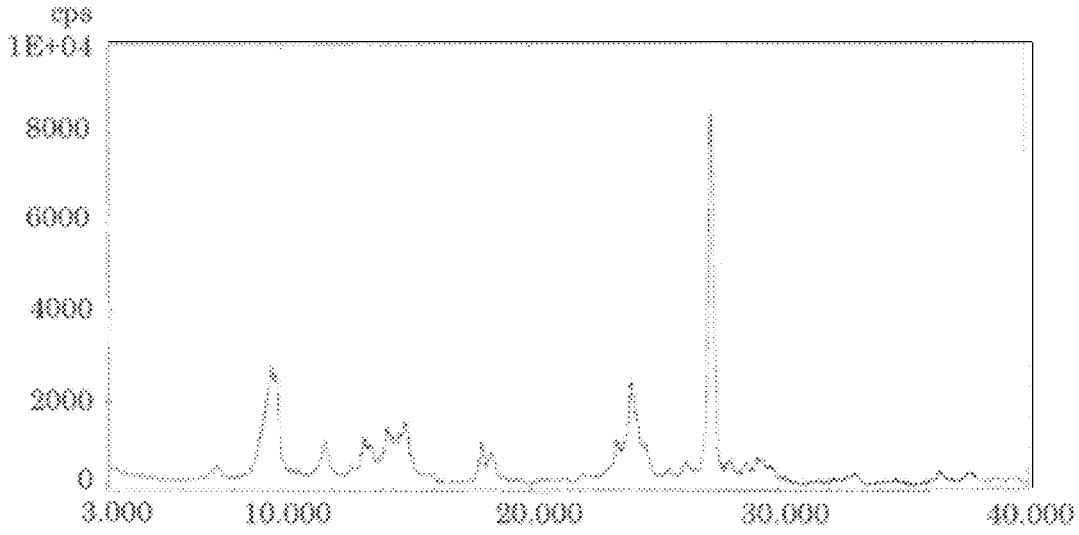
FIG. 36 is a powder X ray spectrum chart of Y-type Ti-phthalocyanine used in Comparative Example B-5.

The powder X ray spectrum of the obtained titanylporphyrazine derivative mixture is shown in FIG. 36.

The procedure of Example B-21 was repeated, except that the hydroxygallium porphyrazine derivative mixture (mixture No. B-7) was changed to the titanylporphyrazine derivative mixture (comparative mixture No. B-5), to thereby produce an electrophotographic photoconductor and evaluate the electrophotographic photoconductor for changes in the post-charge potential (V) and the post-exposure potential (V) under low-temperature, low-humidity conditions. The results are shown in Table 8.

TABLE 8

| Ex. No. | Mixture No. | Surface potential under low-temperature, low-humidity conditions: Post-charge potential (V) | Post-exposure potential (V) |
|---|---|---|---|
| B-21 | B-7 | −795 | −105 |
| B-22 | B-7 | −790 | −110 |

TABLE 8-continued

| Ex. No. | Mixture No. | Surface potential under low-temperature, low-humidity conditions: Post-charge potential (V) | Post-exposure potential (V) |
|---|---|---|---|
| Comp. Ex. B-4 | Comp. Compound B-4 | −685 | −175 |
| Comp. Ex. B-5 | Comp. Mixture B-5 | −780 | −145 |

As is clear from Table 8, the electrophotographic photoconductors of the present invention, having the photoconductive layer containing the hydroxygallium porphyrazine derivative mixtures (B) were found to be smaller than the electrophotographic photoconductors of Comparative Examples Nos. B-4 and B-5 in terms of changes in chargeability and sensitivity even under low-temperature, low-humidity conditions.

As is clear from the above description, the electrophotographic photoconductor of the present invention, having the photoconductive layer containing the hydroxygallium porphyrazine derivative mixture (B), has high sensitivity in the visible light region and the near-infrared light region and involves the following to a less extent: decrease in chargeability and increase in residual potential (decrease in sensitivity) caused by repeated fatigue, and change in them depending on the temperature and humidity. Also, an electrophotographic method, an electrophotographic apparatus and a process cartridge for electrophotography each using this electrophotographic photoconductor are also useful.

The embodiments of the present invention are as follows, for example.

<1> A hydroxygallium porphyrazine derivative mixture including:

a plurality of different hydroxygallium porphyrazine derivatives each represented by the following General Formula (A-2):

General Formula (A-2)

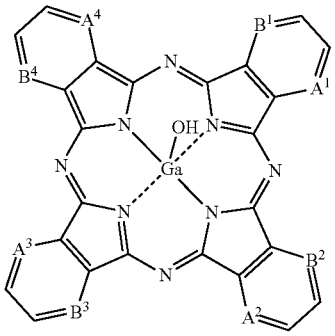

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

<2> The hydroxygallium porphyrazine derivative mixture of <1>, wherein the hydroxygallium porphyrazine derivative mixture is obtained by treating with an acid a chlorogallium porphyrazine derivative mixture containing a plurality of different chlorogallium porphyrazine derivatives each represented by the following General Formula (A-1), the chlorogallium porphyrazine derivative mixture being obtained by reacting together phthalonitrile, dicyanopyridine and gallium trichloride:

General Formula (A-1)

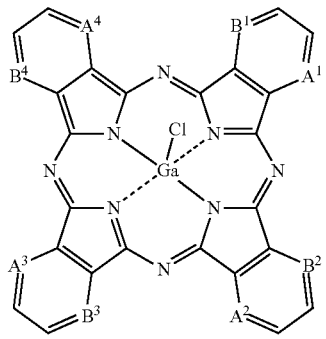

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

<3> The hydroxygallium porphyrazine derivative mixture of <1>, wherein the hydroxygallium porphyrazine derivative mixture includes: hydroxygallium phthalocyanine represented by General Formula (A-2) where $A^1$, $A^2$, $A^3$, $A^4$, $B^1$, $B^2$, $B^3$ and $B^4$ each are carbon atoms each bonded to hydrogen; and a plurality of different hydroxygallium porphyrazine derivatives each represented by General Formula (A-2) where at least one of $A^1$, $A^2$, $A^3$, $A^4$, $B^1$, $B^2$, $B^3$ and $B^4$ is a nitrogen atom.

<4> The hydroxygallium porphyrazine derivative mixture of <3>, wherein the hydroxygallium porphyrazine derivative mixture is obtained by treating with an acid a chlorogallium porphyrazine derivative mixture containing: chlorogallium phthalocyanine represented by the following General Formula (A-1) where $A^1$, $A^2$, $A^3$, $A^4$, $B^1$, $B^2$, $B^3$ and $B^4$ each are a carbon atom bonded to hydrogen; and a plurality of different chlorogallium porphyrazine derivatives each represented by the following General Formula (A-1) where at least one of $A^1$, $A^2$, $A^3$, $A^4$, $B^1$, $B^2$, $B^3$ and $B^4$ is a nitrogen atom, the chlorogallium porphyrazine derivative mixture being obtained by reacting together phthalonitrile, dicyanopyridine and gallium trichloride:

General Formula (A-1)

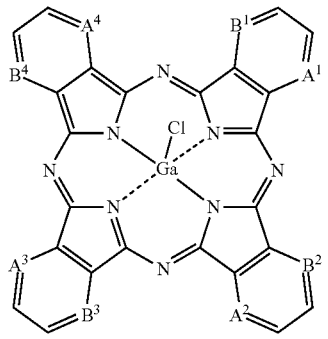

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

<5> The hydroxygallium porphyrazine derivative mixture of any one of <1> to <4>, wherein the hydroxygallium porphyrazine derivative mixture is a crystal having diffraction peaks at Bragg angles (2θ±−0.2°) of 6.9°, 13.8°, 16.6° and 26.4° in an X ray diffraction spectrum obtained using CuKα rays.

<6> The hydroxygallium porphyrazine derivative mixture of any one of <1> to <4>, wherein the hydroxygallium porphyrazine derivative mixture is a crystal having diffraction peaks at Bragg angles (2θ±0.2°) of 7.4°, 16.2°, 25.2° and 28.3° in an X ray diffraction spectrum obtained using CuKα rays.

<7> A hydroxygallium porphyrazine derivative mixture including:

a plurality of different hydroxygallium porphyrazine derivatives each represented by the following General Formula (B-21):

General Formula (B-21)

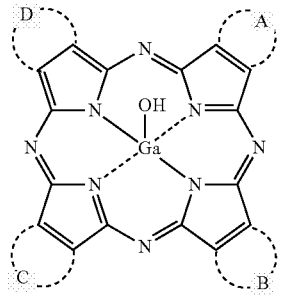

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group.

<8> The hydroxygallium porphyrazine derivative mixture of <7>, wherein the hydroxygallium porphyrazine derivative mixture is obtained by treating with an acid a gallium porphyrazine derivative mixture containing a plurality of gallium porphyrazine derivatives each represented by the following General Formula (B-20), the gallium porphyrazine derivative mixture being obtained by reacting together at least one selected from the group consisting of compounds represented by the following General Formulas (B-1) to (B-6), at least one selected from the group consisting of compounds represented by the following General Formulas (B-7) to (B-18), and a gallium compound represented by the following General Formula (B-19):

General Formula (B-1)

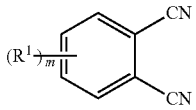

General Formula (B-2)

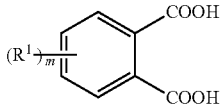

General Formula (B-3)

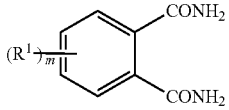

General Formula (B-4)

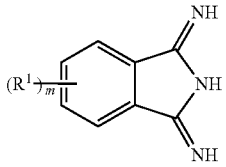

General Formula (B-5)

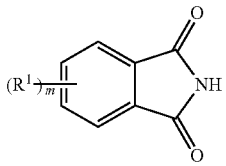

General Formula (B-6)

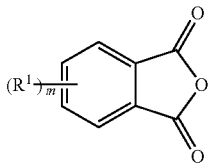

in each of the General Formulas (B-1) to (B-6), $R^1$ represents a halogen atom, an alkyl group, a hydroxyl group or a benzo group, and m is an integer of 0 to 4, where when m is an integer of 2 or greater, R's may be identical or different, General Formula (B-7)

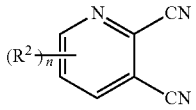

-continued

General Formula (B-8)

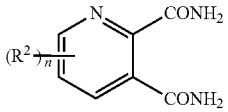

General Formula (B-9)

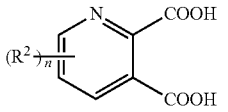

General Formula (B-10)

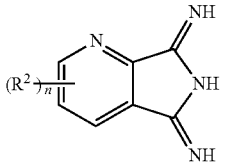

General Formula (B-11)

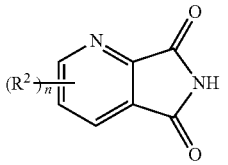

General Formula (B-12)

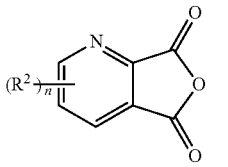

General Formula (B-13)

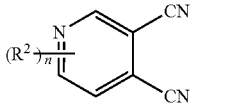

General Formula (B-14)

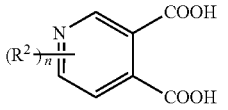

General Formula (B-15)

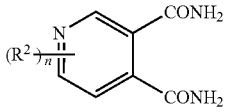

General Formula (B-16)

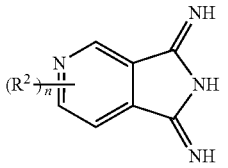

General Formula (B-17)

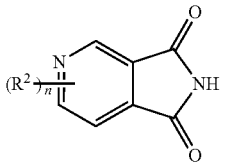

-continued

General Formula (B-18)

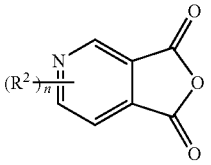

in each of the General Formulas (B-7) to (B-18), $R^2$ represents a nitro group, a halogen atom, an alkyl group, an alkoxy group, a hydroxyl group or a benzo group, and n is an integer of 0 to 3, where when n is an integer of 2 or greater, $R^2$s may be identical or different, General Formula (B-19)

$$Ga(R^3)_3$$

where $R^3$ represents a halogen atom or an alkoxy group,

General Formula (B-20)

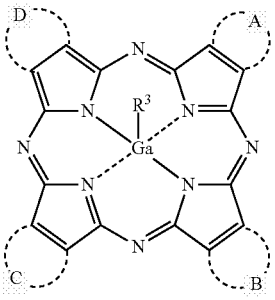

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group, and $R^3$ represents an halogen atom or an alkoxy group.

<9> The hydroxygallium porphyrazine derivative mixture of <7>, wherein the hydroxygallium porphyrazine derivative mixture includes: a hydroxygallium phthalocyanine derivative represented by General Formula (B-21) where A, B, C and D each represent a benzo group which may have a substituent; and a plurality of different hydroxygallium porphyrazine derivatives each represented by General Formula (B-21) where at least one of A, B, C and D represents a pyrido group which may have a substituent.

<10> The hydroxygallium porphyrazine derivative mixture of <9>, wherein the hydroxygallium porphyrazine derivative mixture is obtained by treating with an acid a gallium porphyrazine derivative mixture containing: a gallium phthalocyanine derivative represented by the following General Formula (B-20) where A, B, C and D each represent a benzo group which may have a substituent; and a plurality of different gallium porphyrazine derivatives each represented by the following General Formula (B-20) where at least one of A, B, C and D represents a pyrido group which may have a substituent, the gallium porphyrazine derivative mixture being obtained by reacting together at least one selected from the group consisting of compounds represented by the following General Formulas (B-1) to (B-6), at least one selected from the group consisting of compounds represented by the following General Formulas (B-7) to (B-18), and a gallium compound represented by the following General Formula (B-19):

General Formula (B-1)

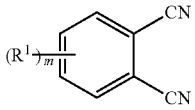

General Formula (B-2)

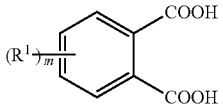

General Formula (B-3)

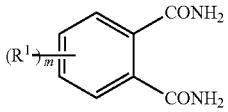

General Formula (B-4)

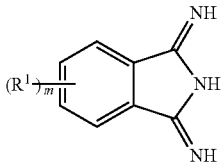

General Formula (B-5)

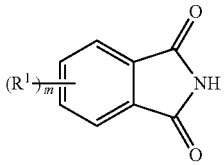

General Formula (B-6)

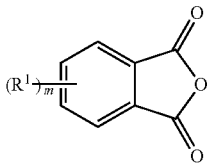

in each of the General Formulas (B-1) to (B-6), $R^1$ represents a halogen atom, an alkyl group, a hydroxyl group or a benzo group, and m is an integer of 0 to 4, where when m is an integer of 2 or greater, $R^1$s may be identical or different, General Formula (B-7)

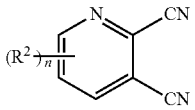

General Formula (B-8)

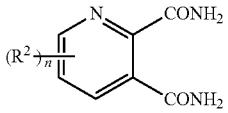

General Formula (B-9)

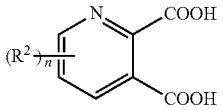

-continued

General Formula (B-10)

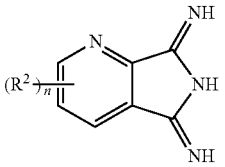

General Formula (B-11)

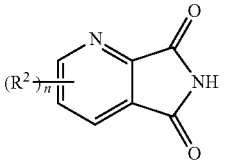

General Formula (B-12)

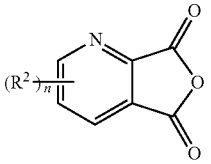

General Formula (B-13)

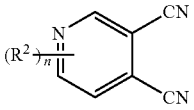

General Formula (B-14)

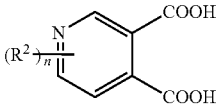

General Formula (B-15)

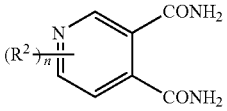

General Formula (B-16)

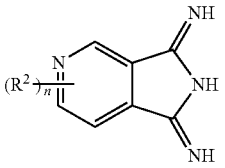

General Formula (B-17)

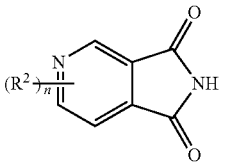

General Formula (B-18)

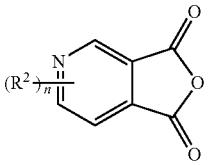

in each of the General Formulas (B-7) to (B-18), $R^2$ represents a nitro group, a halogen atom, an alkyl group, an alkoxy group, a hydroxyl group or a benzo group, and n is an integer of 0 to 3, where when n is an integer of 2 or greater, $R^2$s may be identical or different, $Ga(R^3)_3$ General Formula (B-19)

where $R^3$ represents a halogen atom or an alkoxy group,

General Formula (B-20)

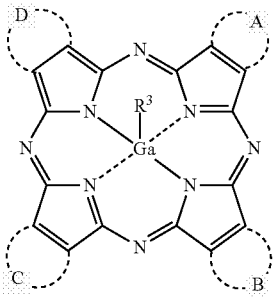

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group, and $R^3$ represents an halogen atom or an alkoxy group.

<11> The hydroxygallium porphyrazine derivative mixture of any one of <7> to <10>, wherein the hydroxygallium porphyrazine derivative mixture has diffraction peaks at Bragg angles (2θ±0.2°) of at least 7.4°, 16.2°, 25.2° and 28.3° in an X ray diffraction spectrum obtained using CuKα rays.

<12> The hydroxygallium porphyrazine derivative mixture of any one of <7> to <11>, wherein in General Formula (B-21), the unsubstituted benzo group or the benzo group which may have as a substituent a halogen atom, an alkyl group, a hydroxyl group or a benzo group is a benzo group having a hydroxyl group.

<13> The hydroxygallium porphyrazine derivative mixture of any one of <7> to <12>, wherein in General Formula (B-21), the unsubstituted pyrido group or the pyrido group which may have as a substituent a nitro group, a halogen atom, an alkyl group, an alkoxy group, a hydroxyl group or a benzo group is a pyrido group having an alkyl group.

<14> The hydroxygallium porphyrazine derivative mixture of any one of <7> to <13>, wherein in General Formula (B-21), the unsubstituted pyrido group or the pyrido group which may have as a substituent a nitro group, a halogen atom, an alkyl group, an alkoxy group, a hydroxyl group or a benzo group is a pyrido group having a halogen atom.

<15> The hydroxygallium porphyrazine derivative mixture of any one of <7> to <14>, wherein in General Formula (B-21), the unsubstituted pyrido group or the pyrido group which may have as a substituent a nitro group, a halogen atom, an alkyl group, an alkoxy group, a hydroxyl group or a benzo group is a pyrido group having a benzo group.

<16> An electrophotographic photoconductor including:

an electrically conductive substrate; and a photoconductive layer laid on the electrically conductive substrate, wherein the photoconductive layer includes a hydroxygallium porphyrazine derivative mixture including a plurality of different hydroxygallium porphyrazine derivatives each represented by the following General Formula (B-21):

General Formula (B-21)

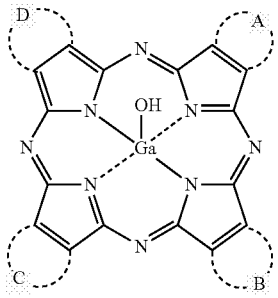

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have as a substituent a nitro group, a halogen atom, an alkyl group, an alkoxy group, a hydroxyl group or a benzo group.

<17> The electrophotographic photoconductor of <16>, wherein the hydroxygallium porphyrazine derivative mixture includes: a hydroxygallium phthalocyanine derivative represented by General Formula (B-21) where A, B, C and D each represent a benzo group which may have a substituent; and a plurality of different hydroxygallium porphyrazine derivatives each represented by General Formula (B-21) where at least one of A, B, C and D represents a pyrido group which may have a substituent.

<18> The electrophotographic photoconductor of <16> or <17>, wherein the photoconductive layer further includes an azo pigment.

<19> The electrophotographic photoconductor of <16> or <17>, wherein the photoconductive layer further includes a phthalocyanine pigment.

<20> The electrophotographic photoconductor of any one of <16> to <19>, wherein the photoconductive layer further includes a charge generation layer and a charge transport layer where the charge generation layer and the charge transport layer are laid on the electrically conductive substrate in this order or the charge transport layer and the charge generation layer are laid on the electrically conductive substrate in this order.

<21> A method for producing a hydroxygallium porphyrazine derivative mixture including a plurality of different hydroxygallium porphyrazine derivatives each represented by the following General Formula (A-2), the method including:

reacting together phthalonitrile, dicyanopyridine and gallium trichloride to prepare a chlorogallium porphyrazine derivative mixture including a plurality of different chlorogallium porphyrazine derivatives each represented by the following General Formula (A-1); and treating the chlorogallium porphyrazine derivative mixture with an acid:

General Formula (A-1)

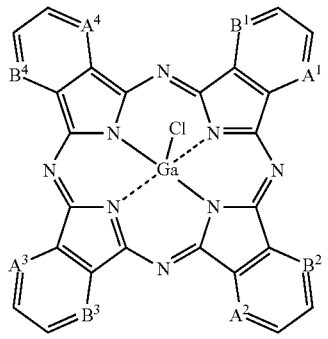

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom, General Formula (A-2)

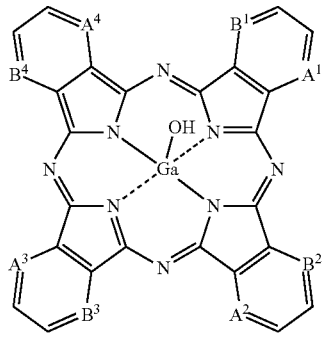

where $A^1$, $A^2$, $A^3$, $A^4$, $B^1$, $B^2$, $B^3$ and $B^4$ each independently represent a nitrogen atom or a carbon atom bonded to hydrogen, with the proviso that both of $A^1$ and $B^1$ are carbon atoms each bonded to hydrogen or only one of $A^1$ and $B^1$ is a nitrogen atom, both of $A^2$ and $B^2$ are carbon atoms each bonded to hydrogen or only one of $A^2$ and $B^2$ is a nitrogen atom, both of $A^3$ and $B^3$ are carbon atoms each bonded to hydrogen or only one of $A^3$ and $B^3$ is a nitrogen atom, and both of $A^4$ and $B^4$ are carbon atoms each bonded to hydrogen or only one of $A^4$ and $B^4$ is a nitrogen atom.

<22> The method for producing a hydroxygallium porphyrazine derivative mixture of <21>, wherein the reacting together phthalonitrile, dicyanopyridine and gallium trichloride is reacting together phthalonitrile, dicyanopyridine and gallium trichloride to prepare a chlorogallium porphyrazine derivative mixture including: chlorogallium phthalocyanine represented by General Formula (A-1) where $A^1$, $A^2$, $A^3$, $A^4$, $B^1$, $B^2$, $B^3$ and $B^4$ each are a carbon atom bonded to hydrogen; and a plurality of different chlorogallium porphyrazine derivatives each represented by General Formula (A-1) where at least one of $A^1$, $A^2$, $A^3$, $A^4$, $B^1$, $B^2$, $B^3$ and $B^4$ is a nitrogen atom.

<23> The method for producing a hydroxygallium porphyrazine derivative mixture of <21> or <22>, wherein the hydroxygallium porphyrazine derivative mixture is a crystal having diffraction peaks at Bragg angles (2θ±0.2°) of 6.9°, 13.8°, 16.6° and 26.4° in an X ray diffraction spectrum obtained using CuKα rays.

<24> The method for producing a hydroxygallium porphyrazine derivative mixture of <21> or <22>, further including treating the hydroxygallium porphyrazine derivative mixture with a solvent to produce a crystal having diffraction peaks at Bragg angles (2θ±0.2°) of 7.4°, 16.2°, 25.2° and 28.3° in an X ray diffraction spectrum obtained using CuKα rays.

This application claims priority to Japanese application No. 2011-052237, filed on Mar. 9, 2011 and Japanese application No. 2011-052410, filed on Mar. 10, 2011 and incorporated herein by reference.

What is claimed is:

1. A hydroxygallium porphyrazine derivative mixture comprising:

a plurality of different hydroxygallium porphyrazine derivatives each represented by the following General Formula (B-21):

General Formula (B-21)

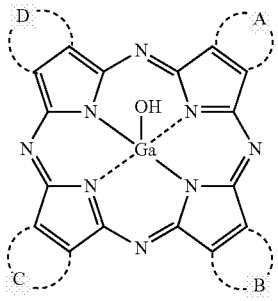

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group.

2. The hydroxygallium porphyrazine derivative mixture of claim 1, wherein the hydroxygallium porphyrazine derivative mixture is obtained by treating with an acid a gallium porphyrazine derivative mixture containing a plurality of gallium porphyrazine derivatives each represented by the following General Formula (B-20), the gallium porphyrazine derivative mixture being obtained by reacting together at least one selected from the group consisting of compounds represented by the following General Formulas (B-1) to (B-6), at least one selected from the group consisting of compounds represented by the following General Formulas (B-7) to (B-18), and a gallium compound represented by the following General Formula (B-19):

General Formula (B-1)

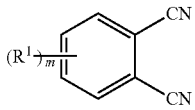

-continued

General Formula (B-2)

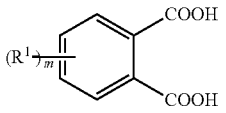

General Formula (B-3)

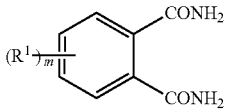

General Formula (B-4)

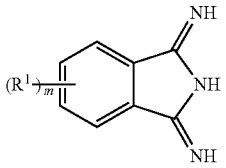

General Formula (B-5)

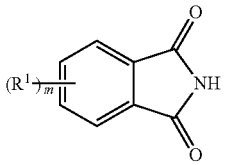

General Formula (B-6)

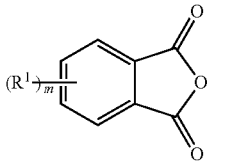

in each of the General Formulas (B-1) to (B-6), $R^1$ represents a halogen atom, an alkyl group, a hydroxyl group or a benzo group, and m is an integer of 0 to 4, where when m is an integer of 2 or greater, $R^1$s may be identical or different, General Formula (B-7)

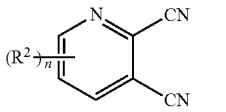

General Formula (B-8)

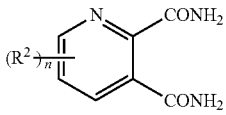

General Formula (B-9)

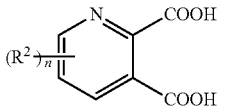

General Formula (B-10)

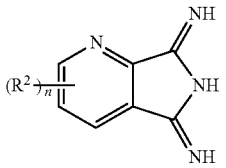

-continued

General Formula (B-11)

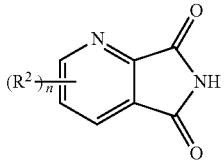

General Formula (B-12)

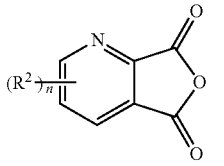

General Formula (B-13)

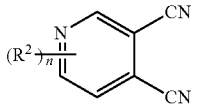

General Formula (B-14)

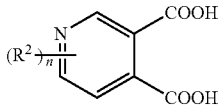

General Formula (B-15)

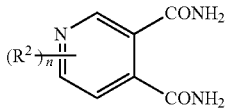

General Formula (B-16)

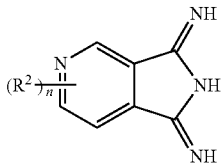

General Formula (B-17)

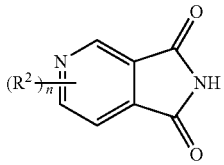

General Formula (B-18)

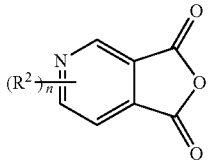

in each of the General Formulas (B-7) to (B-18), $R^2$ represents a nitro group, a halogen atom, an alkyl group, an alkoxy group, a hydroxyl group or a benzo group, and n is an integer of 0 to 3, where when n is an integer of 2 or greater, $R^2$s may be identical or different, $Ga(R^3)_3$ General Formula (B-19)

where $R^3$ represents a halogen atom or an alkoxy group,

General Formula (B-20)

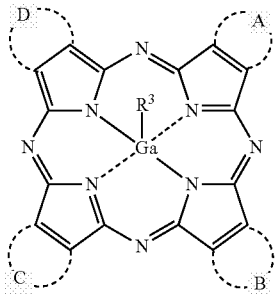

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group, and $R^3$ represents an halogen atom or an alkoxy group.

3. The hydroxygallium porphyrazine derivative mixture of claim 1, wherein the hydroxygallium porphyrazine derivative mixture comprises: a hydroxygallium phthalocyanine derivative represented by General Formula (B-21) where A, B, C and D each represent a benzo group which may have a substituent; and a plurality of different hydroxygallium porphyrazine derivatives each represented by General Formula (B-21) where at least one of A, B, C and D represents a pyrido group which may have a substituent.

4. The hydroxygallium porphyrazine derivative mixture of claim 3, wherein the hydroxygallium porphyrazine derivative mixture is obtained by treating with an acid a gallium porphyrazine derivative mixture containing: a gallium phthalocyanine derivative represented by the following General Formula (B-20) where A, B, C and D each represent a benzo group which may have a substituent; and a plurality of different gallium porphyrazine derivatives each represented by the following General Formula (B-20) where at least one of A, B, C and D represents a pyrido group which may have a substituent, the gallium porphyrazine derivative mixture being obtained by reacting together at least one selected from the group consisting of compounds represented by the following General Formulas (B-1) to (B-6), at least one selected from the group consisting of compounds represented by the following General Formulas (B-7) to (B-18), and a gallium compound represented by the following General Formula (B-19):

General Formula (B-1)

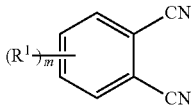

General Formula (B-2)

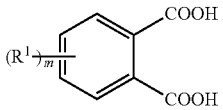

-continued

General Formula (B-3)

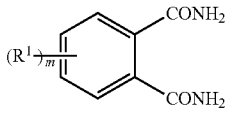

General Formula (B-4)

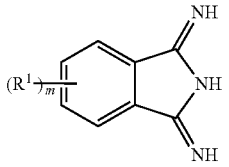

General Formula (B-5)

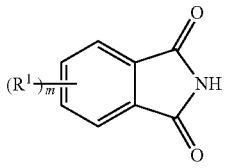

General Formula (B-6)

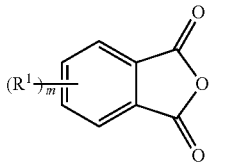

in each of the General Formulas (B-1) to (B-6), $R^1$ represents a halogen atom, an alkyl group, a hydroxyl group or a benzo group, and m is an integer of 0 to 4, where when m is an integer of 2 or greater, Ws may be identical or different, General Formula (B-7)

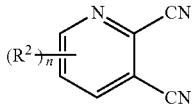

General Formula (B-8)

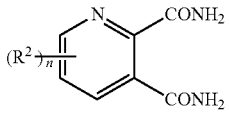

General Formula (B-9)

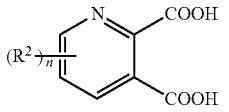

General Formula (B-10)

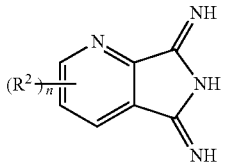

General Formula (B-11)

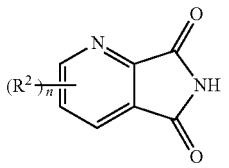

-continued

General Formula (B-12)

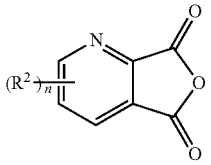

General Formula (B-13)

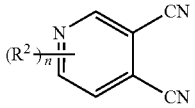

General Formula (B-14)

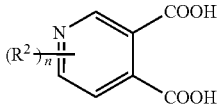

General Formula (B-15)

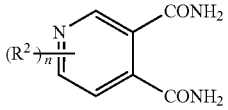

General Formula (B-16)

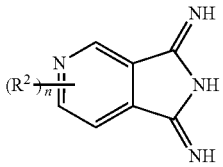

General Formula (B-17)

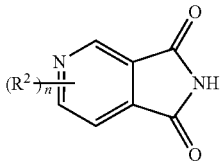

General Formula (B-18)

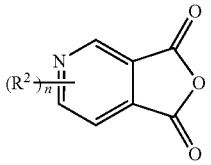

in each of the General Formulas (B-7) to (B-18), $R^2$ represents a nitro group, a halogen atom, an alkyl group, an alkoxy group, a hydroxyl group or a benzo group, and n is an integer of 0 to 3, where when n is an integer of 2 or greater, $R^2$s may be identical or different, $Ga(R^3)_3$ General Formula (B-19)

where $R^3$ represents a halogen atom or an alkoxy group,

General Formula (B-20)

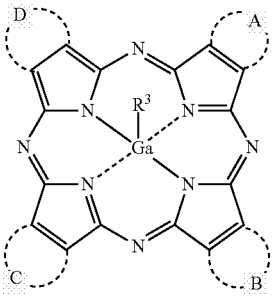

where A, B, C and D each independently represent a group selected from the group consisting of: an unsubstituted benzo group; a benzo group which may have as a substituent a halogen atom, an alkyl group, a hydroxyl group or a benzo group; an unsubstituted pyrido group; and a pyrido group which may have a substituent a nitro group, a halogen atom, an alkyl group, an alkoxy group, a hydroxyl group or a benzo group, and $R^3$ represents an halogen atom or an alkoxy group.

5. The hydroxygallium porphyrazine derivative mixture of claim 1, wherein the hydroxygallium porphyrazine derivative mixture has diffraction peaks at Bragg angles (2θ±0.2°) of at least 7.4°, 16.2°, 25.2° and 28.3° in an X ray diffraction spectrum obtained using CuKα rays.

6. The hydroxygallium porphyrazine derivative mixture of claim 1, wherein in General Formula (B-21), the unsubstituted benzo group or the benzo group which may have as a substituent a halogen atom, an alkyl group, a hydroxyl group or a benzo group is a benzo group having a hydroxyl group.

7. The hydroxygallium porphyrazine derivative mixture of claim 1, wherein in General Formula (B-21), the unsubstituted pyrido group or the pyrido group which may have as a substituent a nitro group, a halogen atom, an alkyl group, an alkoxy group, a hydroxyl group or a benzo group is a pyrido group having an alkyl group.

8. The hydroxygallium porphyrazine derivative mixture of claim 1, wherein in General Formula (B-21), the unsubstituted pyrido group or the pyrido group which may have as a substituent a nitro group, a halogen atom, an alkyl group, an alkoxy group, a hydroxyl group or a benzo group is a pyrido group having a halogen atom.

9. The hydroxygallium porphyrazine derivative mixture of claim 1, wherein in General Formula (B-21), the unsubstituted pyrido group or the pyrido group which may have as a substituent a nitro group, a halogen atom, an alkyl group, an alkoxy group, a hydroxyl group or a benzo group is a pyrido group having a benzo group.

* * * * *